US012698686B2

(12) United States Patent
Steele et al.

(10) Patent No.: US 12,698,686 B2
(45) Date of Patent: Aug. 4, 2026

(54) CLEANING DEVICES AND OPERATIONS FOR DOWNHOLE SEPARATION IN A WELL

(71) Applicant: Halliburton Energy Services, Inc., Houston, TX (US)

(72) Inventors: David J. Steele, Carrollton, TX (US); Matthew Bradley Stokes, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/647,581

(22) Filed: Apr. 26, 2024

(65) Prior Publication Data

US 2025/0101822 A1 Mar. 27, 2025

Related U.S. Application Data

(60) Provisional application No. 63/585,662, filed on Sep. 27, 2023.

(51) Int. Cl.

| | |
|---|---|
| ***E21B 21/06*** | (2006.01) |
| ***E21B 37/00*** | (2006.01) |
| ***E21B 43/38*** | (2006.01) |

(52) U.S. Cl.

CPC ..... *E21B 21/065* (2013.01); *E21B 37/00* (2013.01); *E21B 43/38* (2013.01); *E21B 43/385* (2013.01)

(58) Field of Classification Search

CPC ..... E21B 21/065; E21B 37/00; E21B 43/38

See application file for complete search history.

(56) References Cited

U.S. PATENT DOCUMENTS

| | | | |
|---|---|---|---|
| 1,592,079 | A | 7/1926 | Victor et al. |
| 2,783,716 | A | 3/1957 | Varner |
| 4,771,830 | A | 9/1988 | Peate |

(Continued)

FOREIGN PATENT DOCUMENTS

| | | |
|---|---|---|
| CN | 102235162 | 11/2011 |
| CN | 112240194 | 1/2021 |

(Continued)

OTHER PUBLICATIONS

"U.S. Appl. No. 18/646,388 Non-Final Office Action", Jan. 30, 2025, 11 pages.

(Continued)

*Primary Examiner* — Neel Girish Patel

(74) *Attorney, Agent, or Firm* — DeLizio, Peacock, Lewin and Guerra, LLP

(57) ABSTRACT

A system comprises a downhole separation system configured to be positioned downhole a well formed in a subsurface formation, wherein the downhole separation system is configured to receive formation fluid from the subsurface formation and configured to separate formation fluid into a production fluid and a nonproduction fluid. The downhole separation system comprises at least one device to be positioned in an opening of a downhole tubular through which the formation fluid is to be received from the subsurface formation, wherein the at least one device is to filter out at least a portion of solids in the formation fluid from entering the downhole tubular; and a controller configured to initiate an operation to clean the at least one device using a cleaning fluid.

14 Claims, 30 Drawing Sheets

(56) References Cited

U.S. PATENT DOCUMENTS 5,107,927 A 4/1992 Whiteley et al.
5,165,450 A 11/1992 Marrelli et al.
5,295,537 A 3/1994 Trainer
5,314,018 A 5/1994 Cobb
5,327,960 A * 7/1994 Cornette ..... E21B 43/04 166/227
5,339,912 A 8/1994 Hosie et al.
5,564,509 A 10/1996 Dietzen
5,597,042 A 1/1997 Tubel et al.
5,613,242 A 3/1997 Oddo
5,673,752 A 10/1997 Scudder et al.
5,690,708 A 11/1997 Danckaarts et al.
5,711,374 A 1/1998 Kjos
5,762,149 A * 6/1998 Donovan ..... E21B 43/305 166/313
5,837,152 A 11/1998 Komistek
5,996,690 A 12/1999 Shaw et al.
6,082,452 A 7/2000 Shaw et al.
6,089,317 A 7/2000 Shaw
6,092,599 A 7/2000 Berry et al.
6,131,660 A 10/2000 Stuebinger et al.
6,170,580 B1 1/2001 Reddoch
6,179,071 B1 1/2001 Dietzen
6,189,613 B1 2/2001 Chachula et al.
6,213,208 B1 * 4/2001 Skilbeck ..... E21B 43/40 166/105.1
6,277,286 B1 8/2001 Sontvedt et al.
6,336,504 B1 1/2002 Alhanati et al.
6,378,608 B1 4/2002 Nilsen et al.
6,382,317 B1 5/2002 Cobb
6,394,183 B1 5/2002 Schrenkel et al.
6,698,521 B2 3/2004 Schrenkel et al.
6,719,048 B1 4/2004 Ramos et al.
6,755,978 B2 6/2004 Oddie et al.
7,017,663 B2 3/2006 Polderman et al.
7,971,657 B2 7/2011 Hollier et al.
8,286,805 B2 10/2012 Hopper
8,505,627 B2 * 8/2013 Cox ..... E21B 43/385 166/266
8,695,730 B2 4/2014 Clark et al.
8,783,359 B2 7/2014 Reed
8,950,510 B2 2/2015 Bender
9,289,700 B2 3/2016 Andreussi et al.
9,334,699 B2 5/2016 Bender et al.
9,359,878 B2 6/2016 Whitney et al.
9,441,435 B2 9/2016 Leitch
10,323,494 B2 6/2019 Joshi et al.
10,344,570 B2 7/2019 Steele et al.
10,583,373 B2 3/2020 Braaten et al.
10,626,682 B2 4/2020 Hope et al.
10,767,477 B1 9/2020 Leeper et al.
10,844,699 B2 11/2020 Xiao et al.
11,008,848 B1 5/2021 Webber et al.
11,103,807 B2 8/2021 Oneto et al.
11,143,009 B1 10/2021 Novak et al.
11,173,427 B2 11/2021 Bayati et al.
11,180,396 B2 11/2021 Andreussi et al.
11,285,405 B2 3/2022 Johnson
11,542,817 B1 * 1/2023 McGraw ..... E21B 49/0875
11,643,916 B2 5/2023 Gonzales et al.
11,668,166 B2 6/2023 Lopez De Cardenas et al.
11,708,746 B1 7/2023 Xiao et al.
11,795,365 B1 * 10/2023 Nguyen ..... C09K 8/26
11,828,153 B2 11/2023 Moraes et al.
11,913,322 B1 * 2/2024 Aleid ..... E21B 41/0035
12,006,816 B2 6/2024 Al-Dhafeeri et al.
12,305,498 B2 5/2025 Fripp et al.
12,529,301 B2 1/2026 Donovan et al.
2002/0059866 A1 5/2002 Grant et al.
2002/0134554 A1 9/2002 Schrenkel et al.
2002/0153326 A1 10/2002 Oddie
2003/0098799 A1 5/2003 Zimmerman
2003/0111230 A1 6/2003 Olson et al.
2003/0205522 A1 11/2003 Polderman et al.
2004/0118565 A1 * 6/2004 Crawford ..... E21B 23/08 166/383
2005/0098210 A1 * 5/2005 Strattan ..... E21B 34/105 137/70
2006/0037746 A1 2/2006 Wright et al.
2009/0242490 A1 10/2009 Hopper
2010/0300684 A1 * 12/2010 Kotsonis ..... E21B 37/06 166/65.1
2011/0000675 A1 1/2011 Hackworth et al.
2011/0079388 A1 * 4/2011 Cox ..... E21B 43/38 166/266
2012/0006543 A1 1/2012 Cox et al.
2012/0043088 A1 2/2012 Mcallister et al.
2012/0080186 A1 4/2012 Reed
2012/0285680 A1 11/2012 Kumar
2013/0112598 A1 5/2013 Culver
2013/0292327 A1 11/2013 Andreussi et al.
2013/0312955 A1 11/2013 Medoff
2013/0313200 A1 11/2013 Andreussi et al.
2014/0014358 A1 1/2014 Leitch
2014/0332391 A1 11/2014 Munisteri
2015/0075772 A1 3/2015 Saponja et al.
2015/0152715 A1 * 6/2015 Cunningham ..... E21B 34/066 166/205
2015/0306520 A1 10/2015 Grave et al.
2015/0345264 A1 12/2015 Johnson
2016/0047176 A1 2/2016 Martin
2017/0009557 A1 1/2017 Harman et al.
2017/0022797 A1 1/2017 Joshi et al.
2017/0058659 A1 3/2017 El-Bakry et al.
2017/0174530 A1 6/2017 Yin et al.
2017/0234113 A1 8/2017 Steele
2018/0002995 A1 1/2018 Dotson et al.
2018/0051533 A1 2/2018 Zbranek et al.
2018/0100383 A1 4/2018 Saponja et al.
2018/0223642 A1 8/2018 Zahran
2018/0320500 A1 11/2018 Williams
2019/0032465 A1 1/2019 Ayub
2019/0145220 A1 5/2019 Patel et al.
2019/0186222 A1 6/2019 Steele et al.
2019/0203575 A1 7/2019 Schlosser
2019/0316443 A1 * 10/2019 Haugland ..... E21B 27/02
2019/0323331 A1 10/2019 Zahran
2020/0123888 A1 4/2020 Saponja et al.
2020/0215459 A1 7/2020 Oneto et al.
2020/0217187 A1 7/2020 Wang et al.
2020/0378235 A1 12/2020 Gonzales et al.
2021/0055146 A1 2/2021 Bukhamseen et al.
2021/0115771 A1 4/2021 Berntsen et al.
2021/0131277 A1 5/2021 Giordano et al.
2021/0140297 A1 5/2021 Webber et al.
2021/0363836 A1 11/2021 Jandhyala et al.
2021/0379511 A1 12/2021 Scott et al.
2022/0034178 A1 2/2022 Hughes
2022/0049581 A1 * 2/2022 Provost ..... E21B 21/103
2022/0056799 A1 2/2022 Johnson et al.
2022/0220838 A1 7/2022 Capela Moraes et al.
2022/0282695 A1 9/2022 Peviani
2023/0109781 A1 4/2023 Alexander et al.
2023/0175364 A1 6/2023 Al-huwaider et al.
2023/0228186 A1 7/2023 Ai-Dhafeeri et al.
2023/0313644 A1 * 10/2023 Wang ..... E21B 43/20
2023/0313662 A1 10/2023 Al Majid et al.
2024/0076953 A1 3/2024 Trifol et al.
2024/0084687 A1 3/2024 Saponja et al.
2024/0255454 A1 * 8/2024 Hadi ..... G01B 21/085
2024/0287882 A1 8/2024 Alghamdi
2025/0067150 A1 2/2025 Shakeel et al.
2025/0067160 A1 2/2025 Shukor et al.
2025/0067164 A1 2/2025 Gupta et al.
2025/0084748 A1 3/2025 Fripp et al.
2025/0101817 A1 3/2025 Steele et al.
2025/0101823 A1 3/2025 Steele
2025/0101846 A1 3/2025 Steele et al.
2025/0101848 A1 3/2025 Steele et al.
2025/0101849 A1 3/2025 Steele et al.
2025/0109674 A1 4/2025 Donovan et al.

(56) References Cited

U.S. PATENT DOCUMENTS

| | | | |
|---|---|---|---|
| 2025/0109675 | A1 | 4/2025 | Steele et al. |
| 2025/0109676 | A1 | 4/2025 | Butler et al. |
| 2025/0154860 | A1 | 5/2025 | Steele et al. |

FOREIGN PATENT DOCUMENTS

| | | |
|---|---|---|
| CN | 116733440 | 9/2023 |
| CN | 117552765 | 2/2024 |
| CN | 117569792 | 2/2024 |
| CN | 118057000 | 5/2024 |
| EP | 0977621 | 7/2002 |
| EP | 0948702 | 3/2003 |
| GB | 2365046 | 2/2002 |
| JP | 2002370005 | 12/2002 |
| RU | 200894 | 11/2020 |
| WO | 1996004056 | 2/1996 |
| WO | 2004007908 | 1/2004 |
| WO | 2010118351 | 10/2010 |
| WO | 2011119675 | 9/2011 |
| WO | 2014172324 | 10/2014 |

OTHER PUBLICATIONS

"U.S. Appl. No. 18/647,015 Restriction Requierement", Jan. 22, 2025, 7 pages.
"U.S. Appl. No. 18/656,389 Restriction Requirement", Feb. 5, 2025, 7 pages.
"PCT Application No. PCT/US2024/055948 International Search Report and Written Opinion", Mar. 7, 2025, 13 pages.
"BaraCRI™ Cuttings Reinjection Operations Save More Than US 4 Million on Six-Year Project", Halliburton, www.halliburton.com, 2018, 2 pages.
"BaraCRI™ Cuttings Reinjection System Saves Operator USD 120,000 Per Month", Halliburton, www.halliburton.com, 2018, 2 pages.
"BaraCRI™ Services Help Reduce Environmental Impact in First CRI Application in Ecuador", Halliburton, www.halliburton.com, 2018, 2 pages.
"Cuttings Reinjection Video", SLB; https://www.slb.com/videos/cuttings-reinjection-service, Sep. 8, 2016, 4 pages.
"iWISE: Integrated waste injection services", Mi SWACO: a Schlumberger Company, 2016, 6 pages.
"WHIRLAWAY Gas Handlers", ChampionX Artificial Lift, Nov. 4, 2020, 2 pages.
"Workstring Orientation Tool: Orientation Accuracy in Multilateral Completion Operations", Halliburton Completion Tools, 2020, 2 pages.
Alshmakhy, et al., "Use of Downhole Oil-Water Separation System in Horizontal Wells", 2021 SPE Annual Technical Conference and Exhibition, Sep. 2021, 5 pages.
Catala, "Fluid Flow Fundamentals", Oilfield Review, 1996, 4 pages.
Ezell, et al., "First Successful Field Utilization of Cuttings Re-Injection (CRI) in the Offshore Field of Saudi Arabia as an Environmentally Friendly and Cost Effective Waste Disposal Method", SPE Annual Technical Conference and Exhibition held in Denver, Colorado, USA, Nov. 2011, 14 pages.
Guo, et al., "Increased Assurance of Drill Cuttings Reinjection: Challenges, Recent Advances, and Case Studies", Paper IADC/SPE 87972 presented at the IADC/SPE Asia PacificDrilling Technology Conference and Exhibition, Jun. 2007, 7 pages.
Hagan, et al., "Engineering and Operational Issues Associated with Commingled Drill Cuttings and Produced Water Re-injection Schemes", SPE International Conference on Health, Safety and Environment in Oil and Gas Exploration and Production held in Kuala Lumpur, Malaysia, Mar. 2022, 9 pages.
Hernandez, et al., "Drill Cutting Reinjection Feasibility Study in a Critical Environment, Apaika Field, Ecuador", SPE Latin American and Caribbean Health, Safety, Environment and Sustainability Conference held in Bogotá, Colombia, Jul. 2015, 21 pages.
Kuhnen, et al., "Destabilizing Turbulence in Pipe Flow", Nature Physics vol. 14, 386-390 (2018), 2018, 36 pages.
Kuhnen, et al., "Like Cures Like: How to Destroy Turbulence With Turbulence", APS Physics; YouTube Video https://youtu.be/gZgtT-JxmtM?si=zBHluksDm75LCQuw, Nov. 14, 2017.
Ladmia, et al., "Downhole Oil Water Separation to Handle Produced Water Study Case Onshore & Offshore Fields Abu Dhabi", SPE Annual Technical Conference and Exhibition, Dubai, UAE, Sep. 2021, Sep. 15, 2021.
Marusic, et al., "An Energy-Efficient Pathway to Turbulent Drag Reduction", Nature Communications vol. 12, Article No. 5805 (2021), 2021, 8 pages.
McCoy, et al., "Evaluation and Performance of Packer-Type Downhole Gas Separators", SPE Production and Operations Symposium, Mar. 2023, 14 pages.
Muktadir, et al., "Review and Applicability of Downhole Separation Technology", 2016, 13 pages.
Poclin, et al., "Commingled Reinjection of Cuttings and Produced Water Provides a Zero-Discharge Solution for the Development Phase of the Pirana Field in the Peruvian Amazon Region", SPE Latin American and Caribbean Petroleum Engineering Conference held in Quito, Ecuador, Nov. 2015, 18 pages.
Samy, "Cutting Re-injection CRI Uncertainty and Risk Assessment", SPE Abu Dhabi International Petroleum Exhibition & Conference to be held in Abu Dhabi, UAE,, Nov. 2021, 15 pages.
Scarselli, et al., "Turbulence Suppression by Cardiac-Cycle-Inspired Driving of Pipe Flow", Nature vol. 621, pp. 71-74 (2023), Sep. 6, 2023.
Schuh, et al., "Case History: Cuttings Reinjection on the MurdochDevelopment Project in the Southern Sector of the North Sea", Paper SPE 26680 presented at The Offshore European Conference held in Aberdeen, 1993, 16 pages.
Yang, et al., "Application of DOWS (Downhole Oil Water Separation) Technology Used in High Water-Cut Oilfield: Case Study", SPE/IATMI Asia Pacific Oil & Gas Conference and Exhibition, Oct. 2015, 8 pages.
Zunce, et al., "Study on the Flow Pattern of Downhole Oil-Water Separator with Different Inlet Patterns", 2009 3rd International Conference on Bioinformatics and Biomedical Engineering, Jun. 2009, 4 pages.
"PCT Application No. PCT/US2024/026360 International Search Report and Written Opinion", Aug. 19, 2024, 13 pages.
"PCT Application No. PCT/US2024/026689 International Search Report and Written Opinion", 13 pages.
"PCT Application No. PCT/US2024/026896 International Search Report and Written Opinion", Aug. 19, 2024, 13 pages.
"PCT Application No. PCT/US2024/026900 International Search Report and Written Opinion", Aug. 19, 2024, 12 pages.
"PCT Application No. PCT/US2024/027103 International Search Report and Written Opinion", Aug. 19, 2024, 11 pages.
"PCT Application No. PCT/US2024/027105 International Search Report and Written Opinion", Oct. 10, 2024, 11 pages.
"PCT Application No. PCT/US2024/027565 International Search Report and Written Opinion", Sep. 6, 2024, 14 pages.
"PCT Application No. PCT/US2024/027573 International Search Report and Written Opinion", Sep. 9, 2024, 11 pages.
"PCT Application No. PCT/US24/28078 International Search Report and Written Opinion", Aug. 14, 2024, 9 pages.
"U.S. Appl. No. 18/647,015 Non-Final Office Action", Jun. 4, 2025, 19 pages.
"U.S. Appl. No. 18/647,393 Non-Final Office Action", Apr. 7, 2025, 21 pages.
"U.S. Appl. No. 18/648,824 Non-Final Office Action", Mar. 27, 2025, 11 pages.
"U.S. Appl. No. 18/649,236 Non-Final Office Action", May 13, 2025, 13 pages.
"U.S. Appl. No. 18/651,918 Non-Final Office Action", Jun. 4, 2025, 15 pages.
"U.S. Appl. No. 18/653,061 Final Office Action", Jul. 3, 2025, 20 pages.
"U.S. Appl. No. 18/653,061 Non-Final Office Action", Mar. 18, 2025, 16 pages.

(56) References Cited

OTHER PUBLICATIONS

"U.S. Appl. No. 18/656,389 Non-Final Office Action", Apr. 24, 2025, 20 pages.
"U.S. Appl. No. 18/945,016 Non-Final Office Action", Jul. 22, 2025, 10 pages.
"U.S. Appl. No. 18/647,015 Final Office Action", Oct. 2, 2025, 24 pages.
"U.S. Appl. No. 18/647,393 Final Office Action", Aug. 22, 2025, 14 pages.
"U.S. Appl. No. 18/649,236 Final Office Action", Sep. 11, 2025, 17 pages.
"U.S. Appl. No. 18/651,918 Final Office Action", Sep. 30, 2025, 23 pages.
"U.S. Appl. No. 18/647,015 Non-Final Office Action", Dec. 19, 2025, 27 pages.
"U.S. Appl. No. 18/647,393 Ex Parte Quayle Action", Nov. 24, 2025, 7 pages.
"U.S. Appl. No. 18/651,918 Non Final Office Action", Dec. 11, 2025, 16 pages.
"U.S. Appl. No. 18/656,389 Final Office Action", Jan. 7, 2026, 23 pages.
"U.S. Appl. No. 18/945,016 Non-Final Office Action", Jan. 12, 2026, 8 pages.

* cited by examiner

CLEANING DEVICES AND OPERATIONS FOR DOWNHOLE SEPARATION IN A WELL

BACKGROUND

Oil and gas wells produce significant amounts of water in their lifetime. The percentage of water produced from these wells is called the water cut, the ratio of the water produced from the well compared to the volume of the total liquids produced. Most wells produce an ever-increasing water cut throughout their productive life. In many oil fields around the world the percentage of water recovered with oil has risen to be greater than the percentage of the oil. In fact, in many fields, the percentage of oil has decreased to be from about 20% in an excellent field to about 2% in a relatively poor field.

The end of a well's productive life is often determined by the water cut. A well is typically shut in when the value of the hydrocarbons produced is no longer sufficient to economically cover the operating costs of the well and the cost of disposing of the produced water. Indeed, disposing of the produced water is not environmentally and economically friendly as energy is used to power the pump to lift the produced water to the surface, to separate the produced water from the oil, to transport the separated water as it cannot be disposed on the surface in most cases. Thus, the separated water must be transported to a remote well site to be reinjected into a subterranean formation. Therefore, decreasing the water cut of a well increases the value of the produced fluids and directly decreases the disposal costs of the produced water.

One method of reducing the water cut of a well is to separate produced water from the hydrocarbons downhole, rather than at surface. Downhole separation increases the value of the fluids produced to the surface. Downhole separation also facilitates disposal of the separated water. The separated water can be reinjected into the same production zone or into a different zone. Another way to improve the productivity of a well is to increase the length of the intersection of the productive zone by the well completion. One way of increasing this intersection length is by using multilateral wells. A multilateral well is a conventional well that has a lateral well that is drilled from a point in the original well. The lateral well increases productivity by allowing additional intersection length along the productive zone without the cost and delay involved in redrilling the upper part of the well. While multilaterals enable multiple intersections within the same productive zone, multilaterals also enable fluid communication with different productive zones within a reservoir. In certain reservoirs, operators can leverage this approach to improve reservoir production by accessing numerous production zones or by increasing the contact area between a wellbore and a formation with minimal increase in drilling and completion costs. These techniques also reduce the environmental footprint of drilling rigs and subsequent production trees, particularly for land operations. Therefore, the use of multilateral well increases the potential production of a well and can also enable disposal of the produced water in a different zone.

BRIEF DESCRIPTION OF THE DRAWINGS

Embodiments of the disclosure may be better understood by referencing the accompanying drawings.

DESCRIPTION

Figure 1:
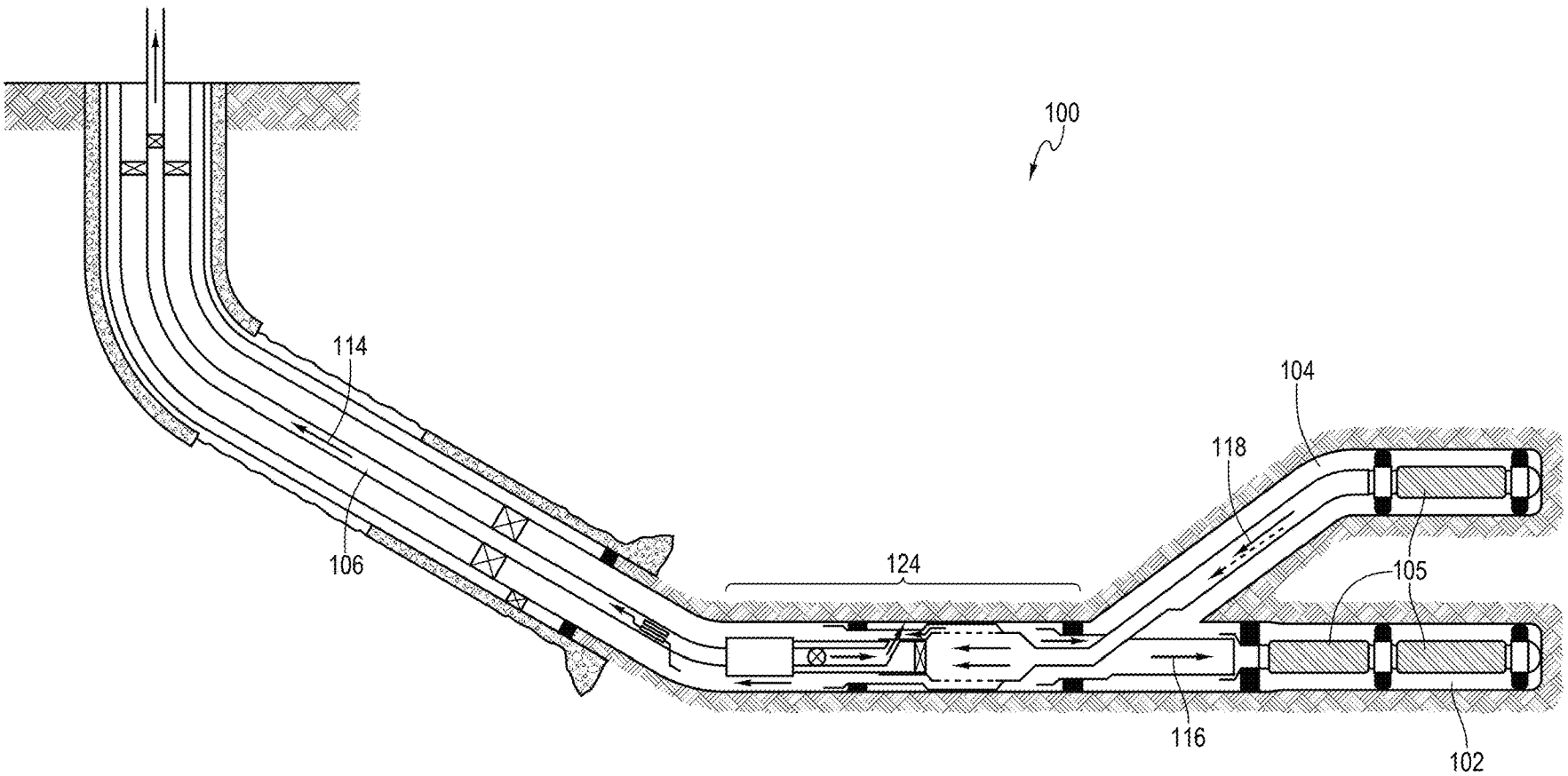
FIG. 1 is a perspective view in partial cross section of a multilateral well system that includes downhole fluid separation, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Some implementations are in reference to a "multilateral well." A multilateral well may be defined to include any type of well having more than one bore, wellbore, branch, lateral, etc. For example, a multilateral well may include a main bore with one or more laterals branching therefrom. In another example, a multilateral well may also include any type of multi-bore well configuration with such bores at any angles relative to each other. Additionally, while example implementations may be used in reference to a multilateral or multi-bore well, some implementations may also be used in a single bore well. Also, the terms Downhole Oil-Water Separation (DOWS) System and Downhole Oil-Water-Solids Separation (DOWSS) System herein may be used interchangeably. Moreover, the acronyms DOWS and DOWSS herein may be used interchangeably.

Example implementations refer to a screen for downhole filtering. Such a screen may be designed to stop sand production before the flow enters the pump or tubing downhole. While described in reference to a screen, example implementations may include other types of devices for performing this filtering. For example, a sieve may be used for this filtering. A sieve may be defined as a device with meshes or perforations through which finer particles of a mixture (sand, silt, etc.) of various sizes may be passed to separate them from coarser ones.

The screen as described herein may be a sand screen (also referenced as a sand control screen or a gravel pack screen. The sand screen may be considered a specialized tool installed in hydrocarbon recovery wells. A function of the sand screen is to filter out sand and other solid particles from the reservoir fluid (preventing them from entering the wellbore during production). By doing so, sand screens prevent sand production, which can be highly detrimental to well integrity and productivity.

Example implementations may include a wellbore system that includes a downhole fluid separator. For example, the system may be part of a multilateral well completion design that includes a fluid separator at the junction between the main bore and a lateral well on the upper completion. A fluid separator may provide separation of different types of fluids. For example, the fluid separator may separate a formation fluid (received from the formation surrounding on the main bore) into production fluid and nonproduction fluid. For instance, the fluid separator may include an oil-water separator and a gas-oil-water separator, etc. In some implementations, the system may include a pump (such as an electrical submersible pump (ESP)) at the junction to pump the nonproduction fluid (such as water) into the lateral well so that the nonproduction fluid is injected into the subsurface formation surrounding the lateral well.

Example implementations may also include separation of downhole solids from the fluids (formation fluid(s), production fluid(s), nonproduction fluid(s) or any combination thereof)—thereby avoiding injectivity impairment caused by solids plugging. For instance, example implementations may include separation of solids from the nonproduction fluid to minimize or prevent plugging of the subsurface formation surrounding the lateral well where the nonproduction fluid is to be disposed.

As part of hydrocarbon recovery from a wellbore, solids (formation fines, sediments, etc.) may be dislodged from the formation and produced with the formation fluids being delivered to the surface of the wellbore. Like operations where the fluids are produced at the surface, solids need to be dealt with when using Downhole Oil-Water Separation (DOWS) operations. The solids in a DOWS operation may provide an extra challenge of being separated downhole because these solids need to be either transported to surface of the well or disposed of downhole. Either way, processing and/or disposal of these solids may be prone to accumulate and plug off water separation and injection equipment.

Example implementations may include addressing the issue of accumulation of downhole solids in a DOWS operation in order to dislodge, transport and dispose of the solids to a location that will not interfere with the continued operation of the Downhole Oil Water Separator System (DOWSS) and other related equipment. Example implementations may be applicable to Multilateral Downhole Oil Water Separator Systems.

For example, some implementations may include at least one screen through which formation fluid from a subsurface formation enters a tubing or liner in a bore of the well. Such formation fluid may include solids (such as sediment). Accordingly, these screens may filter out the solids—to prevent at least a portion of the solids from entering the downhole tubing or liner. Over time, these screens may become clogged with these solids. Therefore, these screens need to be cleaned to remove these solids from the screens.

In some implementations, the screen may be cleaned periodically (independent of any condition). Alternatively or in addition, the screen may be cleaned in response to detecting or sensing a change in a value of any of a number of parameters. One or multiple sensors at any number of locations may sense values of any number of parameters. For example, a sensor may be positioned behind the screen opposite the subsurface formation. Such a sensor may sense a flow rate of the formation fluid. If the flow rate of the formation fluid going through the screen drops below a flow rate threshold value, a controller may initiate cleaning of the screen. Alternatively or in addition, a sensor may be positioned at a surface of the well and/or any location downhole. Such sensors may also sense a flow rate of a fluid (such as the formation fluid, the production fluid, the nonproduction fluid, etc.). If the flow rate of such a fluid drops below a flow rate threshold value for the given fluid, a controller may initiate cleaning of the screen. In some implementations, a given flow rate threshold value may be unique to the given type of fluid and the location of the sensor.

Alternatively or in addition, a sensor may sense a level of solids (or sediment) for a given unit of time being separated from the formation fluid, the production fluid and/or nonproduction fluid (as described herein). If this level of solids being separated out falls below a solids rate threshold value, a controller may initiate cleaning of the screen. In some implementations, a given solids rate threshold value may be unique to the given type of fluid from which the solids are being separated and the location of the sensor. In some implementations, a sensor may float as a buoyant device.

In some implementations, a cleaning device may be built into the screen or other downhole device—it automatically can sense when the screen/device needs to be cleaned and then initiate a cleaning cycle. Alternatively or in addition, the cleaning may be initiated manually from the surface of the well. In some implementations, the system may be powered by the ESP, its own pump and/or motor. Also, the system may be serviceable and/or replaceable without pulling the completion (or parts thereof).

In some implementations, the controller may initiate cleaning of the screen based on values of a combination of parameter values. For example, the controller may initiate cleaning of the screen if the level of solids being separated out from a given fluid falls below a solid threshold value and if a flow rate of a given fluid falls below a flow rate threshold value. In some implementations, any other property of the given fluid may be used in determining whether initiation of applying the fluid (e.g., cleaning fluid) to the screens. Examples of other such properties may include a pressure drop or pressure change.

The timing of the cleaning of these screens may be based on other parameters. For example, the cleaning of these screens may be based on time, the amount of different fluids being processed, etc. For instance, the cleaning of these screens may occur after an amount of production fluids produced at the surface of the well exceeds a threshold, after an amount of formation fluids is received by a DOWSS for separation, etc.

In some implementations, the controller may initiate cleaning of the screens by causing a pump to activate to pump a cleaning fluid into the area of the screens to clean off the solids from the screens. In some implementations, the cleaning fluid may be water. In some implementations, the cleaning fluid (aka fluid) may not be for cleaning, but for other reasons—or it may be a fluid for multiple requirements. For example, the fluid may be a corrosion coating or corrosion inhibitor. If the fluid is primarily a corrosion coating, additional steps, processes, fluids, etc. may be required. For example, pre-flushes to remove buildup on one or more surfaces may be required to remove paraffin, scale, salts, etc. prior to applying a new coating or fluid. Physical cleaning may be required and implemented to remove deposits, films, etc. that may be hard to remove by only a flushing or jetting type action. In some implementations, the device and processes may also perform necessary actions to get to the surfaces to be cleaned such as sliding a sleeve open, actuating a port, unfastening a fastener, etc. The device and processes may include sliding a sleeve closed (after one or more operations are complete). The device and processes may also perform other operations such as replacing gaskets, injecting sealants, replacing parts on the equipment being cleaned, replacing parts or servicing other parts or assemblies during the same trip, etc.

In some other implementations, the cleaning fluid may be other types of fluids. In some implementations, the cleaning fluid may not be a cleaning fluid, but a fluid designed to perform other tasks. The fluid may be an acid, base, surfactant, solvent, etchant, proppant-carrying fluid, emulsifier, de-emulsifier, detergent, a lubricant, a degreaser, a paraffin removing agent, cement, flushing agent, etc.

In some implementations, the cleaning fluid may be water in combination with at least one cleaning composition. In some implementations, a pump may pump a concentrate of cleaning fluid. The concentrate may be mixed with a fluid downhole. This mixture may then be applied to the screens. The controller and the pump may be at the surface of the well and/or at any location downhole. In some implementations, there may be a pump at the surface of the well and a pump downhole. For example, there may be a pump downhole that is part of the DOWSS such that the pump may pump the nonproduction fluid (that has been separated out during the DOWSS operation) into the area of the screens to clean off the solids from the screens. In some implementations, the controller may initiate the pump at the surface and/or the pump downhole. For example, if the level of flow rate of the formation fluid drops below a different threshold, the controller may initiate both pumps to clean the screens. As another example, the controller may use the pump downhole if there is a sufficient level of nonproduction fluid that is available to perform the cleaning operation. As further described below, an inner diameter and/or an outer diameter of the screens may be cleaned. Additionally, while described in reference to cleaning of screens, in some implementations, other parts of the DOWSS may be cleaned (similar to the cleaning of the screens).

In some implementations, at least one sensor may be positioned behind the screens opposite the subsurface formation. The sensors may measure a flow rate of the formation fluid flowing through the screens. If the flow rate of the formation fluid falls below a threshold value, a controller may initiate operation of a pump to pump a cleaning fluid (such as water) to clean the screens. For example, the pump may be at the surface of the well. Alternatively or in addition, the pump may be downhole such that the pump pumps the separated out nonproduction fluid to the screens for cleaning. In some implementations, a coiled tubing positioned in the well may fluidly couple the pump to the screens. Additionally, if the pump may be positioned downhole via a wireline or a wireline tractor.

Example System

FIG. 1 is a perspective view in partial cross section of a multilateral well system that includes downhole fluid separation, according to some embodiments. FIG. 1 depicts a multilateral well that includes a main bore 102 and a lateral bore 104. The main bore 102 may include an open hole horizontal well. The lateral bore 104 may be an open hole inclined well. Screens 105 may be positioned in the main bore 102 and the lateral bore 104. For example, one of the screens 105 may be positioned in the lateral bore 104 at the point where the formation fluid 118 enters the tubing to prevent the larger solids from even entering the tubing.

While described as being screens, alternatively or in addition, slotted liners, perforated tubing, etc. may be used to prevent the larger solids from entering the tubing. The screens may also be used to prevent larger solids from entering the formation in the scenario where non-production fluid is returned to a downhole reservoir.

Example implementations may use different types of sand screens (depending on the specific well conditions and production requirements). For example, one type of sand screen is a gravel pack screen. A gravel pack screen may be used in unconsolidated formations where sand influx is a major concern. Gravel pack screens may provide additional support to the wellbore and prevent sand production effectively. Another type of sand screen is a wire-wrapped screen. Such a screen may be used in wells with fine sand particles—because such screens may filter out even the tiniest sand grains. This type of screen may offer a balance between sand control and well productivity. Another type of sand screen is a pre-packed screen that may include a pre-installed filtration media, eliminating the need for additional gravel packing. Such screens may be suitable for wells with challenging downhole conditions.

These different types of sand screens are needed in the hydrocarbon recovery industry for a number of reasons. A first reason for using sand screens is to control sand production. Uncontrolled sand influx may lead to equipment damage, reservoir damage, and even wellbore collapse (jeopardizing the entire production process). A second reason is related to well productivity. By preventing sand production, sand screens maintain the integrity of the wellbore, ensuring that production rates remain steady and consistent. A third reason for sand screens is equipment protection. Sand screens protect surface facilities and downhole equipment from abrasive sand particles that could cause wear and tear, reducing maintenance costs. A fourth reason is reservoir management. Effective sand control enhances reservoir management, allowing for optimal recovery of oil and gas resources.

Figure 2:
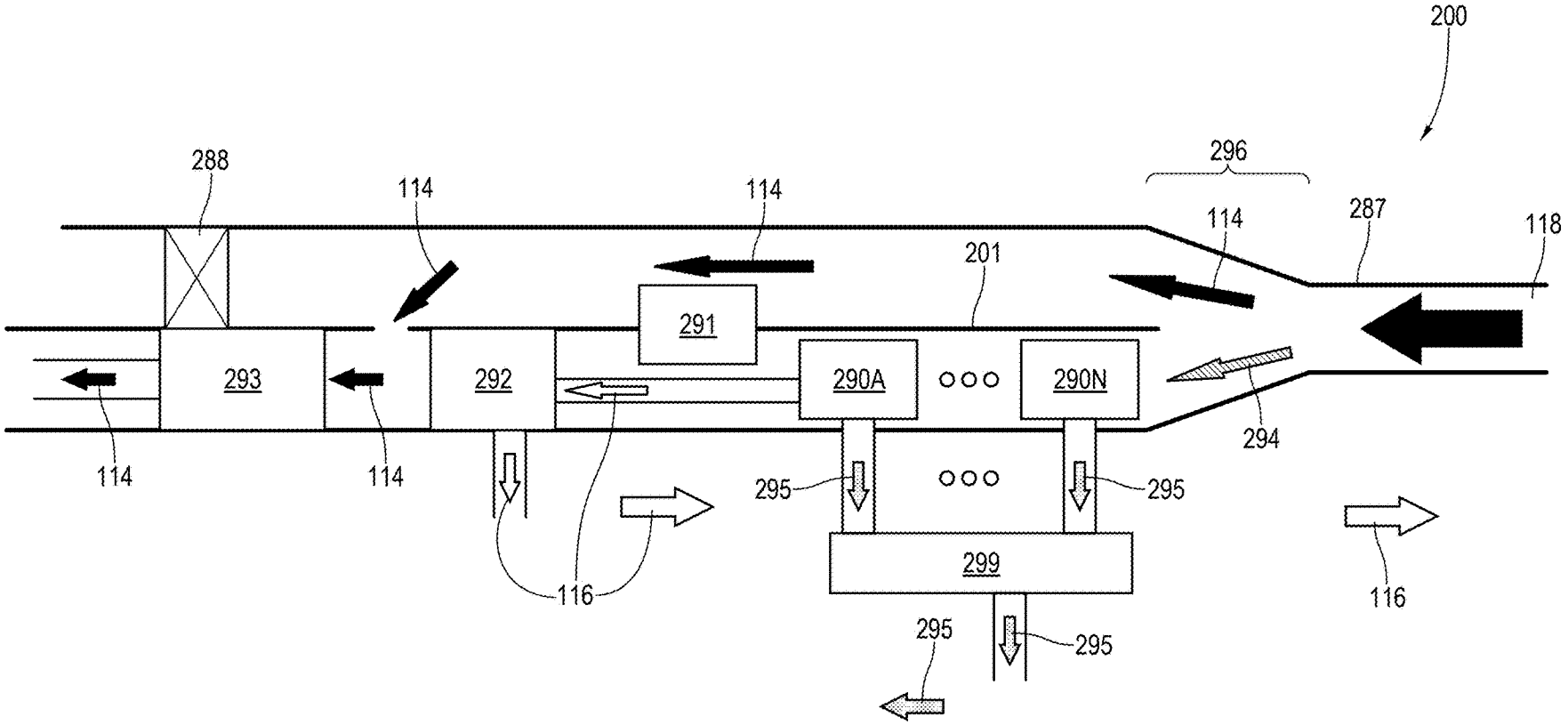
FIG. 2 is side view of an example downhole separation system (including a fluid separator, sediment separator(s), and sediment injector(s)), according to some embodiments.

In FIG. 1, a system 100 includes a separation system 124 that may include a combination of separators for both fluid and solids (such as sediment). The separation system 124 may include pumps and sediment injector(s). An example of the separation system 124 is depicted in FIG. 2 (which is further described below). A formation fluid 118 from the lateral bore may be drawn into the separation system 124. The separation system 124 may include a fluid separator to separate formation fluid 118. The fluid separator may separate the formation fluid 118 into production fluid (such as hydrocarbons (e.g., oil)) 114 and nonproduction fluid (such as water) 116. The production fluid 114 may be delivered uphole through a production tubing 106. The nonproduction fluid 116 may be delivered to the main bore 102 for injecting into the surrounding formation. Thus, example implementations may separate the nonproduction fluid downhole such that the nonproduction fluid may be directed back to the formation without any need to pump it back to the surface for separation and any transportation needed for storage. The nonproduction fluid 116 may include sediment. In some implementations, the sediment may be separated out from the nonproduction fluid 116 prior to the nonproduction fluid 116 being injected back a subsurface formation. Therefore, the separation system 124 may also include sediment separator(s) to separate out sediment from the nonproduction fluid 116. The formation fluid 118 and/or the production fluid 114 may also include sediment (solids, sand, paraffin, dirt, emulsions, water, etc.), liquids, emulsions, gases, and combinations thereof. In some implementations, one or more of these materials may be separated out from the formation fluid 118 and/or the production fluid 114 prior to, during, or after the nonproduction fluid 116 has been injected back a subsurface formation. Therefore, the separation system 124 may also include separator(s) to separate out materials from the formation fluid 118 and/or the production fluid 114 too. A controller and sensor positioned at the surface, subsurface, or both may sense and/or control one or more parameter, process, actuator, system and/or device of one or more systems of 100 including separation system 124 The formation fluid 118 and/or the production fluid 114 may also include sediment (solids, sand, paraffin, dirt, emulsions, water, etc.), liquids, emulsions, gases, and combinations thereof. In some implementations, one or more of these materials may be separated out from the formation fluid 118 and/or the production fluid 114 prior to, during, or after the nonproduction fluid 116 has been injected back a subsurface formation. Therefore, the separation system 124 may also include separator(s) to separate out materials from the formation fluid 118 and/or the production fluid 114 too. A controller and sensor positioned at the surface, subsurface, or both may sense and/or control one or more parameter, process, actuator, system and/or device of one or more systems of 100 including separation system 124.

In some implementations, the sediment that has been separated out may be stored downhole (at least temporarily). In some implementations, the sediment may be delivered to the surface of the multilateral well or another downhole location using a flow channel (such as a tubing string). Examples of another downhole location may include a cavern, a disposal wellbore, a thief zone, etc. This flow channel may be the production tubing string 106 used to deliver production fluid to a surface of the multilateral well. In some implementations, this flow channel may be a separate tubing string for delivery of the sediment and/or other fluids to the surface of the multilateral well or to a different downhole location.

In some implementations, the separation system 124 may include sediment injector(s) to receive the sediment separated out by the sediment separator(s). The sediment injector (s) may inject this sediment into the production tubing string 106 (used to deliver the production fluid to a surface of the multilateral well) to deliver this sediment to the surface of the multilateral well. Alternatively or in addition, the sediment injector(s) may inject this sediment into a separate tubing string to deliver this sediment to the surface of the multilateral well or to a different downhole location.

FIG. 2 is side view of an example downhole separation system (including a fluid separator, sediment separator(s), and sediment injector(s)), according to some embodiments. For example, FIG. 2 depicts a separation system 200 that may be an example of the separation system 124 depicted in FIG. 1. The separation system 200 includes a tubing 287 that includes a fluid separator 296, separators 290A-290N, chemical injector(s) 291, a lower pump 292, an upper pump 293, sediment injector(s) 299, a separator 201 and a packer 288. Also, while the separation system 200 is depicted in a given order, example implementations include a separation system with components that are reordered or changed.

The formation fluid 118 flows into the fluid separator 296. In this example, the fluid separator 296 comprises a gravity-based separation that includes the separator 201. As shown, the formation fluid 118 moves from a smaller to a larger diameter of the tubing 287. This may decrease the velocity of the flow of the formation fluid 118—which allows the separation. In particular, most or at least a majority of the production fluid 114 may separate into a flow above the separator 201, while most or at least a majority of the nonproduction fluid with sediment 294 may separate into a separate flow below the separator 201. This allows most of the sediment to be captured in the lower portion of the tubing 287 (below the separator 201).

While depicted as having the separator 201, in some implementations, there is no separator 201. Rather, the production fluid 114 and the nonproduction fluid with sediment 294 may naturally separate in a horizontal pipe because of their different density. Accordingly, even in a same tubing without the separator 201, most of the production fluid 114 would be above the nonproduction fluid 116 because of the differences in weight between the two types of fluid.

The nonproduction fluid with sediment 294 flows into the sediment separators 290A-290N, which may represent one to any number and type of sediment separators. In some implementations, each of the sediment separators 290A-290N may separate some of the sediment in the nonproduction fluid with sediment 294. For example, the first sediment separator 290 may be used to separate and collect the largest size (denser) sediment; the second sediment separator 290 may be used to separate and collect the next largest size sediment; the third sediment separator 290 may be used to separate and collect the next largest size sediment; etc. (as the flow moves from right to left through the different sediment separators). For example, at least one of the sediment separators 290 may be a cyclonic separator—wherein larger (denser) particles in the rotating stream having too much inertia to follow the tight curve of the stream. Such particles may thus strike the outside wall and fall to the bottom of the cyclone where they may be removed. In some implementations, each of the sediment separators 290 may store the sediment that was collected into an associated storage area or tank.

Additionally, the chemical injector(s) 291 may inject one or more chemicals into at least one of the formation fluid 118, the production fluid 114, the nonproduction fluid with sediment 294, the nonproduction fluid 116, or the sediment 295. While depicted such that chemicals are injected downhole, alternatively or in addition, chemicals may be injected from the surface of the multilateral well. Aso, different chemicals may be injected for different purposes. For example, a flocculant or deflocculant may be injected to promote or not promote aggregation or settling of suspended particles in a liquid. Other examples of chemicals being injected may include paraffin, solvents, dispersants, etc. being added to the production fluid 114, a scavenger being added to the production fluid 114 to remove corrosive gases ($H_2S$) therefrom, etc. In particular, crude oils often contain paraffins which precipitate and adhere to the liner, tubing, sucker rods and surface equipment as the temperature of the producing stream decreases in the normal course of flowing, gas lifting or pumping. Heavy paraffin deposits are undesirable because they reduce the effective size of the flow conduits and restrict the production rate from the well. Where severe paraffin deposition occurs, removal of the deposits by mechanical, thermal or other means is required, resulting in costly down time and increased operating costs.

In some implementations, these different collections of the sediment by the different sediment separators 290 may be injected into a same or different line or tubing for disposal. As shown, the sediment injector(s) 299 are coupled to receive the sediment collected by the different sediment separators 290.

Periodically, sediment may need to be emptied from the different sediment separators 290 via the sediment injector (s) 299. The decision of when may be based on different criteria. For example, pressure and/or production flow may be monitored at the surface of the multilateral well. If the pressure and/or production flow start to degrade, it may be an indication that sediment needs to be emptied from the sediment separators 290.

In some implementations, sensors may be coupled to each of the tanks of the sediment separators 290. A signal from a given sensor may indicate when the associated sediment separator 290 needs to be emptied. A controller (downhole or at the surface of the multilateral well) may be communicatively coupled to the sensors such that the controller may initiate a sequence to empty one or more of the tanks of the sediment separators 290.

In some implementations, the sediment injector(s) 299 may dispose of these sediments by injecting them into a tubing for delivery to the surface of the multilateral well. For example, the sediment may be delivered to the surface using the production tubing or a separate tubing. If the production tubing is used, the solids may be included with the production fluid that is being delivered to the surface. In such implementations, separation operations may be performed at the surface to separate out the solids from the production fluid 114.

Accordingly, if sediment is being included with the production fluid 114 being delivered to the surface, the production fluid 114 may be delivered to surface equipment that provides for separation of the sediment. Alternatively, during the time when the sediment is not being included with the production fluid 114, the production fluid 114 may be delivered to different surface equipment that does not include such separation of sediment.

Alternatively or in addition, the sediment injectors 299 may deliver the sediment to a different downhole location (such as a different lateral well, a thief zone (having a high porosity, high permeability downhole zone that may include a low pressure), etc.). In some implementations, sediment may be disposed to different locations depending on their size. For example, for sediment having a size greater than X, such solids may be delivered to the surface of the multilateral well for disposal. For sediment having a size less than X but greater than Y, such sediment may be disposed in a first downhole location (such as a thief zone). For the remaining sediment that have a size less than Y, such solids may be disposed in a second downhole location (such as a lateral well).

In some examples, the sediment (AKA solid) Y may be larger, or the same size as sediment X. As an example, if the first hole location is very permeable and can accept larger-size solids (AKA sediments), the larger size solids may be injected/disposed into the first downhole location and the smaller size solids may be either produced to the surface and/or injected/disposed into a second downhole location.

In some examples, X may range from 0.01 mm (10 microns) to larger than 8.00 mm (8000 microns). (Medium silt to larger than medium gravel).

In some examples, Y may be 0.01 mm (10 microns) or smaller.

In some examples, X may range from 0.02 mm (20 microns) to 8.00 mm (8000 microns). (Medium silt to larger than medium gravel).

In some examples, Y may be 0.02 mm (20 microns) or smaller.

In some examples, Y may be 0.01 mm (10 microns) to 02 mm (20 microns).

In some examples, X may range from 0.063 mm to 2.00 mm (63 microns to 2000 microns).

In some examples, Y may be 0.063 mm (63 microns) or smaller.

In some examples, Y may be 0.02 mm (20 microns) to 0.063 mm (63 microns).

In some examples, X may range from 0.075 mm to greater than 4.75 mm (75 to greater than 4750 microns).

In some examples, Y be 0.075 mm (75 microns) or smaller.

In some examples, Y may be 0.02 mm (20 microns) to 0.075 mm (75 microns).

In some examples, X may be greater than 4750 microns.

In some examples, Y be 4.75 mm (4775 microns) or smaller.

In some examples, Y may be 0.02 mm (20 microns) to 4.75 mm (4775 microns).

In some examples, X may be greater than 0.6 mm (600 microns). (Coarse sand and larger).

In some examples, Y be 7.5 mm (75 microns) or smaller.

In some examples, Y may be 0.02 mm (20 microns) to 7.5 mm (75 microns).

Example implementations may include weir skimmers that function by allowing the oil floating on the surface of the water to flow over a weir. In some implementations, the weir skimmers may require the weir height to be manually adjusted. Alternatively, the weir skimmers may be such that the weir height is automatic or self-adjusting. While manually adjusted weir skimmer types may have a lower initial cost, the requirement for regular manual adjustment makes self-adjusting weir types more popular in most applications. Weir skimmers may collect water if operating when oil is no longer present. To overcome this limitation, the weir type skimmers may include an automatic water drain on the oil collection tank.

Accordingly, example implementations may detect the accumulation of solids in DOWS equipment. An operator (or other device) may be signaled that the solids should be removed. In response, an operational change in the DOWS equipment may be initiated to allow solids removal. For example, this may include shut down or reduction of DOWS-related operations (decrease or shut down pumps, switch valves that direct fluids to the surface and/or other location, etc.). Preparation of the solid's removal process may be initiated. For example, access sleeves and flushing ports may be opened, solids directional control equipment may be adjusted (e.g., change position), injection devices, sleeves, ports, valves, etc. may be closed, solids processing/removal equipment (from surface and/or downhole) may be deployed, etc. Additionally, flushing, dislodging, scrapping, chemically treating, fluidically treating, mechanically treating, etc. of downhole solids from one or more locations downhole may be enabled. Solids and related debris from the DOWS system (DOWSS) may be displaced. In some implementations, solids and other materials may be collected from the DOWSS. The solids and other materials may be transported from the DOWSS. Fluids, chemicals, solvents, acids, liquids, abrasive media, solids and other materials may be transported from the surface to the DOWSS.

Items such as water, chemicals and other items listed above may be transported in a controlled manner. For example, the transporting in a controlled manner may be based on speed, velocity, volumes, ratios, time-based (e.g., until a certain amount of time has passed), function-based (e.g., until a certain pressure-drop is experienced, until fluid has been circulated "bottoms up", etc.). For example, the transporting in a controlled manner may be based on when Z number of tubing strings of fluid has been pumped or until X-amount (e.g., pounds, mass, volume, etc.) of debris has been recovered, collected, injected, disposed, transferred, etc. Tools, devices, flow, etc. may be moved, shifted, directed, etc. to improve the solids collecting, removal, retaining, and flushing process(es). For example, a direction of a jetting nozzle may be changed, one flushing port may be closed while opening another, etc. Tools, devices, components, strings, etc. may be repositioned from one location to another to continue the one-or-more above processes. Additionally, tools, devices, components, strings, etc. may be repositioned to dispose of solids in a preferred location.

One or more fluids, chemicals, solvents, acids, liquids, abrasive media, solids and other materials may be moved from the surface of the well to the DOWSS to enhance the longevity of the DOWSS. This may include applying and/or re-applying friction reducing coatings, replacing components-filters, stators, pumps, rotors, bearings, bearing assemblies, worn parts, eroded parts, electrical components, sensors, computers, controllers, logic devices, parts intend to be consumed including wear pads, erosion pads, corrosion pads, filters, screens, etc.

Also, the shutting down of the solid's removal process may be initiated. For example, access sleeves and flushing ports may be closed, solids directional control equipment may be adjusted. Injection devices, sleeves, ports, valves, etc. may be opened. Solids processing and removal equipment may be retrieved (from the surface and/or other location downhole. Used or worn devices from well may be retrieved. Such devices may include filters, stators, pumps, rotors, bearings, bearing assemblies, worn parts, eroded parts, electrical components, sensors, computers, controllers, logic devices, parts intend to be consumed including wear pads, erosion pads, corrosion pads, filters, screens, etc.

An operational change in the DOWS equipment may be initiated to allow fluid separation again. This may include "turning on" or increase of DOWSS-related operations (e.g., increase or turn-on pumps, switch valves that direct fluids to the surface and/or downhole, etc.). Also, the operator (or other device) may be signaled that the DOWSS equipment has been re-configured out of the solids-removal status and is ready to begin fluid separation operations. The DOWS may then return back to fluids separation mode. Additionally, there may be provided a continuous or occasional status check of the "health" of DOWS equipment.

It should be noted that the DOWS system and components noted may be inclusive of items from the wellhead to the toe of each wellbore and more. The cables and/or energy conduits that provide power to the one or more ESPs and/or other pumps and prime movers (downhole and on surface) may be inclusive. The surface components that transport the fluids and solids (everything) out of the well may be included. Subsea trees, subsea DOWS equipment, platform, land-base, jack up, drillship, etc. types of equipment may be inclusive. Data lines, data processing, sensors, in the well and outside of the well may be inclusive. Fluid processing equipment and processes in the well and outside of the well may be inclusive. Solids processing equipment and processes in the well and outside of the well may be inclusive.

Example implementations may be applied to other types of remote operations where the tools, operations, processes are separated from the operators by distances, barriers, adverse environments, etc. The ability to remotely test to determine or verify whether functions were performed successfully and then communicate or report the tests results to a locale inhabitable by humans (e.g. the earth's surface) makes example implementations suitable for use in other remote locations with harsh environments such as outer space (e.g., satellites, spacecrafts, planets, moons, etc.), aeronautics (aircrafts, drones), on-ground (swamps, marshes, power generation, hydrogen or other gas extraction and/or transportation, etc.), below ground (mines, caves, etc.), ocean (on surface and subsea), subterranean (mineral extraction, storage wells (carbon sequestration, carbon capture and storage (CCS), etc.)), and other energy recovery activities (geothermal, steam, etc.). The unhabitable environments may comprise corrosive fluids (hydrocarbons, H2S fluids, CO2 fluids, acids, bases, gases, etc.), contaminants (sand, debris, paraffins, asphaltenes, etc.), high-temperature fluids (fluids from geothermal formations, injected fluids, etc.), cryogenic fluids, etc. Example implementations may be utilized in harsh conditions (e.g., corrosive environments or contaminated fluids), extreme pressures (e.g., >5,000-psi differential), extreme temperatures (e.g., >−20° F. or >300° F.), etc. In other instances, well-known instruction instances, protocols, structures, and techniques have not been shown in detail to avoid confusion.

Thus, in some implementations, the separators, pumps, and injectors may be installed at the junction between the main bore and the lateral bore. In other implementations, such devices may be installed below this junction or above this junction. Further, the main bore or one or more lateral bores may include one or more orientation devices which provides depth and orientation control. While example implementations include a given gravity-type separator, other types of separators may be used. For example, other gravity-type separators (e.g., fluid separators) and other non-gravity separators may be used.

The multilateral junction may be placed above or inside the target formation. In some implementations, this configuration may be accomplished in a two-trip multilateral completion that includes a lower completion with orientation liner hanger connected to additional lower completion, and an upper completion that includes the fluid separator, an electrical submersible pump, and an upper packer. This simplifies the installation. This reduced complexity allows the fluid separator to be installed into existing wells, i.e., retrofitting existing wells. Further, the lateral well may be a target formation. In this implementation, the main bore passes through a target production formation and the lateral bore passes through a target injection formation which is a separate formation from the production formation. The existing wells do not require a tangent section at the junction for the placement of the fluid separator, significantly increasing the number of oil well candidates for installation of the fluid separator according to example implementations.

The design of the installed completion equipment may be critical for the downhole fluid separator to function as intended. By installing the fluid separators, pumps, and sediment injector in the main bore at or near the junction between the main bore and the lateral bore, an existing watered out well may be re-entered, and a new lateral added to it. This decreases the overall cost involved in installing the separators, pumps, and sediment injector according to example implementations as compared with installing it at the completion of the well at the beginning of the life of the well. It also decreases the risks associated with installing these devices according to example implementations in existing wells that may be poor producers and represent a smaller cost if the well is lost during the trial as compared with selecting a potential well before well completion is finished. Using these separators and injectors in a downhole setting combined with a multilateral junction may provide efficiency gains.

This includes converting poor performing wells, wherein the percentage of oil has decreased to about 2% for example, into a downhole water injector combined with a better producing well. Additional benefits include lower flow rate and pressure rating requirements, a lighter fluid column, and increased recovery. Example implementations may be particularly useful in low flow rate wells (in the 200 barrel per day range or less), which tend to be shallow, and relatively inexpensive to drill. Moderate flow rate wells, for example 500-5000 barrels of fluid per day, may also be potential candidates for incorporating example implementations. Finally, it will also be useful for most multilaterals with very high flow rate wells, up to 50,000 barrels of fluid per day, for example.

Example implementations reference a tubing string for the delivery of fluids, sediment, etc. to the surface of the multilateral well or other downhole location. However, example implementations may use any type of flow channel, conduit, etc. for such delivery. For example, the sediment flow channel may be the annular space around the production flow tubing. Additionally, while depicting the separation being performed uphole relative to the junction between the main bore and the lateral well, example implementations may position the separation at any other location downhole. For instance, the separation may be performed at the junction, below the junction, etc.

The DOWSS may include flow inlet devices, oil-separation devices, water-separation devices, self-deprecation devices, flow outlet devices, flow outlet conduits (tubing, screens, y's, tees, splitters, etc.), fluid transport devices, fluid screening devices, formation support devices (liners, casings, screens, injection ports, and valves (including Outflow Control Devices (including automatic, chokes, restrictors, regulating, etc.). The outflow control devices may comprise one or more features similar to inflow control devices such Inflow Control Devices (ICD's), Automatic Inflow Control Devices (AICD's), Gravity-based ICD's, AIDC's, etc., Viscous-based ICD's, AIDC's, etc., Inertial-based ICD's, AIDC's, etc., pumps, regulators, sensors, controllers, relays, transmitters, floats, etc.

Examples implementations may include an injecting-while-producing system—wherein one pump may be used to force fluid into one formation and a second pump may be used to produce fluid from a second zone. This single-bore water-flood solution maintains downhole pressure to reduce cycling and recover more oil in struggling wells. The injecting-while-producing system may inject from an upper zone and produce from the lower with the aid of isolation packers, or it can inject in the bottom zone and produce from a zone higher in the well.

In some implementations, the separation system 200 and/or any one or more of the components within the separation system 200 may be oriented with respect to gravity. For example, components such as the fluid separator 296, separator 201, sediment separators 290A-N, etc. may be oriented with respect to gravity such that gravity may assist in separating the phases of the formation fluid 118, sediment 295 from the formation fluid 118, etc.

Example Cleaning Devices

Figure 3:
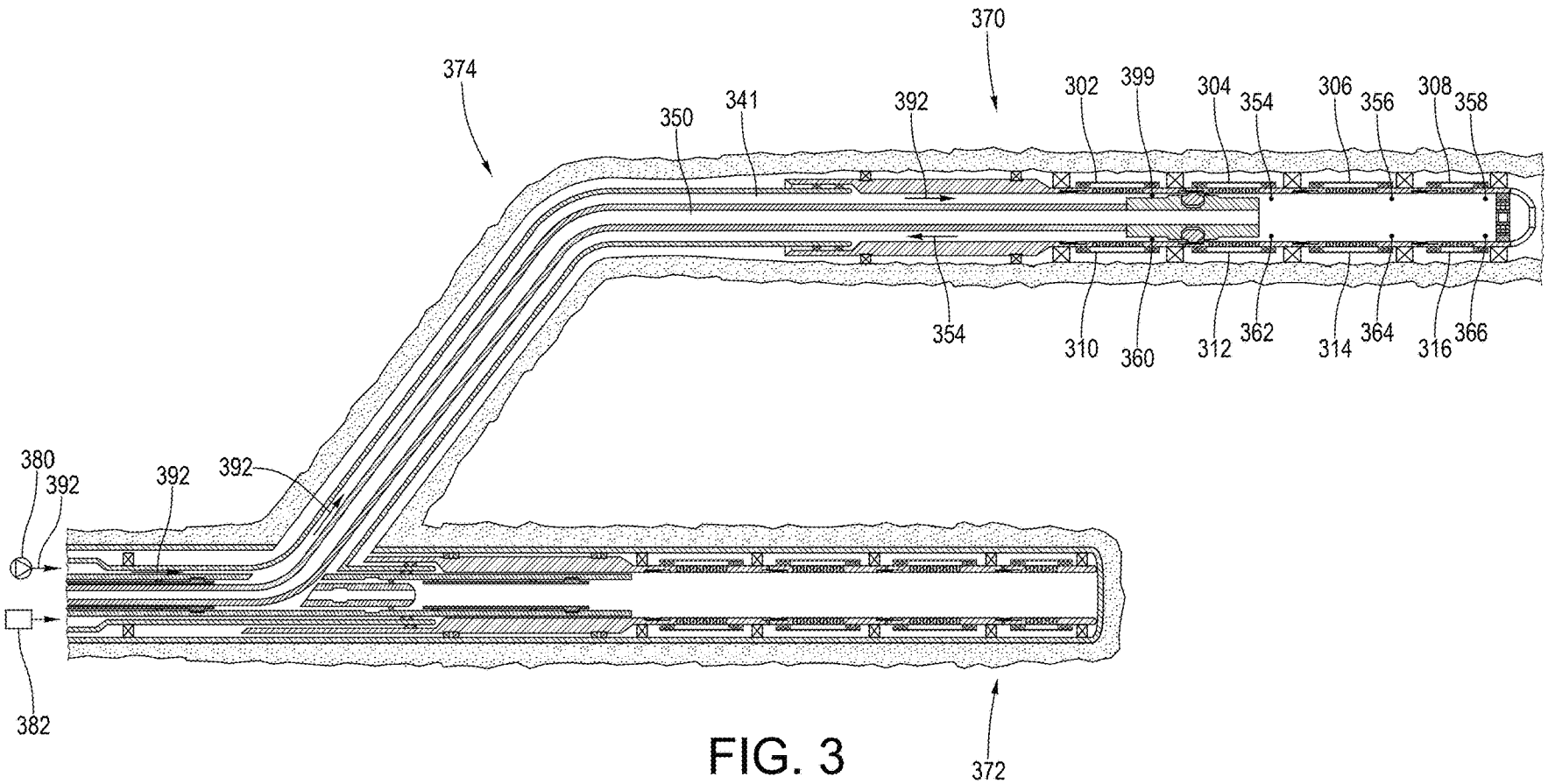
FIG. 3 is a cross sectional side view of an example downhole configuration in a multi-bore well that includes screens (that are intermittently cleaned) used to filter out solids from a formation fluid entering a tubing for separation and processing, according to some embodiments.

FIG. 3 is a cross sectional side view of an example downhole configuration in a multi-bore well that includes screens (that are intermittently cleaned) used to filter out solids from a formation fluid entering a tubing for separation and processing, according to some embodiments. FIG. 3 depicts a multi-bore well 374 having a first bore 370 and a second bore 372. The first bore 370 includes a liner 341 having screens 302-316 configured to receive formation fluid from the surrounding subsurface formation and into the liner 341 for downhole separation and processing (as described herein). In the example of FIG. 3, at least one of the outer or inner diameter of the screens 302-316 may be cleaned.

The formation fluid passing through the screens 302-316 will include solids. Accordingly, the screens 302-316 may filter out at least some of the solids so that the solids do not pass through the screens 302-316. However, over time, these screens 302-316 may become clogged with the solid and need to be cleaned. Accordingly, a coiled tubing 350 with an example cleaning device 399 may be positioned within the liner 341. The coiled tubing 350 fluidly couples a pump 380 and one or more devices similar to the exemplary cleaning device 399 to clean the screens 302-316. While depicted at a surface of the well 374, in some implementations, the pump 380 may be positioned anywhere downhole. The pump 380 may be configured to intermittently pump cleaning fluid 392 (such as water) through the coiled tubing 350 to a cleaning device 399 to clean one or more of the screens 302-308 positioned at a top portion of first bore 370 and screens 310-316 positioned at a bottom portion of the first bore 370.

In some implementations, the screens 302-316 may be cleaned periodically (independent of any condition). Alternatively or in addition, the screens 302-316 may be cleaned in response to detecting or sensing a change in a value of any of a number of parameters. One or multiple sensors at any number of locations may sense values of any number of parameters. For example, a sensor may be positioned behind the screens 302-316 opposite the subsurface formation. Such a sensor may sense a flow rate of the formation fluid. In some implementations, one or multiple sensors may be positioned in one or more components of a separation system 124 represented in FIG. 1 and/or separation system 200 of FIG. 2 and/or other device(s) associated with material transfer, etc.

A controller 382 may control a cleaning device 399 and the cleaning of the screens 302-316. For example, the controller 382 may control how and when the pump 380 transmits the cleaning fluid 392 downhole to cleaning device 399 to clean the screens 302-316. While depicted at a surface of the well 374, in some implementations, the controller 382 may be positioned anywhere downhole. In some implementations, the controller 382 may initiate the operation of the pump 380 to clean at least one screen using the cleaning fluid 392 in response to the value of a parameter passing a threshold value. For example, at least one sensor may be configured to detect a value of a parameter that is indicative the at least one screen needs to be cleaned. To illustrate, FIG. 3 depicts a number of sensors 352-366 to depict a flow rate of the formation fluid passing through the associated screen 302-316, respectively, from the subsurface formation. The controller 382 may initiate cleaning of one or more of the screens 302-316 if the flow rate for at least of the screens 302-316 falls below a flow rate threshold. For example, the controller 382 may initiate cleaning if the flow rate for one, more than half, all, etc. of the screens 302-316 falls below a flow rate threshold. In some implementations, a given flow rate threshold value may be unique to the given type of fluid and the location of the sensor.

Alternatively or in addition, there may be other controllers and/or sensors at other locations downhole and/or at the surface of the multi-bore well 374. The controller 382 and these other sensors, and/or another controller and sensors such as mentioned for use with separation system 124, may control the cleaning of the screens 302-316. Such sensors may measure flow rates of different types of fluids, amounts (volume) of solids accumulated during downhole separation, etc. For example, sensors may measure a flow rate of the production fluid at the surface of the multi-bore well 374, a flow rate downhole of the nonproduction fluid after its separation from production fluid, etc. If these flow rates fall below a flow rate threshold value, the controller 382 may initiate the operation to the clean the screens 302-316.

Alternatively or in addition, a sensor may sense a level of solids (or sediment) for a given unit of time being separated from the formation fluid, the production fluid and/or nonproduction fluid (as described herein). If this level of solids being separated out falls below a solids rate threshold value, the controller 382 may initiate cleaning of the screens 302-316 or provide an indication that the screens 302-316 need to be cleaned. In some implementations, a given solids rate threshold value may be unique to the given type of fluid from which the solids are being separated and the location of the sensor.

In some implementations, the controller may initiate cleaning of the screen based on values of a combination of parameter values. For example, the controller may initiate cleaning of the screen if the level of solids being separated out from a given fluid falls below a solid threshold value and if a flow rate of a given fluid falls below a flow rate threshold value.

The timing of the cleaning of the screens 302-316 may be based on other parameters. For example, the cleaning of the screens 302-316 may be based on time, the amount of different fluids being processed, etc. For instance, the cleaning of the screens 302-316 may occur after an amount of production fluids produced at the surface of the well exceeds a threshold, after an amount of formation fluids is received by a DOWSS for separation, etc.

The controller 382 may initiate cleaning of the screens 302-316 by causing the pump 380 to activate to pump the cleaning fluid 392 to one or more cleaning device(s) 399 so the cleaning fluid 392 may be directed into the area of the screens 302-316 to clean off the solids from on and around the screens 302-316. In some implementations, the cleaning fluid 392 may be water. In some other implementations, the cleaning fluid 392 may be other types of fluids.

In some implementations, the cleaning fluid 392 may be water in combination with at least one cleaning composition. The controller 382 and the pump 380 may be at the surface of the well and/or at any location downhole. In some implementations, there may be a pump at the surface of the well and a pump downhole. For example, there may be a pump downhole that is part of the DOWSS such that the pump may pump the nonproduction fluid (that has been separated out during the DOWSS operation) into the area of the screens 302-316 to clean off the solids from the screens 302-316.

In some implementations, the controller may initiate the pump at the surface and/or the pump downhole. For example, if the level of flow rate of the formation fluid drops below a different threshold, the controller may initiate both pumps to clean the screens. As another example, the controller may use the pump downhole if there is a sufficient level of nonproduction fluid that is available to perform the cleaning operation. As further described below, an inner diameter and/or an outer diameter of the screens may be cleaned. Additionally, while described in reference to cleaning of screens, in some implementations, other parts of the DOWSS may be cleaned (similar to the cleaning of the screens).

Figure 4:
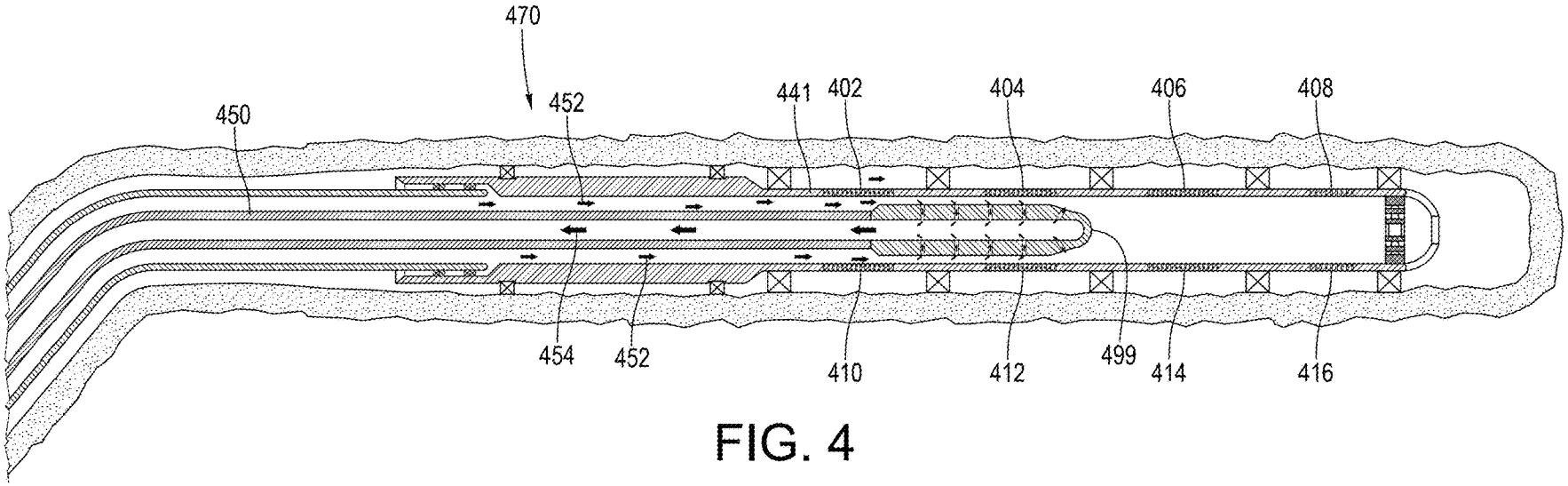
FIG. 4 is a cross sectional side view of an example downhole configuration for cleaning the inner diameter of a slotted liner, according to some embodiments.

FIG. 4 is a cross sectional side view of an example downhole configuration for cleaning the inner diameter of a slotted liner, according to some embodiments. FIG. 4 depicts a bore 470 that may be part of a multi-bore well. A slotted liner 441 is positioned in the bore 470 and includes a number of joints of slotted liner 402-416. The joints of slotted liner 402-416 may be configured to receive formation fluid from the surrounding subsurface formation and into the liner 441 for downhole separation and processing (as described herein). In some implementations, the slotted liners may be configured to receive non-production fluid (e.g., water) from another portion of the well, which is injected through the slot and into the bore 470. The joints of slotted liner 402-416 may be used to filter out solids from the formation fluid entering the liner 441 or solids from the non-production fluid entering the bore/formation. Slotted liner may work both ways (ingress and egress), since an application may be to use the slotted liners to keep solids out of the space that would be used to inject the water separated by the DOWS. Accordingly, this makes cleaning the inner diameter of the screens important.

The formation fluid passing through the joints of slotted liner 402-416 will include solids. Accordingly, the joints of slotted liner 402-416 may filter out at least some of the solids so that the solids do not pass through the joints of slotted liner 402-416. However, over time, these joints of slotted liner 402-416 may become clogged with the solid and need to be cleaned. Accordingly, a coiled tubing 450 is positioned within the liner 441. The coiled tubing 450 fluidly couples a pump (not shown in FIG. 4) and the joints of slotted liner 402-416. The pump may be positioned at the surface of the well and/or anywhere downhole. The pump may be configured to intermittently pump cleaning fluid 452 (such as water) through the coiled tubing 450 to clean one or more of the joints of slotted liner 402-408 positioned at a top portion of the bore 470 and joints of slotted liner 410-416 positioned at a bottom portion of the bore 470. As shown in this example, the cleaning fluid 452 flows within the inner diameter of the joints of slotted liner 402-416 for cleaning the inner side of the joints of slotted liner 402-416. In some implementations, cleaning device 499 may be attached to the end of coiled tubing 450 to enhance the cleaning capabilities. In other implementations, the cleaning device may comprise parts attached to the coiled tubing 450 and/or components of liner 441 such a joint of slotted liner 402-416, etc.

This flushing of the inner diameter is analogous to cleaning a furnace filter. A furnace filter may be cleaned by 1) dislodging debris from the inlet surface or 2) blowing air through the filter in the opposite direction that the filter filters air. In the same way, cleaning the inner side of the slots may 1) flush large solids caught on the inlet side—large solids will only catch here when water is being disposed into the formation.

Figure 5:
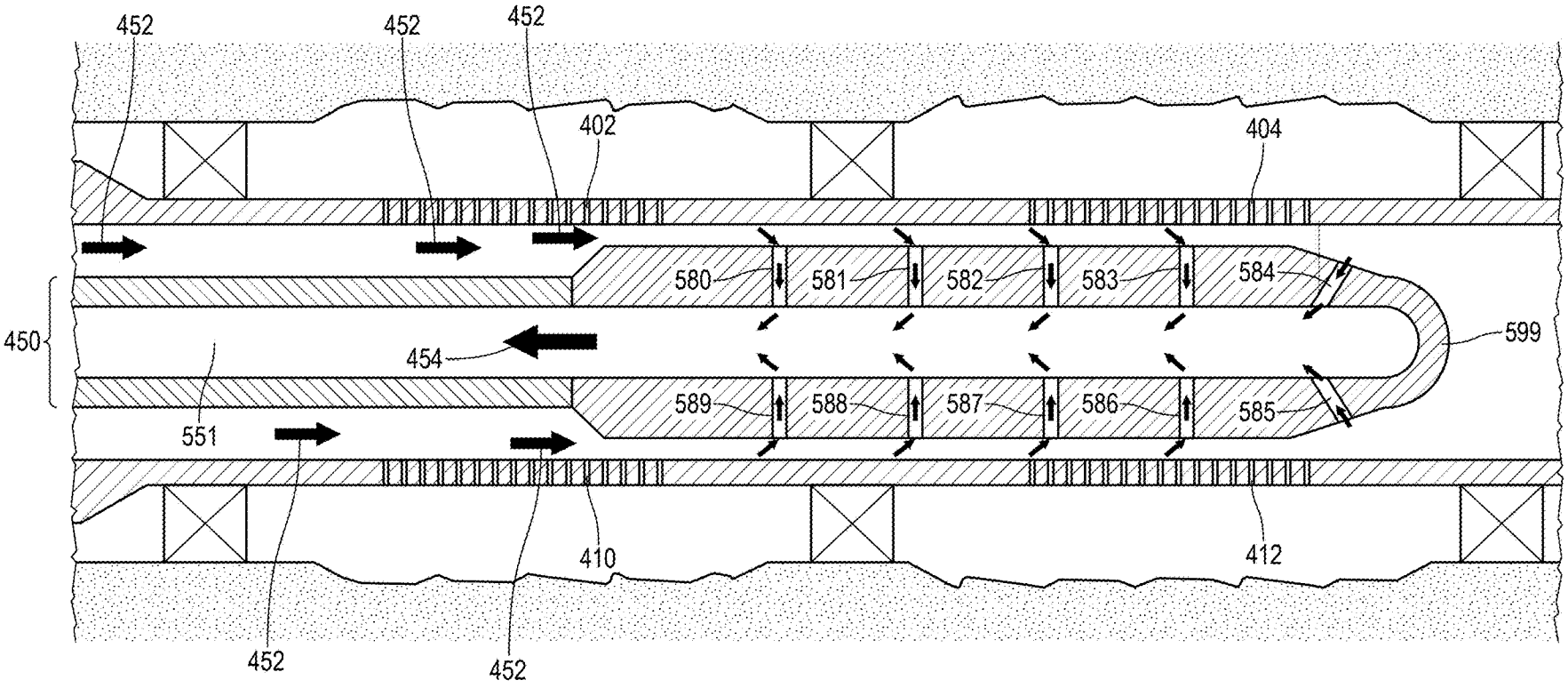
FIG. 5 is a more detailed cross sectional side view of FIG. 4 (for cleaning the inner diameter of a slotted liner), according to some embodiments.

The other reason for flushing the inner diameter as shown in FIGS. 4-5 is to remove "smaller/denser" debris that accumulates in the area. For example, some debris may be small enough to enter from the formation and pass through the slots/screens, but settles out right away due to things such as decreased fluid velocity of the fluid once it enters the tubular (441).

In some implementations, the fluid 452 may be pumped through the coiled tubing in the reverse circulation method as shown in FIG. 5. When using the reverse circulation method, fluid may be injected on the backside (or annulus) of the tubular (e.g., the annulus of the coiled tubing 450). In this manner, the fluid 452 may flow upwards towards the surface on the inside of coiled tubing 450. Accordingly, the flow to the tools may be in the annulus of the tubing (reverse circulation) and/or through an inner diameter of the tubing (conventional circulation). In some implementations, the flow may be changed, altered, slowed, stopped, paused, pulsed, modified, velocity increased, etc.

A controller (not shown) may control the cleaning of the screens 402-416. For example, the controller may control how and when the pump transmits the cleaning fluid 452 downhole to clean the inner diameter of the screens 402-416. The controller may be positioned at the surface of the well and/or anywhere downhole. Similar to the configuration of FIG. 3 (described above), the controller may initiate the operation of the pump to clean at least one screen using the cleaning fluid 452. For example, the screens 402-416 may be cleaned periodically and/or in response to the value of a parameter passing a threshold value.

Also, the controller and the pump of FIG. 4 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values or one or more parameters (such as flow rate of fluids, amount of solids, etc.). The sensor may be a component of the coiled tubing 450, joint(s) of slotted liner 402-416, one or more components of cleaning tool 4YY, etc.

Similar to the controller 382 of FIG. 3, the controller of FIG. 4 may initiate the operation of the pump to clean at least one slotted line (or screen) using the cleaning fluid 452 based on one or more parameters. For example, the controller of FIG. 4 may initiate the cleaning of the screens based on one parameter or a combination of parameters (as described above in reference to FIG. 3).

FIG. 5 is a more detailed cross sectional side view of FIG. 4 (for cleaning the inner diameter of screens), according to some embodiments. FIG. 5 depicts the bore 470 that may be part of a multi-bore well. The liner 441 is positioned in the bore 470 and includes the joints of slotted liner 402-416. The coiled tubing 450 fluidly couples a pump (not shown in FIG. 5) and cleaning tool 4YY to clean the joints of slotted liner 402-416. The pump may be configured to intermittently pump cleaning fluid 452 (such as water) through the coiled tubing 450 to clean one or more of the joints of slotted liner 402-416. As shown in this example, the cleaning fluid 452 flows within the inner diameter of the joints of slotted liner 402-416 for cleaning the inner side of the joints of slotted liner 402-416. In some implementations, cleaning device 599 may be attached to the end of coiled tubing 450 to enhance the cleaning capabilities. In other implementations, the cleaning device may comprise parts attached to the coiled tubing 450 and/or components of liner 441 such a joint of slotted liner 402-416, etc.

FIG. 5 also depicts a number of slots 580-589 in the coiled tubing 450 at or near the joints of slotted liner 402-416 to allow for the cleaning fluid and solids (shown as 454) after cleaning of the joints of slotted liner 402-416 to return uphole via an inner path 551. For example, the cleaning fluid and solids 454 may be returned to the surface of the well. Alternatively or in addition, the cleaning fluid and solids 454 may be transported to the downhole separation system for separation and disposal (see description of FIG. 2 above).

Although FIG. 5 shows a rather simple tool with the slots 580-589, the tool 599 may be more complex. For example, the tool may have sharp edges, cutting inserts, etc. for milling steel or removing large pieces of debris. The tool may have dogs, collets, keys, etc. for engaging one or more profiles within the wellbore or tools/devices in the well. The tool may have moving parts such as swivels, actuators, end effectors, grippers, hooks, wedges, drivers, etc. for moving components that are installed downhole or a component of the bottom hole assembly (the one or more tools lowered by tubing 450). The tool may have turbines, motors, hydraulic, electrical, pneumatic, fluidic, mechanical linkages and devices. Accordingly, the tool may be used to repair or replace parts in the wellbore, in a DOWS system, etc. Thus, some implementations may be such that different services may be conducted downhole.

Any other tool, device, object, obstruction may be transported to the one or more bores, zones, tubulars, etc. within the well. A production riser or other device in which the fluids, solids, gases, effluents, etc. may pass or not pass. In some implementations, the bottom hole assembly (BHA) and/or this tool, 599 may comprise a Vac Tool (vacuum tool).

The BHA and/or this tool may comprise a sealed atmospheric chamber and a shear pin, or similar activation mechanism, to allow communication with the wellbore. After the tool is activated, there is a fluid surge into the atmospheric void as the pressure is equalized. A shroud arrangement at the base of the tool contains and directs the fluid surge to dislodge and capture any debris in the area. The tubing BHA (bottom hole assembly) may comprise a downhole device that may filter the fluid and solids. It may also collect debris that is unable to be circulated out of well.

Figure 6:
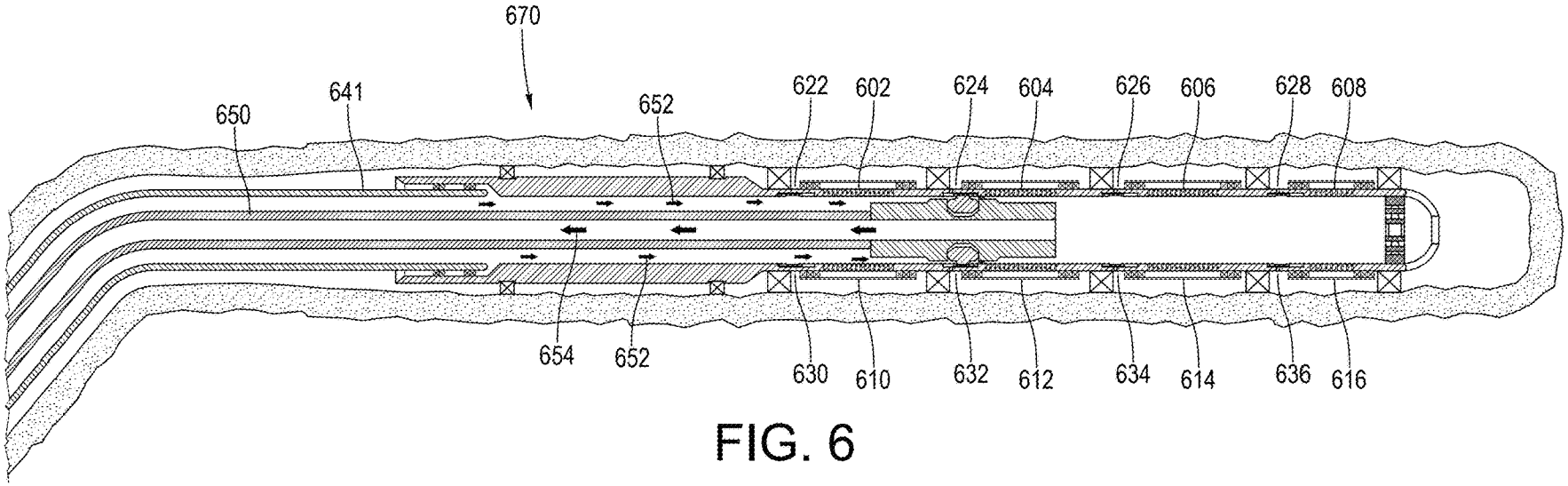
FIG. 6 is a cross sectional side view of an example downhole configuration for cleaning the outer diameter of screens, according to some embodiments.

FIG. 6 is a cross sectional side view of an example downhole configuration for cleaning the outer diameter of screens, according to some embodiments. In this example of FIG. 6, a slide valve may be opened to allow for the cleaning fluid to flow to the outer diameter of the screens. Such a configuration allows the cleaning of the outer diameter of the screens to remove solids therefrom.

FIG. 6 depicts a bore 670 that may be part of a multi-bore well. A liner 641 is positioned in the bore 670 and includes a number of screens—screens 602-616. The screens 602-616 may be configured to receive formation fluid from the surrounding subsurface formation and into the liner 641 for downhole separation and processing (as described herein). The screens 602-616 may be used to filter out solids from the formation fluid entering the liner 641.

The formation fluid passing through the screens 602-616 will include solids. Accordingly, the screens 602-616 may filter out at least some of the solids so that the solids do not pass through the screens 602-616. However, over time, these screens 602-616 may become clogged with the solid and need to be cleaned. Accordingly, a coiled tubing 650 is positioned within the liner 641. The coiled tubing 650 fluidly couples a pump (not shown in FIG. 6) and the screens 602-616. The pump may be positioned at the surface of the well and/or anywhere downhole. The pump may be configured to intermittently pump cleaning fluid 652 (such as water) through the coiled tubing 650 to clean one or more of the screens 602-608 positioned at a top portion of the bore 670 and screens 610-616 positioned at a bottom portion of the bore 670.

The liner may also include valves 622-636. Each of the valves 622-636 may be associated with the screens 602-616, respectively. The valves 622-636 may be opened and closed together or independent of each other. For example, assume a sensor associated with the screen 602 measures a flow rate indicative that the screen 602 needs to be cleaned, while sensors associated with the screen 604-616 measures a flow rate indicative that the screens 604-616 do not require cleaning. In this example, the valve 622 may be opened for enabling cleaning of the outer diameter of the screen 602, while the valves 624-636 may remain closed.

A controller (not shown) may control the cleaning of the screens 602-616. For example, the controller may control how and when the pump transmits the cleaning fluid 652 downhole to clean the outer diameter of the screens 602-616. The controller may also control opening and closing of the valves 624-636 to enable the flow of the cleaning fluid 652 to the outer diameter of the screens 602-616. The controller may be positioned at the surface of the well and/or anywhere downhole. Similar to the configuration of FIG. 3 (described above), the controller may initiate the operation of the pump to clean at least one screen using the cleaning fluid 652. For example, the screens 602-616 may be cleaned periodically and/or in response to the value of a parameter passing a threshold value.

Also, the controller and the pump of FIG. 6 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values or one or more parameters (such as flow rate of fluids, amount of solids, etc.).

Similar to the controller 382 of FIG. 3, the controller of FIG. 6 may initiate the operation of the pump to clean at least one screen using the cleaning fluid 652 based on one or more parameters. For example, the controller of FIG. 6 may initiate the cleaning of the screens based on one parameter or a combination of parameters (as described above in reference to FIG. 3).

Figure 7:
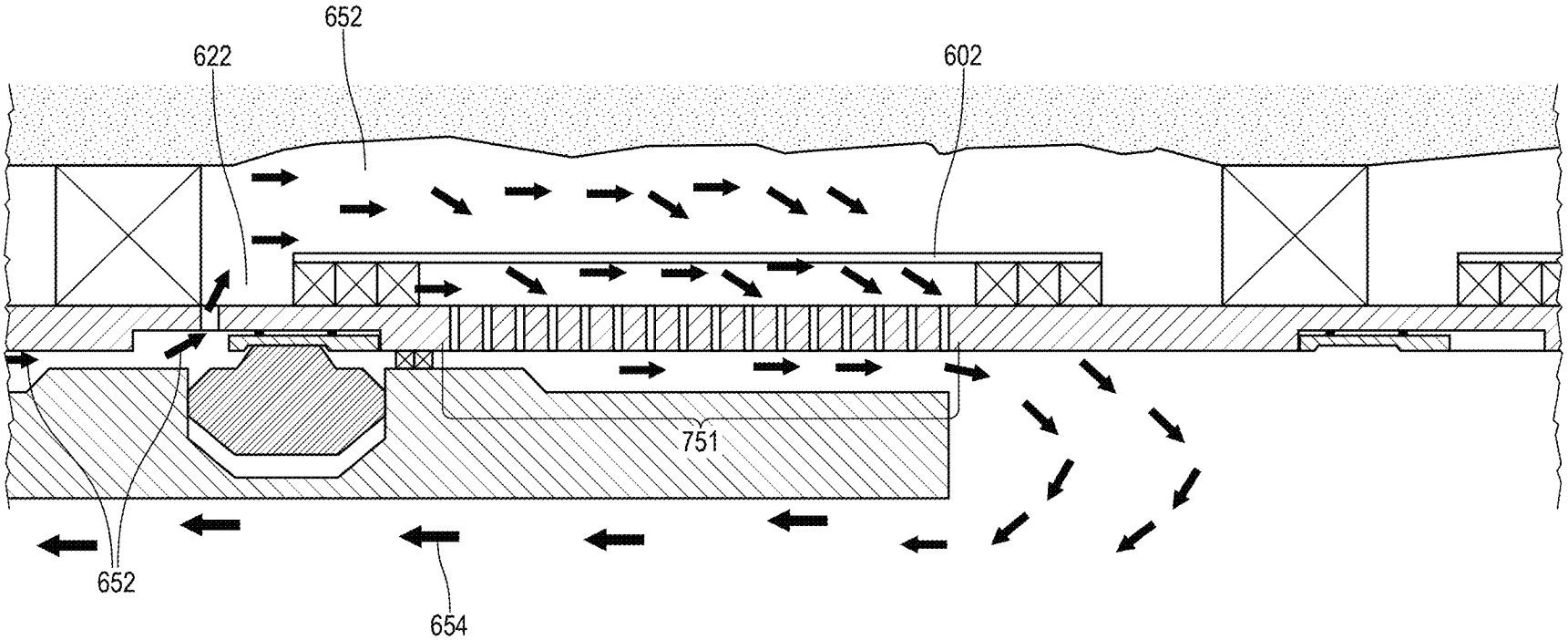
FIG. 7 is a more detailed cross sectional side view of FIG. 6 (for cleaning the outer diameter of screens), according to some embodiments.

FIG. 7 is a more detailed cross sectional side view of FIG. 6 (for cleaning the outer diameter of screens), according to some embodiments. FIG. 7 depicts the screen 602 and the associated valve (the valve 622). The valve 622 is opened—allowing the cleaning fluid 652 to flow to the outer diameter of the screen 602. As shown, as the cleaning fluid 652 cleans the outer diameter of the screen 602, the cleaning fluid 652 flows through the screen 602 and through openings 751 of the liner. After cleaning, the fluid 652 may then return uphole through an inner path of the tubing (shown as the fluid 654). FIG. 7 shows cleaning an injection screen (screen used to filter fluid being injected into a formation). It shows to remove big debris on the inside of the slots/screens and removing small debris by "reverse flushing"—the cleaning fluid flushes in the reverse direction that the injected fluid flows.

Figure 8:
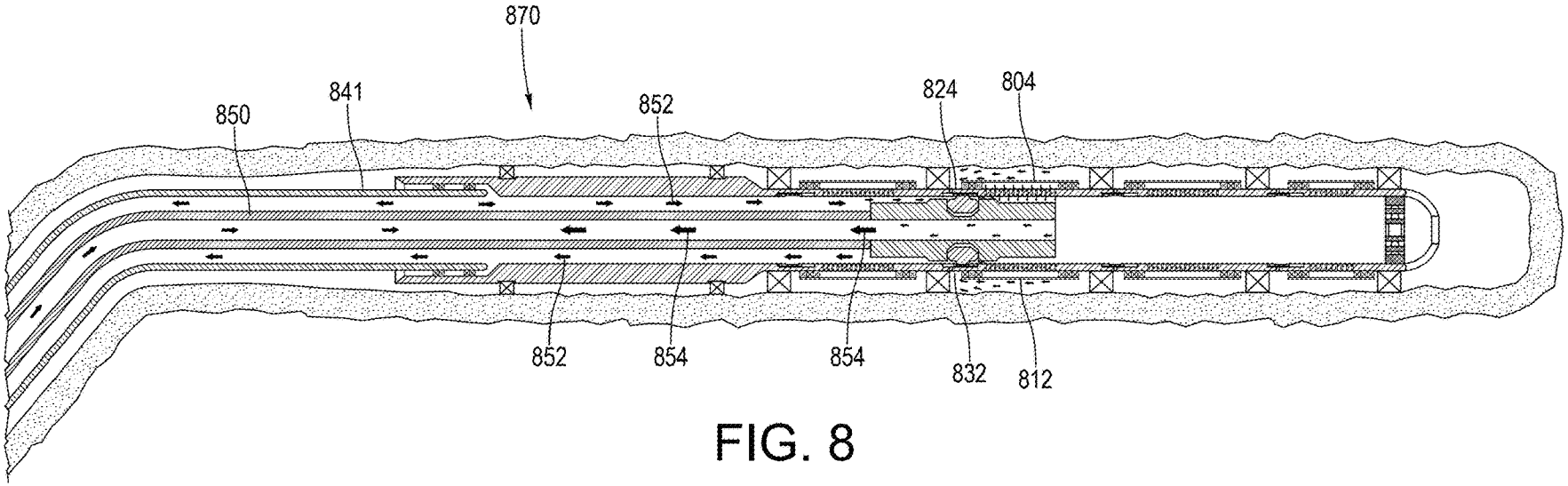
FIG. 8 is a cross sectional side view of an example slide valve opened to pump into annulus of base pipe and screens, according to some embodiments.

FIG. 8 is a cross sectional side view of an example slide valve opened to pump into annulus of base pipe and screens, according to some embodiments. FIG. 8 depicts a bore 870 that may be part of a multi-bore well. A liner 841 is positioned in the bore 870 and includes a number of screens (including screens 804 and 812). The screens 804 and 812 may be configured to receive formation fluid from the surrounding subsurface formation and into the liner 841 for downhole separation and processing (as described herein). The screens 804 and 812 may be used to filter out solids from the formation fluid entering the liner 841.

The formation fluid passing through the screens 804 and 812 will include solids. Accordingly, the screens 804 and 812 may filter out at least some of the solids so that the solids do not pass through the screens 804 and 812. However, over time, these screens may become clogged with the solid and need to be cleaned. Accordingly, a coiled tubing 850 is positioned within the liner 841. The coiled tubing 850 fluidly couples a pump (not shown in FIG. 8) and the screens. The pump may be positioned at the surface of the well and/or anywhere downhole. The pump may be configured to intermittently pump cleaning fluid 852 (such as water) through the coiled tubing 850 to clean one or more of the screens. As shown in this example, the cleaning fluid 852 flows within the inner portion of the screens 804 and 812

A controller (not shown) may control the cleaning of the screens. The controller may be human, electronic, computer, or any combination thereof. It may be Artificial Intelligence (AI) assisted, Deep Learning, Machine Learning, LLM assisted and/or assisted with software and hardware. For example, the controller may control how and when the pump transmits the cleaning fluid 852 downhole to clean the screens. The controller may be positioned at the surface of the well and/or anywhere downhole. Similar to the configuration of FIG. 3 (described above), the controller may initiate the operation of the pump to clean at least one screen using the cleaning fluid 852. For example, the screens may be cleaned periodically and/or in response to the value of a parameter passing a threshold value.

Also, the controller and the pump of FIG. 8 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values or one or more parameters (such as flow rate of fluids, amount of solids, etc.).

Similar to the controller 382 of FIG. 3, the controller of FIG. 8 may initiate the operation of the pump to clean at least one screen using the cleaning fluid 852 based on one or more parameters. For example, the controller of FIG. 8 may initiate the cleaning of the screens based on one parameter or a combination of parameters (as described above in reference to FIG. 3).

Figure 9:
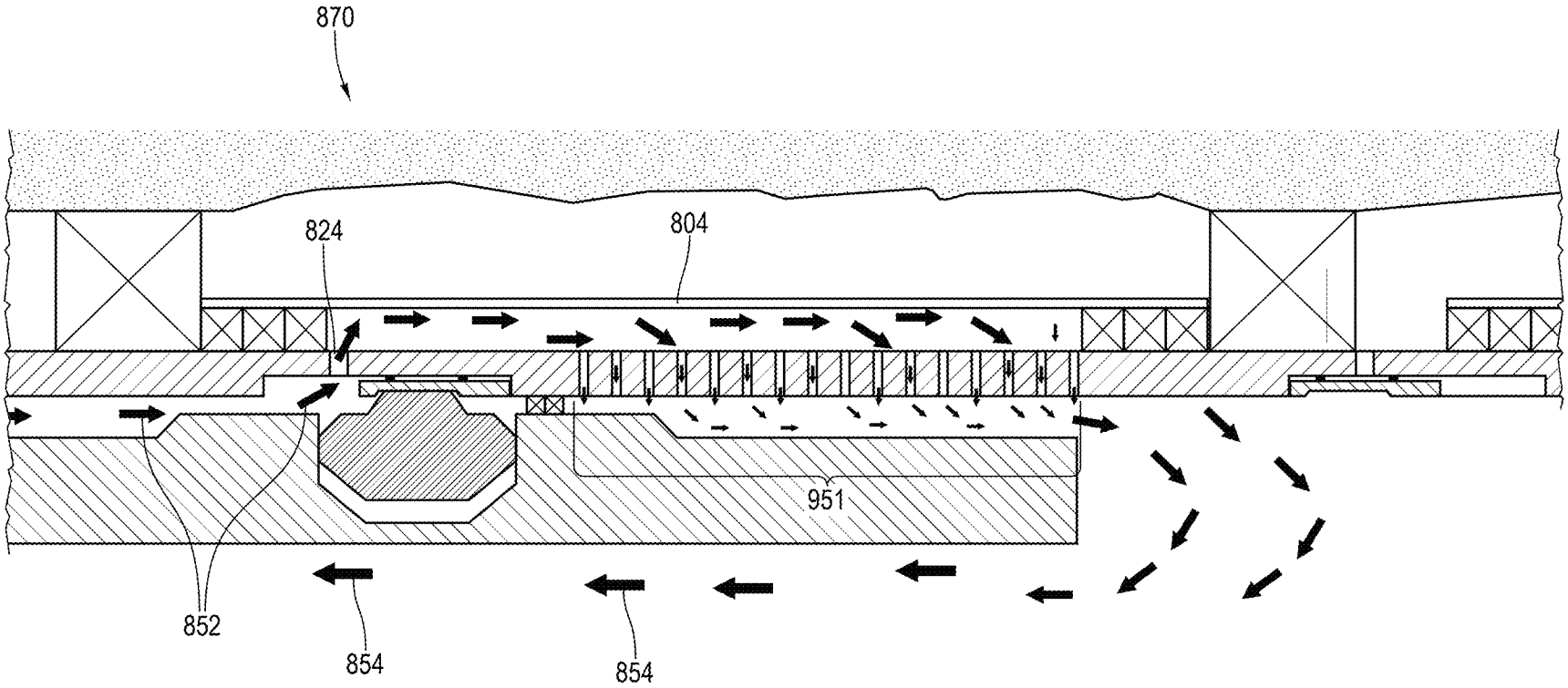
FIG. 9 is a more detailed cross sectional side view of FIG. 10 (showing flushing between the outer shroud and screens), according to some embodiments.

FIG. 9 is a more detailed cross sectional side view of FIG. 8 (showing flushing between the outer shroud and screens), according to some embodiments. FIG. 9 depicts the screen 804 and the associated valve (the valve 824). The valve 824 is opened—allowing the cleaning fluid 852 to flow to the inner portion of the screen 804. As shown, as the cleaning fluid 852 cleans the inner portion of the screen 804, the cleaning fluid 852 flows through the screen 804 and through openings 951 of the liner. After cleaning, the fluid 852 may then return uphole through an inner path of the tubing (shown as the fluid 854). As discussed above, the flow of fluids may be reversed. The fluid 854 may be pumped down the inner path of the tubing and the fluid 854 may return up the annulus of the tubing string.

Figure 10:
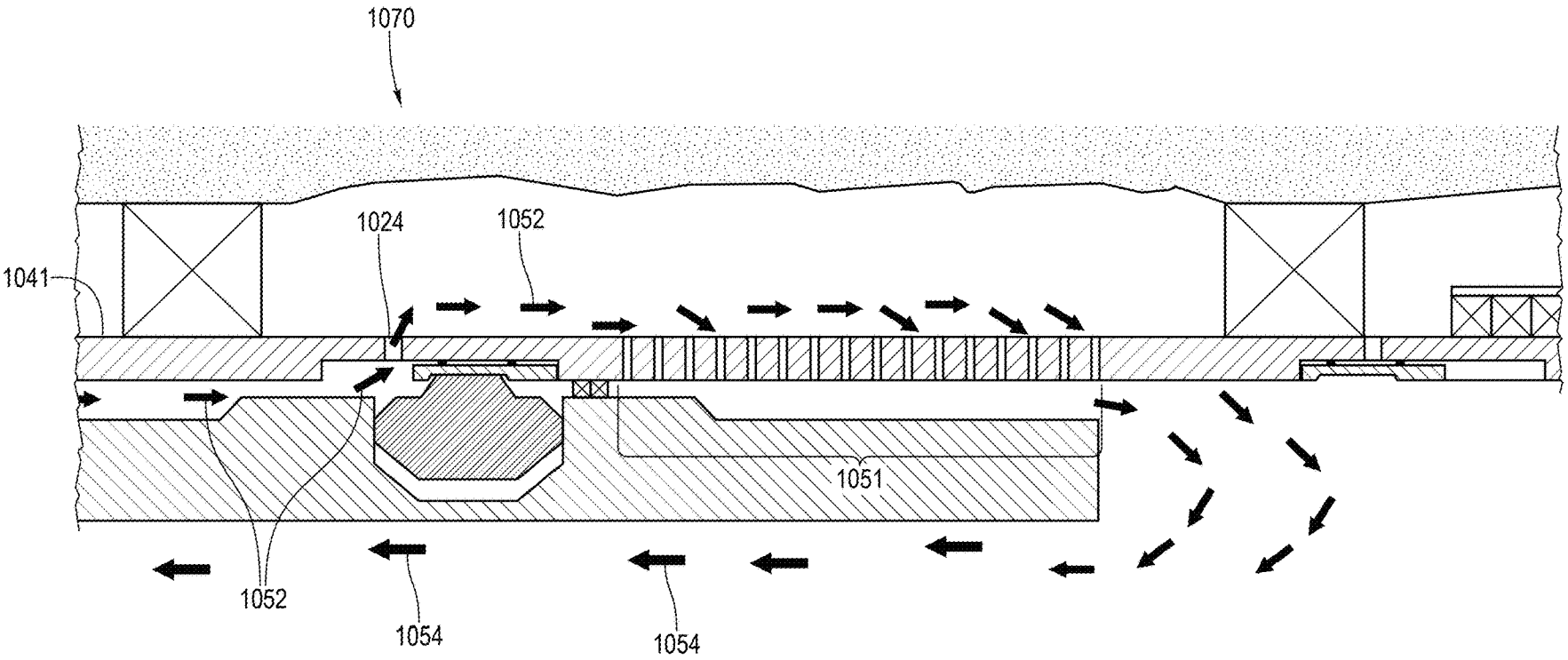
FIG. 10 is a more detailed cross sectional side view of flushing a wellbore section and slotted liner (no screens), according to some embodiments.

FIG. 10 is a more detailed cross sectional side view of flushing a wellbore section and slotted liner (no screens), according to some embodiments. In contrast to the previous examples, FIG. 10 depicts a configuration that does not include screens such that the slots of the liner may be cleaned (instead of the screens).

FIG. 10 depicts a bore 1070 that may be part of a multi-bore well. A liner 1041 is positioned in the bore 1070 and includes a number of slots 1051. The slots 1051 may be configured to receive formation fluid from the surrounding subsurface formation and into the liner 1041 for downhole separation and processing (as described herein). The slots 1051 may be used to filter out solids from the formation fluid entering the liner 1041.

The formation fluid passing through the slots 1051 will include solids. Accordingly, the slots 1051 may filter out at least some of the solids so that the solids do not pass through the slots 1051. However, over time, the slots 1051 may become clogged with the solid and need to be cleaned. Accordingly, a coiled tubing is positioned within the liner 1041. The coiled tubing fluidly couples a pump (not shown in FIG. 10) and the slots 1051. The pump may be positioned at the surface of the well and/or anywhere downhole. The pump may be configured to intermittently pump cleaning fluid 1052 (such as water) through the coiled tubing to clean one or more of the slots 1051. As shown in this example, the cleaning fluid 1052 may flow through a valve 1024 to the outer diameter of the slots 1051.

A controller (not shown) may control the cleaning. For example, the controller may control how and when the pump transmits the cleaning fluid 1052 downhole to clean the slots 1051. The controller may also control the opening and closing of the valve 1024. The controller may be positioned at the surface of the well and/or anywhere downhole. Similar to the configuration of FIG. 3 (described above), the controller may initiate the operation of the pump to clean the slots 1051 using the cleaning fluid 1050. For example, the slots 1051 may be cleaned periodically and/or in response to the value of a parameter passing a threshold value.

Also, the controller and the pump of FIG. 10 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values or one or more parameters (such as flow rate of fluids, amount of solids, etc.).

Similar to the controller 382 of FIG. 3, the controller of FIG. 10 may initiate the operation of the pump to clean using the cleaning fluid 1050 based on one or more parameters. For example, the controller of FIG. 10 may initiate the cleaning based on one parameter or a combination of parameters (as described above in reference to FIG. 3). In some implementations, the cleaning fluid 1050 may be hot oil. "Hot oiling" may be define the process of heating a fluid at surface (usually oil or a petroleum derivative) that is then pumped downhole. The objective of the heated fluid is to melt paraffin that may have solidified and blocks the passage of fluid.

Figure 11:
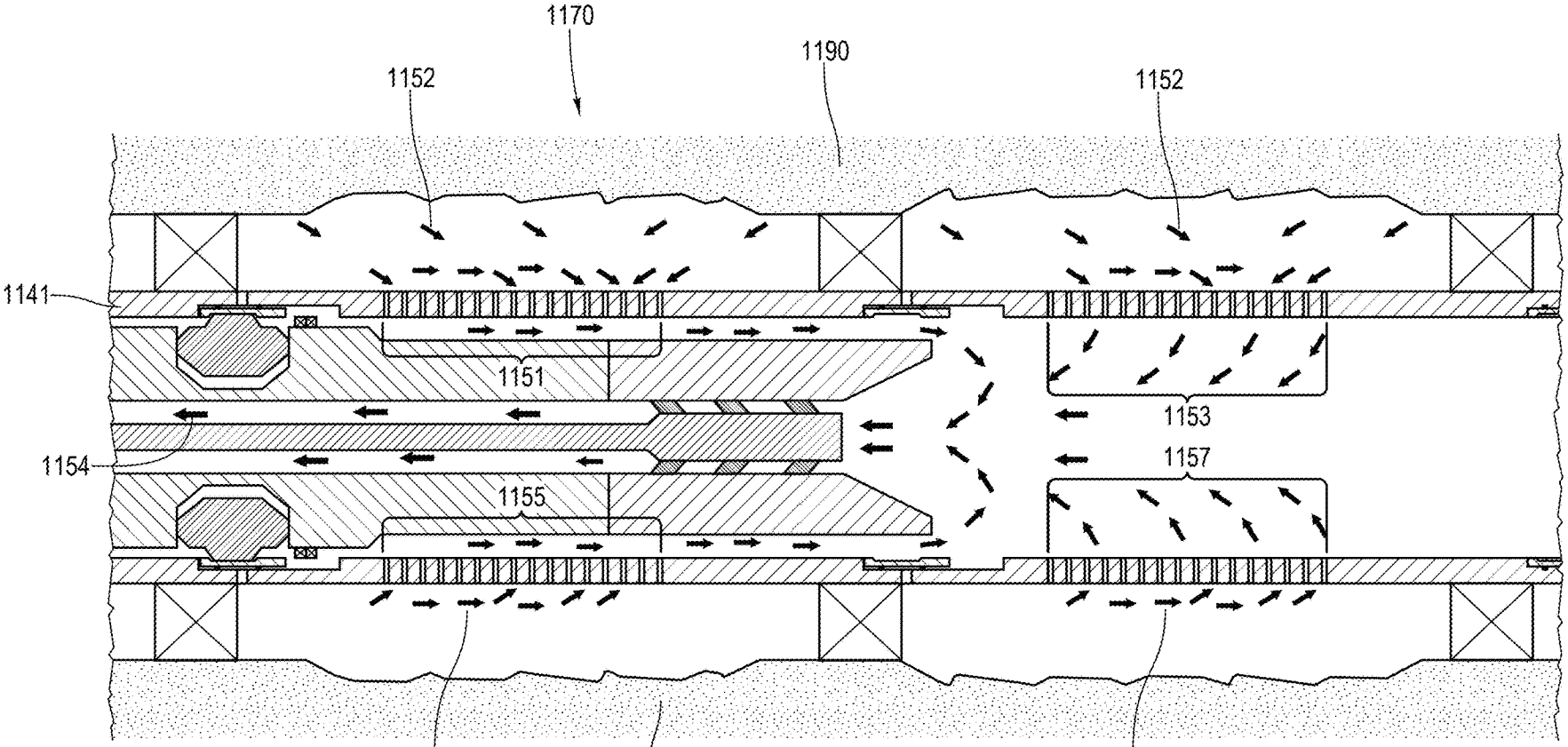
FIG. 11 is a cross sectional side view of an example swabbing of a reservoir, according to some embodiments.

FIG. 11 is a cross sectional side view of an example swabbing of a reservoir, according to some embodiments. FIG. 11 depicts a configuration that enables the swabbing of the reservoir (subsurface formation) surrounding the bore and from which the formation fluid is received. FIG. 11 depicts a bore 1170 formed in a reservoir 1190 that may be part of a multi-bore well. A cleaning fluid 1152 may pass outside the outer diameter of a liner 1141 to swab the reservoir 1190. Swabbing may be defined as the act of accessing the production zones of wells and removing accumulated (e.g., fracking) fluids. To efficiently remove the solids from the well, teams may use specific swabbing equipment, which may include of a winch, cable, swab cups, etc. Using the winch, the operator may lower and raise the cable and swab cups into and out of the well. In general, the standard for fluid removal is pulling about six barrels out of the well by way of the swabbing rig. In some cases, it may only require a single run, while other wells may require multiple repeats to remove all the fluids (and a desired amount of solids). As the operator pulls the fluids (and solids), the bottom pressure of the well builds, allowing the oil or gas to flow unimpeded into the well bore. If it is the injector wellbore, swabbing may help free the solids that are blocking the slots 1151-1157. The operator may apply the swabbing process again and again whenever necessary to remove debris.

The liner 1141 is positioned in the bore 1170 and includes a number of slots—slots 1151, slots 1153, slots 1155, and slots 1157. The slots 1151-1157 may be configured to receive formation fluid from the surrounding subsurface formation and into the liner 1141 for downhole separation and processing (as described herein). The slots 1151-1157 may be used to filter out solids from the formation fluid entering the liner 1141.

The formation fluid passing through the slots 1151-1157 will include solids. Accordingly, the slots 1151-1157 may filter out at least some of the solids so that the solids do not pass through the slots 1151-1157. However, over time, the slots may become clogged with the solid and need to be cleaned. Accordingly, a tubing is positioned within the liner 1141. The tubing fluidly couples a pump (not shown in FIG. 11) and the slots 1151-1157. The pump may be positioned at the surface of the well and/or anywhere downhole. The pump may be configured to intermittently pump cleaning fluid 1152 (such as water) through the tubing to clean one or more of the slots 1151-1157. As shown in this example, the cleaning fluid 1152 may flow through a valve 1124 to the outer diameter of the slots 1151-1157. Before, during, or after pumping fluid(s), the tubing annulus may be sealed off and a swabbing assembly lowered to perform a process known as swabbing. Swabbing comprises lowering a swabbing assembly (e.g., an assembly of swab cups and related devices) to the desired depth and then pulling the assembly out of the well quickly (at an accelerated rate) which will cause fluid and debris to be pulled from 1152, 1151, 1153, etc. Likewise a sand bailing device may be utilized. A sand bailer may comprise an atmospheric chamber that is opened downhole. The lower pressure of the atmospheric chamber will cause debris (sand, etc.) to be pulled into the chamber. The chamber may close, or otherwise trap the debris in the sand bailer or other components of the Bottom Hole Assembly (BHA) so the debris can be pulled out of the well with the sand bailer assembly. In some instances, a tubing BHA (bottom hole assembly) may comprise a downhole device that may filter the fluid and solids during circulation. It may also collect debris that is unable to be circulated out of well, so the debris can be carried out of the well with the tubing BHA. The tubing bottom hole assembly may comprise a downhole device that may filter the fluid and solids. It may also collect debris that is unable to be circulated out of well.

A controller (not shown) may control the swabbing of the reservoir 1190. For example, the controller may control how and when the pump transmits the cleaning fluid 1152 downhole for the swabbing. The controller may also control the opening and closing of valves to enabling the passing of the cleaning fluid 1152 into the outer diameter of the liner 1141. The controller may be positioned at the surface of the well and/or anywhere downhole. Similar to the configuration of FIG. 3 (described above), the controller may initiate the operation of the pump using the cleaning fluid 1150. For example, the swabbing may be cleaned periodically and/or in response to the value of a parameter passing a threshold value.

Also, the controller and the pump of FIG. 11 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values or one or more parameters (such as flow rate of fluids, amount of solids, etc.).

Similar to the controller 382 of FIG. 3, the controller of FIG. 11 may initiate the operation of the pump to swab based on one or more parameters. For example, the controller of FIG. 11 may initiate based on one parameter or a combination of parameters (as described above in reference to FIG. 3).

Figure 12:
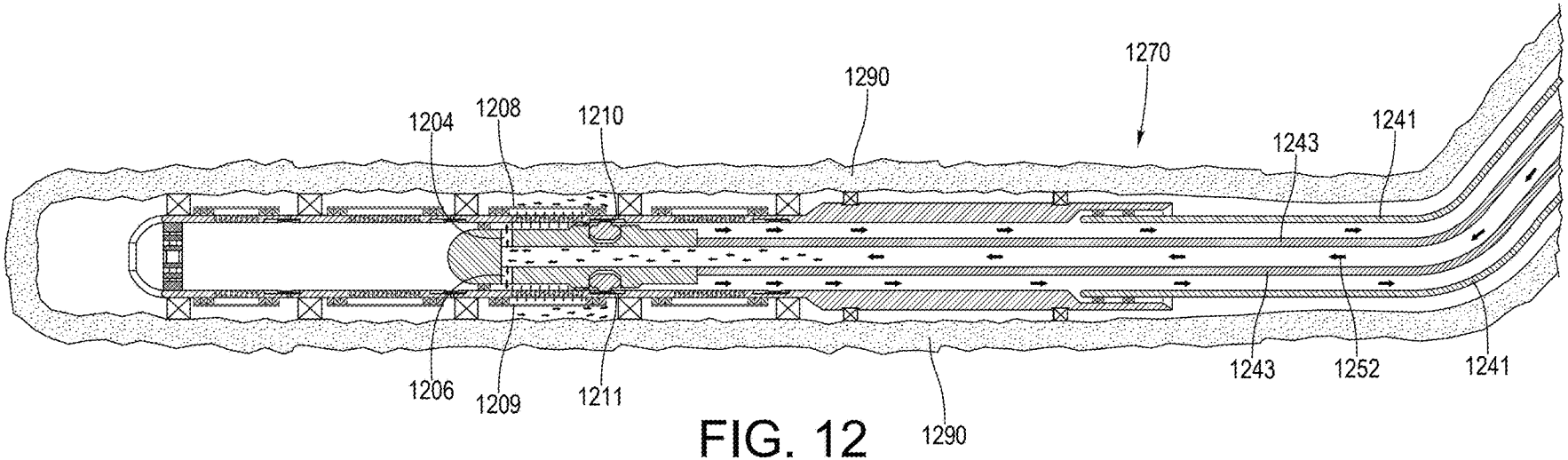
FIG. 12 is a cross sectional side view of an example cleaning of the screens wherein the cleaning fluid flows from an inner diameter to an outer diameter of the screen, according to some embodiments.
Figure 13:
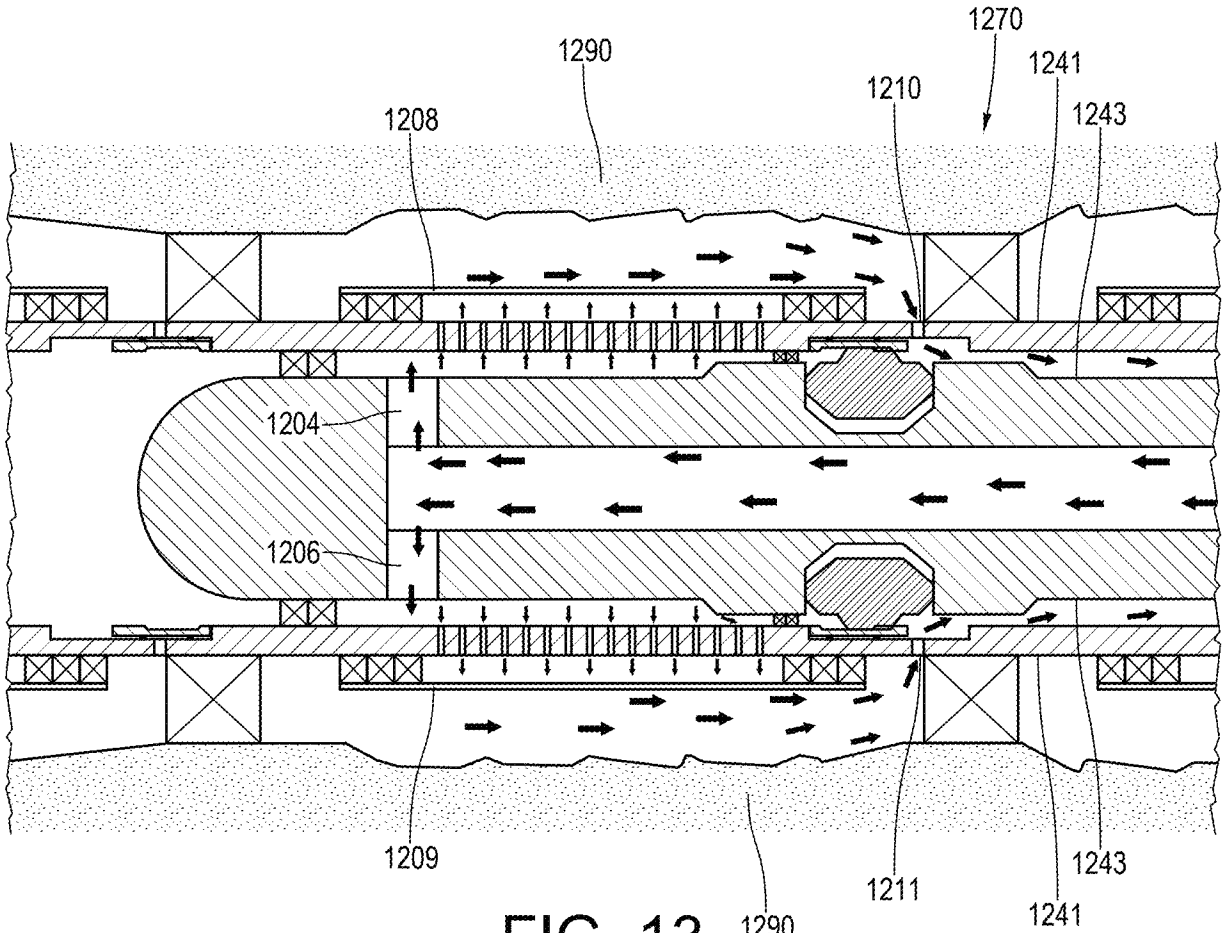
FIG. 13 is a more detailed cross sectional view of the example cleaning of the screens of FIG. 12, according to some embodiments.

FIG. 12 is a cross sectional side view of an example cleaning of the screens wherein the cleaning fluid flows from an inner diameter to an outer diameter of the screen, according to some embodiments. FIG. 13 is a more detailed cross sectional view of the example cleaning of the screens of FIG. 12, according to some embodiments. FIGS. 12-13 depict a bore 1270 formed in a reservoir 1290 that may be part of a multi-bore well. A liner 1241 is positioned in the bore 1270. A tubing 1243 is positioned in the liner 1241. A cleaning fluid 1252 may pass through the tubing 1243 and through ports 1204-1206. The cleaning fluid 1252 may then pass through slots in the liner 1241 out to the inner diameter of screens 1208-1209. The cleaning fluid 1252 may then pass through the screens 1208-1209 to an outer diameter of the screens 1208-1209. The cleaning fluid 1252 may then pass back inside the liner 1241 through ports 1210-1211. The cleaning fluid 1252 may then return through the liner 1241.

Figure 14:
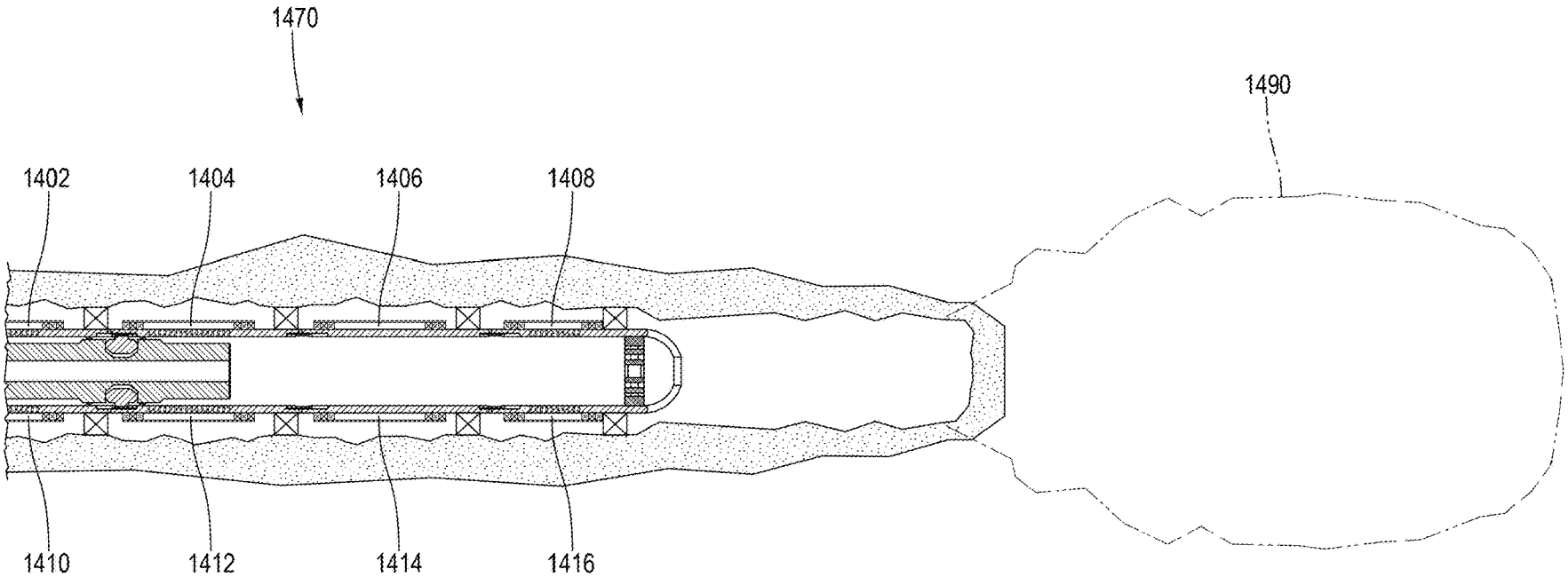
FIG. 14 is a cross sectional side view of using a toe of a wellbore for a variety of functions including storage of solids, pressure relief (sequential and sudden), etc., according to some embodiments.

FIG. 14 is a cross sectional side view of using a toe of a wellbore for a variety of functions including storage of solids, pressure relief (sequential and sudden), etc., according to some embodiments. In contrast to the other implementations depicted in FIGS. 3-11, FIG. 14 depicts a toe 1490 at the bottom of the bore 1470. The toe 1490 may provide one or more functions (such as storage of solids or fluids, pressure relief (sequential and sudden), etc. For example, the cleaning fluid and the solids being removed from the screens may be stored in the toe 1490.

FIG. 14 depicts a bore 1470 that may be part of a multi-bore well. A liner is positioned in the bore 1470 and includes a number of screens—screens 1402-1416. The screens 1402-1416 may be configured to receive formation fluid from the surrounding subsurface formation and into the liner for downhole separation and processing (as described herein). The screens 1402-1416 may be used to filter out solids from the formation fluid entering the liner. Some implementations may be used on the injection side of the DOWS system. Some implementations may be used on the producing side of the DOWS system (formation fluid enters the wellbore side).

The formation fluid passing through the screens 1402-1416 will include solids. Accordingly, the screens 1402-1416 may filter out at least some of the solids so that the solids do not pass through the screens 1402-1416. However, over time, these screens 1402-1416 may become clogged with the solid and need to be cleaned. Accordingly, a coiled tubing is positioned within the liner. The coiled tubing fluidly couples a pump (not shown in FIG. 14) and the screens 1402-1416. The pump may be positioned at the surface of the well and/or anywhere downhole. The pump may be configured to intermittently pump cleaning fluid 1452 (such as water) through the coiled tubing to clean one or more of the screens 1402-1408 positioned at a top portion of the bore 1470 and screens 1410-1416 positioned at a bottom portion of the bore 1470. In some implementations, such a conduit may also be jointed pipe, of another pipe, or combination pipe (eg coiled tubing & jointed pipe).

A controller (not shown) may control the cleaning of the screens 1402-1416. For example, the controller may control how and when the pump transmits the cleaning fluid downhole to clean the screens 1402-1416. As described above, the fluid may be a variety of fluids (cleaning, non-cleaning, a combination of cleaning/non-cleaning, etc.). The fluid may be from the surface. The fluid may be partially from the surface. The fluid may be partially/or in whole from one or more places including the seafloor, a lateral wellbore, one or more parts of the main bore, from one or more other formations, etc. The controller may be positioned at the surface of the well and/or anywhere downhole. Similar to the configuration of FIG. 3 (described above), the controller may initiate the operation of the pump to clean at least one screen using the cleaning fluid. For example, the screens 1402-1416 may be cleaned periodically and/or in response to the value of a parameter passing a threshold value.

Also, the controller and the pump of FIG. 14 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values of one or more parameters (such as flow rate of fluids, amount of solids, etc.).

Similar to the controller 382 of FIG. 3, the controller of FIG. 14 may initiate the operation of the pump to clean at least one screen using the cleaning fluid 1450 based on one or more parameters. For example, the controller of FIG. 14 may initiate the cleaning of the screens based on one parameter or a combination of parameters (as described above in reference to FIG. 3). The solids and the cleaning fluid (after being used for cleaning) may be disposed in the toe 1490 and/or transmitted uphole via an inner path or annular path of the tubing or a combination of both (as described above).

In some implementations, alternatively or in addition to cleaning the screens, other devices downhole may be cleaned. For example, one or more devices of the DOWSS system depicted in FIG. 2 may be cleaned.

Figure 15:
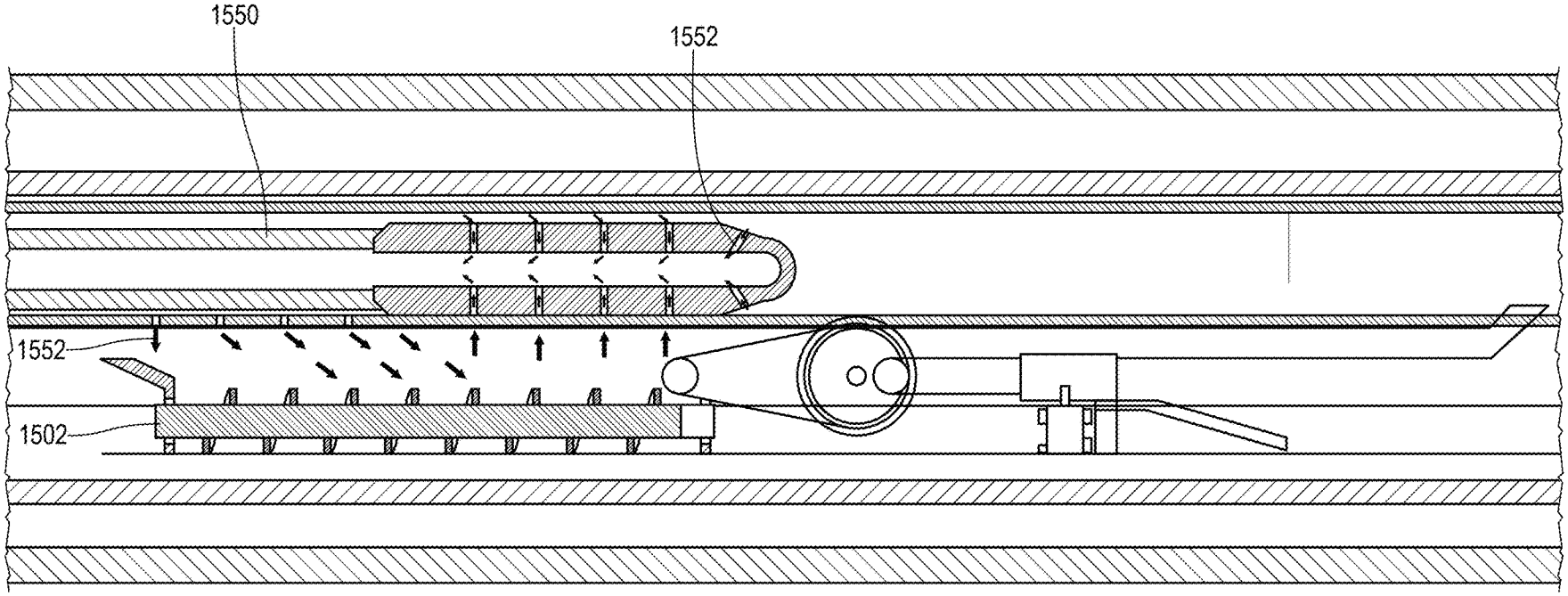
FIG. 15 is a cross sectional side view of an example of cleaning a downhole desander, according to some embodiments.

For example, FIG. 15 is a cross sectional side view of an example of cleaning a downhole desander, according to some embodiments. FIG. 15 depicts a cleaning desander 1502, which may be an example of the sediment separators 290A-290N described above in reference to FIG. 2 for separating the solids from the fluids. As shown, a coiled tubing 1550 may function similar to the coiled tubing 302 described above in reference to FIG. 3. The coiled tubing 1550 may fluidly couple a pump to the cleaning desander 1502. Accordingly, a cleaning fluid 1552 may flow through the coiled tubing 1550 to the cleaning desander 1502 (which may be a desander of any type) for removing and cleaning solids from the cleaning desander 1502 that may build up over time as the DOWSS (or DOWS) system operates to separate solids from the fluids downhole. Also, in some implementations, a centrifuge of any type, a fluid remover of any type, a degasser, etc. may be used. As described above, the coiled tubing 1550, the tool at the end of the coiled tubing 1550, or both in combination with other tools may be used to perform other processes or tasks than just cleaning. For example, one or more tools may be serviced, lubricated, repaired, one or more parts, assemblies may be replaced, etc. Also, the fluid may be for acidizing, paraffin removal, blockage removal, etc. (as described above).

A controller (not shown) may control the cleaning of the cleaning desander 1502. For example, the controller may control how and when the pump transmits the cleaning fluid 1552 downhole to clean the cleaning desander 1502. The controller may be positioned at the surface of the well and/or anywhere downhole. Similar to the configuration of FIG. 3 (described above), the controller may initiate the operation of the pump to clean using the cleaning fluid 1552. For example, the cleaning desander 1502 may be cleaned periodically and/or in response to the value of a parameter passing a threshold value.

Also, the controller and the pump of FIG. 15 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values or one or more parameters (such as flow rate of fluids, amount of solids, etc.).

Similar to the controller 382 of FIG. 3, the controller of FIG. 15 may initiate the operation of the pump to clean the cleaning desander 1502 using the cleaning fluid 1552 based on one or more parameters. For example, the controller of FIG. 15 may initiate the cleaning of the screens based on one parameter or a combination of parameters (as described above in reference to FIG. 3). In some implementations, the cleaning desander 1502 and the screens may be at a same time or independent of each other.

Figure 16:
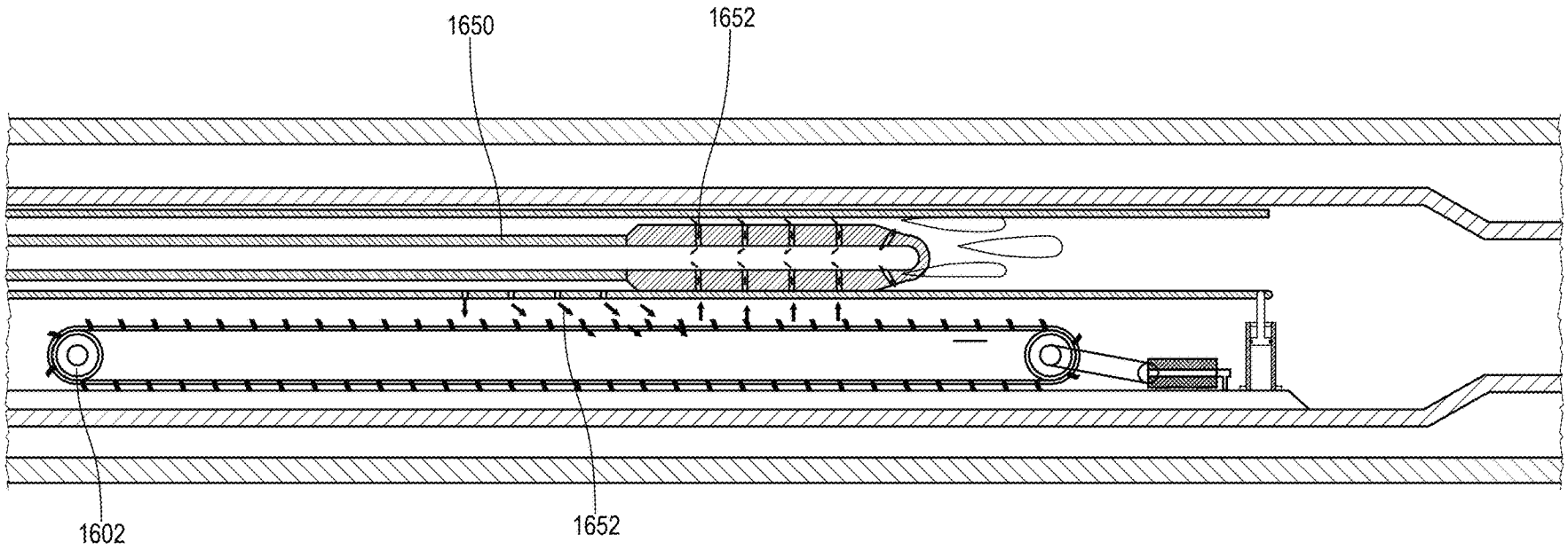
FIG. 16 is a cross sectional side view of an example of solid removal and cleaning of solid consolidation equipment, according to some embodiments.

FIG. 16 is a cross sectional side view of an example of solid removal and cleaning of solid consolidation equipment, according to some embodiments. FIG. 16 depicts a separator 1602, which may be an example of the sediment separators 290A-290N described above in reference to FIG. 2 for separating the solids from the fluids. As shown, a coiled tubing 1650 may function similar to the coiled tubing 302 described above in reference to FIG. 3. The coiled tubing 1650 may fluidly couple a pump to the separator 1602. Accordingly, a cleaning fluid 1652 may flow through the coiled tubing 1650 to the separator 1602 for removing and cleaning solids from the separator 1602 that may build up over time as the DOWSS system operates to separate solids from the fluids downhole. In some implementations, the separator 1602 may have ports, inlets, outlets, etc. to ensure the fluids may get to solids that may be hidden from direct line of site.

A controller (not shown) may control the cleaning of the separator 1602. For example, the controller may control how and when the pump transmits the cleaning fluid 1652 downhole to clean the separator 1602. The controller may be positioned at the surface of the well and/or anywhere downhole. Similar to the configuration of FIG. 3 (described above), the controller may initiate the operation of the pump to clean using the cleaning fluid 1652. For example, the separator 1602 may be cleaned periodically and/or in response to the value of a parameter passing a threshold value.

Also, the controller and the pump of FIG. 16 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values or one or more parameters (such as flow rate of fluids, amount of solids, etc.).

Similar to the controller 382 of FIG. 3, the controller of FIG. 16 may initiate the operation of the pump to clean the separator 1602 using the cleaning fluid 1652 based on one or more parameters. For example, the controller of FIG. 16 may initiate the cleaning of the screens based on one parameter or a combination of parameters (as described above in reference to FIG. 3). In some implementations, the separator 1602 and the screens may be at a same time or independent of each other.

Figure 17:
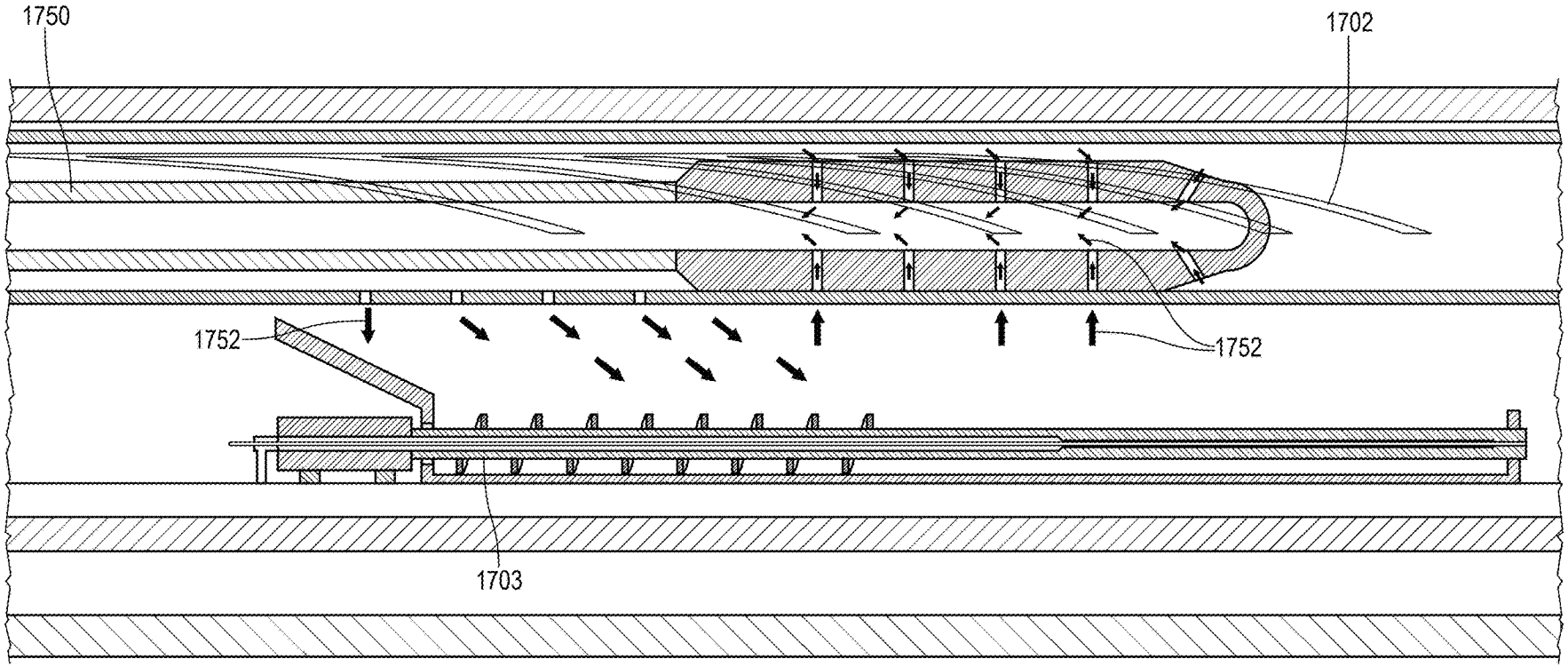
FIG. 17 is a cross sectional side view of an example cleaning of coalescing equipment, according to some embodiments.

FIG. 17 is a cross sectional side view of an example cleaning of coalescing equipment, according to some embodiments. FIG. 17 depicts a coalescer 1702, which may be used downhole for separation of fluids (including gases) and/or solids (as described above in reference to FIG. 2 for separating the fluids and/or the solids. As shown, a coiled tubing 1750 may function similar to the coiled tubing 302 described above in reference to FIG. 3. The coiled tubing 1750 may fluidly couple a pump to the area around the coalescer 1702. Accordingly, a cleaning fluid 1752 may flow through annulus of the coiled tubing 1750 to the coalescer 1702 for removing and cleaning solids from the coalescer 1702 that may build up over time as the DOWSS system operates to separate solids from the fluids downhole. Also, as shown, a separator 1703 may be cleaned (similar to cleaning the separator 1602 of FIG. 16 (described above).

A controller (not shown) may control the cleaning of the coalescer 1702. For example, the controller may control how and when the pump transmits the cleaning fluid 1752 downhole to clean the coalescer 1702. The controller may be positioned at the surface of the well and/or anywhere downhole. Similar to the configuration of FIG. 3 (described above), the controller may initiate the operation of the pump to clean using the cleaning fluid 1752. For example, the coalescer 1702 may be cleaned periodically and/or in response to the value of a parameter passing a threshold value. In some implementations, the coalescer 1702 may be flexible to allow the cleaning fluid 1150 (and other tools) to pass by the coalescer 1702 in either direction. In some implementations, the coalescer 1702 may move axially and radially.

Also, the controller and the pump of FIG. 17 may be configured and operate similar to the controller 382 and the pump 380 of FIG. 3 (as described above). For example, the pump may be at the surface or anywhere downhole. There also may be a pump at the surface and a different pump downhole. Additionally (similar to FIG. 3), there may be one or more sensors downhole and/or at the surface to detect values or one or more parameters (such as flow rate of fluids, amount of solids, etc.).

Similar to the controller 382 of FIG. 3, the controller of FIG. 17 may initiate the operation of the pump to clean the coalescer 1702 using the cleaning fluid 1752 based on one or more parameters. For example, the controller of FIG. 17 may initiate the cleaning of the screens based on one parameter or a combination of parameters (as described above in reference to FIG. 3). In some implementations, the coalescer 17d02 and the screens may be at a same time or independent of each other.

Example Operations

Figure 18:
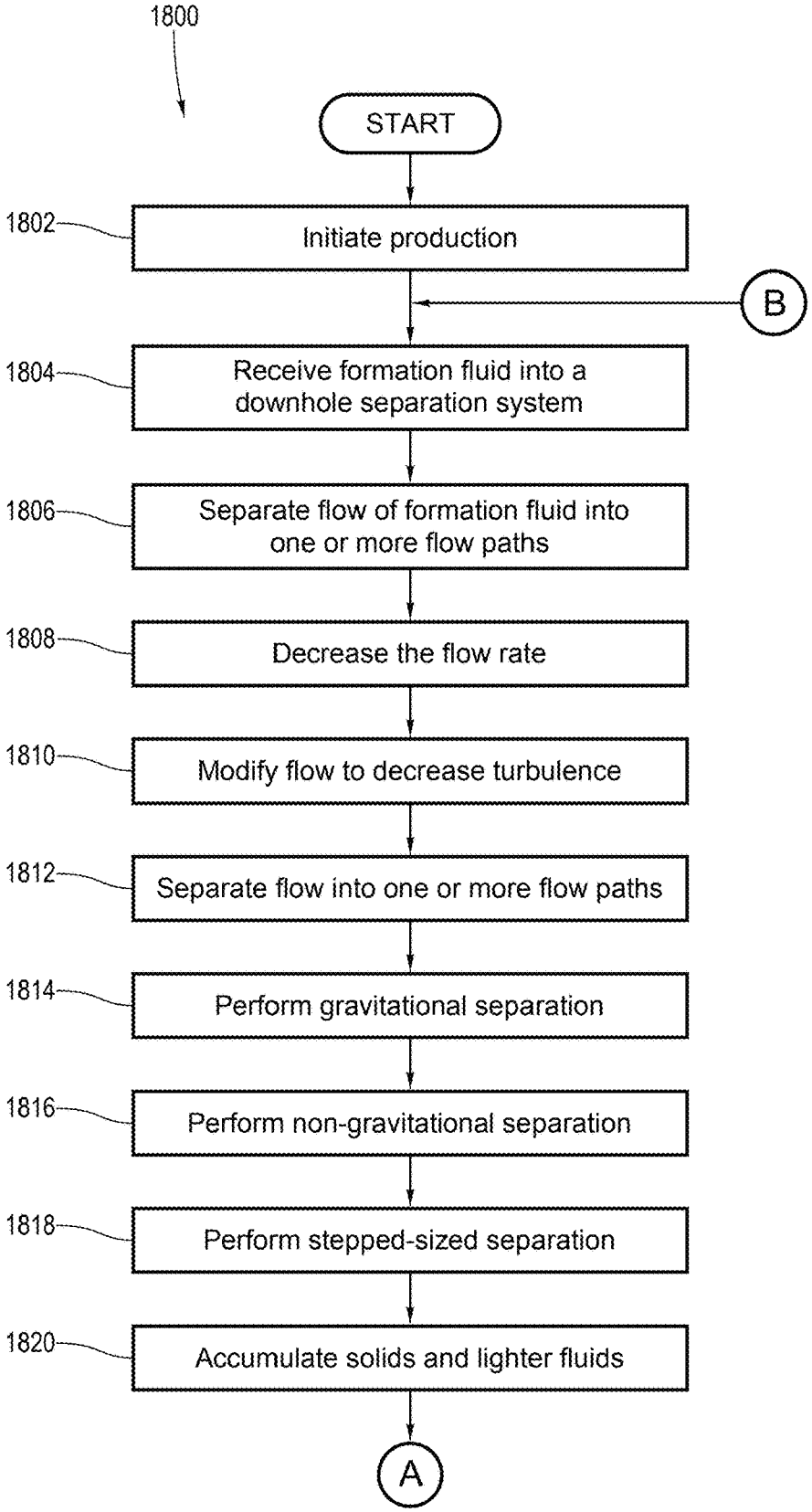
FIGS. 18-19 is a flowchart of example operations for downhole fluid and solid separation, according to some embodiments.
Figure 19:
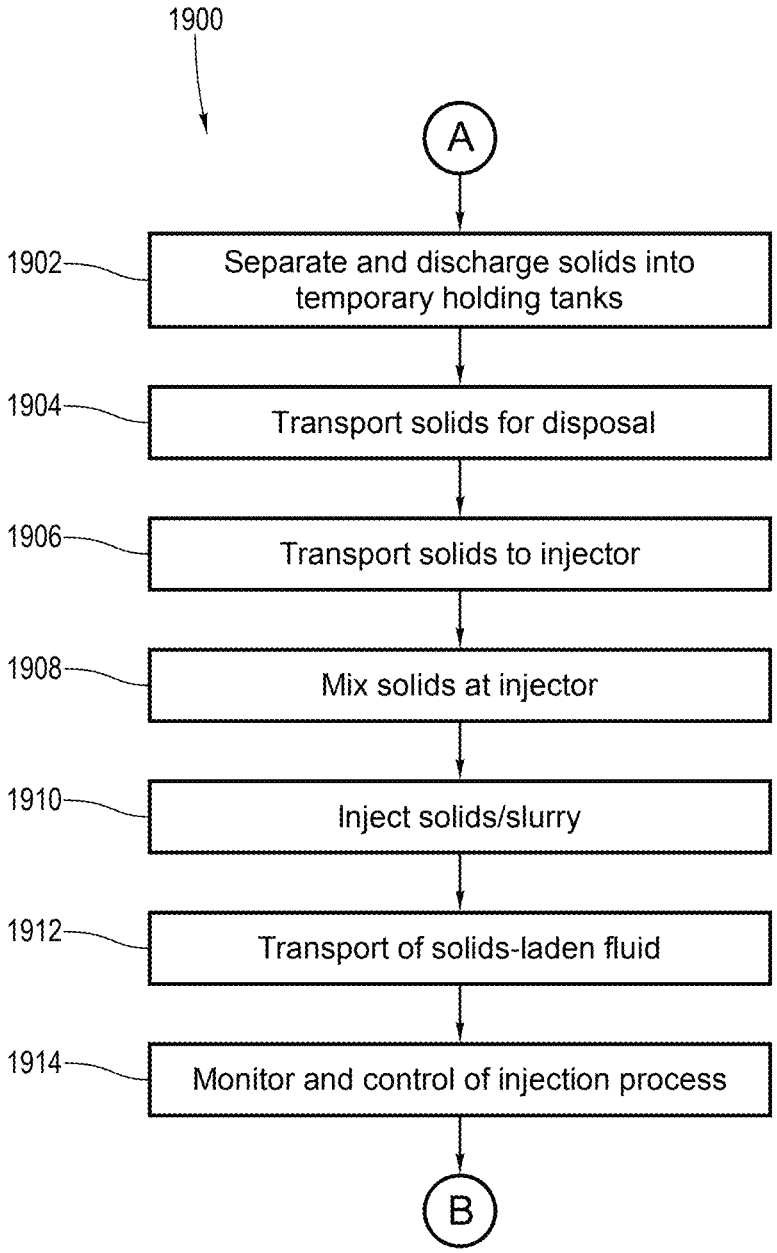

Example operations are now described. FIGS. 18-19 is a flowchart of example operations for downhole fluid and solid separation, according to some embodiments. Flowcharts 1800-1900 of FIGS. 18-19, respectively, are described in reference to FIGS. 1-2. However, other systems and components can be used to perform the operations now described. Operations of the flowcharts 1800-1900 continue between each other through transition points A and B. Operations of the flowchart 1800 start at block 1802.

At block 1802, production is initiated. For example, with reference to FIGS. 1-2, production may be initiated by the formation fluid 118 entering the main bore 102 and/or the lateral bore 104.

At block 1804, formation fluid is received into a downhole separation system. For example, with reference to FIGS. 1-2, the formation fluid 118 may be received into the separation system 124.

At block 1806, flow of formation fluid is separated into one or more flow paths. For example, with reference to FIGS. 1-2, the formation fluid 118 may flow into the fluid separator 296, wherein most or at least a majority of the production fluid 114 may separate into a flow above the separator 201, while most or at least a majority of the nonproduction fluid with sediment 294 may separate into a separate flow below the separator 201. Accordingly, if the formation fluid is at least partially segregated into oil-cut and water-cut, example implementations may take advantage of such a segregation to separate these fluids into two flow paths. Lower-density (oil-cut) fluids may flow through a top flow path. Higher-density (water-cut) may flow through a bottom flow path.

At block 1808, the flow rate is decreased. For example, with reference to FIG. 2, the formation fluid 118 moves from a smaller to a larger diameter of the tubing 287. This may decrease the velocity of the flow of the formation fluid 118—which allows the separation. In particular, most or at least a majority of the production fluid 114 may separate into a flow above the separator 201, while most or at least a majority of the nonproduction fluid with sediment 294 may separate into a separate flow below the separator 201. This allows most of the sediment to be captured in the lower portion of the tubing 287 (below the separator 201). Accordingly, example implementations may reduce flow from a high-turbulent flow to a slower, less turbulent flow. Example implementations may provide more flow area (an increased pipe inner diameter, increased wellbore size, multilateral wellbore for settling ponds, distributing flow, etc.). Example implementations may also provide more time (start and stop flow, slow pumping action, etc.)

At block 1810, flow is modified to decrease turbulence. For example, example implementations may also destabilize turbulence and reduce flow from a turbulent flow to a laminar flow (or transitional flow) by one or means (including those mentioned above).

At block 1812, flow is separated into one or more flow paths. For example, with reference to FIG. 2, the formation fluid 118 may be separated into one or more flow paths via the fluid separator 296. Such separation may be applicable to different flows (e.g., formation fluids, oil-cut, water-cut, gas, liquid, liquid-gas, slurries (solids-laden fluids, production fluids, fluids to be disposed, fluids to be injected, etc.).

At block 1814, gravitational separation is performed. For example, with reference to FIG. 2, the fluid separator 296 may comprise a gravity-based separation that includes the separator 201.

At block 1816, non-gravitational separation is performed. For example, with reference to FIG. 2, the formation fluid 118 may be separated using different types of non-gravitational operations.

At block 1818, stepped-sized separation is performed. For example, with reference to FIG. 2, the sediment separators 290A-290N may separate the sediment 294 from the non-production fluid 116. For example, the sediment separators 290A-290N may separate out the largest or densest solids first, then separate out the next largest or densest solids, etc. Example implementations may include allowing for settling and separation of solids to separate from fluid stream(s). Additionally, example implementations may allow time for the largest and/or densest solids to settle out from fluids. Example implementations may also allow lower flow rates to assist with the separation. Example implementations may use the sediment separators 290A-290N to allow the largest and/or densest solids to settle out, accumulate and be trapped. Example implementations may include allowing time for lighter fluids and gases to begin to segregate and separate from heavier fluids. Example implementations may include means, methods, and devices to subject one or more fluids to one or more force, acceleration, path (e.g., tortuous path, etc.), velocity, pressure, restriction (e.g., screen opening(s), screen size, nozzle, etc.), time, impulse, change in one or more of the above including step change, gradual change, etc. Example implementations may separate based on at least one of density, size, shape, surface tension, molecular makeup, other chemical, physical, molecular, electron properties, etc.

At block 1820, solids and lighter fluids are accumulated. For example, with reference to FIG. 2, the different sediment separators 290A-290N may accumulate the sediment.

Operations of the flowchart 1800 continue at transition point A, which continues at transition point A of FIG. 19. From transition point A of FIG. 19, operations continue at block 1902.

At block 1902, solids are separated and discharged into temporary holding tanks. For example, with reference to FIGS. 1-2, the different sediment separators 290A-290N may include temporary holding tanks for storing the separated out solids. Example implementations may include utilizing an auger, drag chain, an inclined plane, a jetting device, etc. to keep the solids or slurry from accumulating at the discharge end of the solid separation device which may cause the device to plug and become inoperable.

At block 1904, solids are transported for disposal. For example, with reference to FIG. 2, these different collections of the sediment by the different sediment separators 290 may be injected into a same or different line or tubing for disposal. As shown, the sediment injector(s) 299 are coupled to receive the sediment collected by the different sediment separators 290.

At block 1906, solids are transported to an injector. For example, with reference to FIGS. 1-2, the sediment may be transported to the sediment injectors 299.

At block 1908, solids may be mixed at the injector. For example, with reference to FIG. 2, the sediment 295 may be mixed at the sediment injector 299. For example, the sediment 295 may be mixed with fluid (such as production fluid, nonproduction fluid, etc.). In some implementations, one or more type of mixers may be used. For example, a mechanical mixer, a fluid-type mixer, etc. may be used to mix the sediment 295 with fluid. In some implementations, solids may be stored in or near the injector 299 so that mixing may progress smoothly or consistently at a defined rate. For example, the solids may be stored in an enclosed tank, gravity-fed tank, auger-fed tank, etc.

At block 1910, solids (or slurry) are injected. For example, with reference to FIGS. 1-2, the sediment injectors 299 may deliver the sediment to a different downhole location (such as a different lateral well, a thief zone (having a high porosity, high permeability downhole zone that may include a low pressure), etc.). In some implementations, sediment may be disposed to different locations depending on their size. For example, for sediment having a size greater than X, such solids may be delivered to the surface of the multilateral well for disposal. For sediment having a size less than X but greater than Y, such sediment may be disposed in a first downhole location (such as a thief zone). For the remaining sediment that have a size less than Y, such solids may be disposed in a second downhole location (such as a lateral well).

At block 1912, solids-laden fluid is transported. For example, with reference to FIGS. 1-2, the sediment injector (s) 299 may dispose of these sediments by injecting them into a tubing for delivery to the surface of the multilateral well. For example, the sediment may be delivered to the surface using the production tubing or a separate tubing. If the production tubing is used, the solids may be included with the production fluid that is being delivered to the surface. In such implementations, separation operations may be performed at the surface to separate out the solids from the production fluid 114. Accordingly, if sediment is being included with the production fluid 114 being delivered to the surface, the production fluid 114 may be delivered to surface equipment that provides for separation of the sediment. Alternatively, during the time when the sediment is not being included with the production fluid 114, the production fluid 114 may be delivered to different surface equipment that does not include such separation of sediment.

In some implementations, the sediment injectors 299 may inject the solids or slurry into a string or tubular (e.g., a production tubing). Timing of the injection may be coordinated with production of production fluid. For example, a pump may switch between pumping (in the production tubing) production fluid to the solid-laden fluid. Example implementations may include communications to the surface regarding the switching, the volume of the solids, fluids, slurry to be pumped, how much has been pumped, how much remains to be pumped, etc. Additionally, some implementations may enable communication from the surface to downhole to control and override the switching.

At block 1914, injection process is monitored and controlled. For example, with reference to FIGS. 1-2, controllers may be coupled to the sediment injectors 299 for monitoring and controlling the injection and disposal of the sediment (either to the surface of the multilateral wall or to a disposal location downhole).

Operations of the flowchart 1900 continue at transition point B, which continues at transition point B of FIG. 18. From transition point B of FIG. 18, operations return to operations at block 1804.

Figure 20:
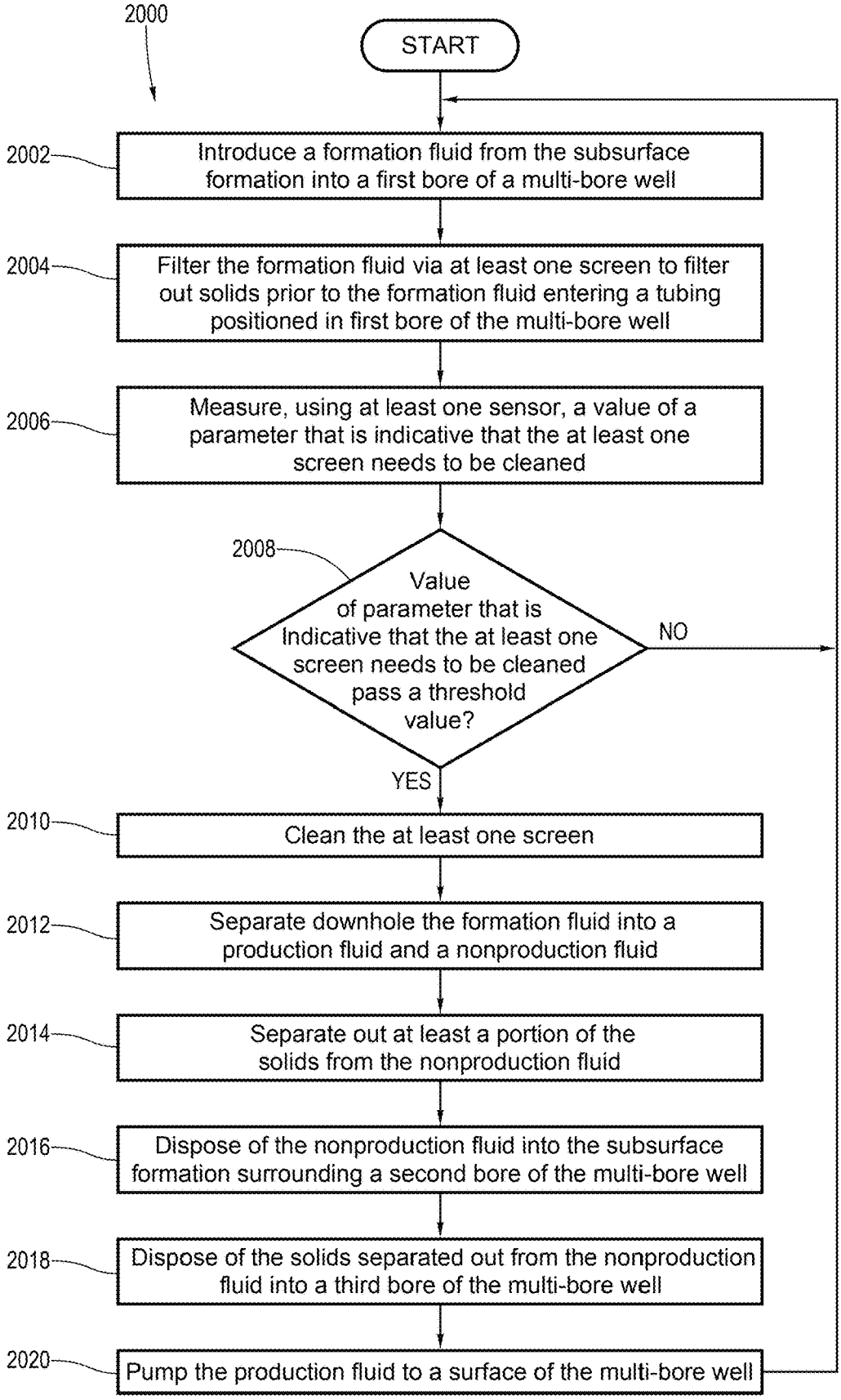
FIG. 20 is a flowchart of example operations for using and cleaning screens for filtering solids in a production fluid from a subsurface formation flowing into a liner of a well for downhole separation, according to some embodiments.

FIG. 20 is a flowchart of example operations for using and cleaning screens for filtering solids in a production fluid or nonproduction fluid flowing into a liner via screens, slots, perforations, etc. from a subsurface formation flowing into a liner of a well for downhole separation, according to some embodiments. A flowchart 2000 of FIG. 20 is described in reference to FIGS. 2-3. However, other systems and components can be used to perform the operations now described. Operations of the flowchart 2000 start at block 2002.

At block 2002, a formation fluid from the subsurface formation is introduced into a first bore of a multi-bore well. For example, with reference to FIG. 3, formation fluid from the subsurface formation surrounding the first bore 370 of the multi-bore well 374 is introduced into the first bore 370.

At block 2004, the formation fluid is filtered via at least one screen to filter out solids prior to the formation fluid entering a tubing positioned in first bore of the multi-bore well. For example, with reference to FIG. 3, the screens 302-316 filter out solids from the formation fluid prior to the formation fluid entering the liner 341. In some implementations, the formation fluid may be filtered via at least one screen to filter out solids prior to the formation fluid entering a tubing positioned in first bore of the multi-bore well. A liner may be defined to include a screen, slotted liner, perforated liner, casing, etc.

At block 2006, a value of a parameter that is indicative that the at least one screen needs to be cleaned is measured, using at least one sensor. For example, with reference to FIG. 3, at least one of the sensors 352-366 may measure a flow rate of the formation fluid passing through the screens 302-316. As described above, sensors may be positioned at other locations downhole and/or at the surface. Additionally, such sensors may measure the flow rate or other parameters (such as amount of solids)-that may be indicative that the screens 302-316 need to be cleaned.

At block 2008, a determination is made of whether the value of the parameter (that is indicative that the at least one screen needs to be cleaned is measured) passes a threshold value. For example, with reference to FIG. 3, the controller 382 may make this determination. In other examples, another controller (not shown) may make the determination. The other controller may be a controller that controls one or more of a DOWS system (e.g., separation system 124 and/or separation system 200 and/or a component thereof. As described above, this determination may be based on measurements from one or more sensors and/or based on different parameters. For example, this determination may be based on a flow rate of the formation fluid passing through the screens 302-316. In another example, this determination may be based on such a flow rate in combination with the level of solids being separated out by the DOWSS. Additionally, the threshold values for a same parameter may vary depending on the location of the sensor, the type of fluid or solid being monitored, etc. If the value of the parameter (that is indicative that the at least one screen needs to be cleaned is measured) does not pass a threshold value, operations of the flowchart 2000 returns to block 2002 (where the formation fluid from the subsurface formation continues to be introduced into the first bore of the multi-bore well). If the value of the parameter (that is indicative that the at least one screen needs to be cleaned is measured) does pass a threshold value, operations of the flowchart 2000 continue at block 2010. While described in reference to a screen, in some implementations, it may be perforated pipe, perforations, slotted liner, etc.

At block 2010, at least one screen is cleaned. For example, with reference to FIG. 3, the controller 382 may cause the pump 380 to pump the cleaning fluid 392 through the coiled tubing 350 to the screens 302-316.

At block 2012, the formation fluid is separated downhole into a production fluid and a nonproduction fluid. For example, with reference to FIG. 2, the formation fluid may be transported to the separation system 200 for separation, disposal, transporting, etc. (as described above). The formation fluid 118 may flow into the fluid separator 296, wherein most or at least a majority of the production fluid 114 may separate into a flow above the separator 201, while most or at least a majority of the nonproduction fluid with sediment 294 may separate into a separate flow below the separator 201. Accordingly, if the formation fluid is at least partially segregated into oil-cut and water-cut, example implementations may take advantage of such a segregation to separate these fluids into two flow paths. Lower-density (oil-cut) fluids may flow through a top flow path. Higher-density (water-cut) may flow through a bottom flow path. It should be noted that oil-cut may comprise oil, water, various hydrocarbons, gas, immiscible fluids, etc. (as described above).

At block 2014, at least a portion of the solids is separated out from the nonproduction fluid. For example, with reference to FIG. 2, the sediment separators 290A-290N may separate the sediment 294 from the nonproduction fluid 116. For example, the sediment separators 290A-290N may separate out the largest or densest solids first, then separate out the next largest or densest solids, etc. Example implementations may include allowing for settling and separation of solids to separate from fluid stream(s). Additionally, example implementations may allow time for the largest and/or densest solids to settle out from fluids. Example implementations may also allow lower flow rates to assist with the separation. Example implementations may use the sediment separators 290A-290N to allow the largest and/or densest solids to settle out, accumulate and be trapped. Example implementations may include allowing time for lighter fluids and gases to begin to segregate and separate from heavier fluids. Example implementations may include means, methods, and devices to subject one or more fluids to one or more force, acceleration, path (e.g., tortuous path, etc.), velocity, pressure, restriction (e.g., screen opening(s), screen size, nozzle, etc.), time, impulse, change in one or more of the above including step change, gradual change, etc. Example implementations may separate based on at least one of density, size, shape, surface tension, molecular makeup, other chemical, physical, molecular, electron properties, etc. In some implementations, the separators like 290A-290N may be used on the production fluid. In some implementations, the gas separators may be used in the nonproduction fluid and the production fluid. In some implementations, the gases may be separated out and then reinjected back into the production fluid.

At block 2016, the nonproduction fluid is disposed into the subsurface formation surrounding a second bore of the multi-bore well. For example, with reference to FIG. 2, a pump may transport the nonproduction fluid 116 to a second bore of the multi-bore well. The nonproduction fluid 116 may be disposed into the subsurface formation surrounding the second bore.

At block 2018, the solids separated out from the nonproduction fluid are disposed into a third bore of the multi-bore well. For example, with reference to FIG. 2, the sediment injectors 299 may deliver the sediment to a third bore of the multi-bore well. In some implementations, sediment may be disposed to different locations depending on their size. For example, for sediment having a size greater than X, such solids may be delivered to the surface of the multilateral well for disposal. For sediment having a size less than X but greater than Y, such sediment may be disposed in a first downhole location (such as a thief zone). For the remaining sediment that have a size less than Y, such solids may be disposed in the third bore of the multi-lateral well. In some implementations, the range of classification for cyclones may be 40 microns to 400 microns. Some applications may include a range as fine as five microns or as coarse as 1000 microns. Cyclones may be used in both primary and secondary grinding circuits as well as regrind circuits.

At block 2020, the production fluid is pumped to a surface of the multi-bore well. For example, with reference to FIG. 2, the upper pump 293 may pump the production fluid 114 to a surface of the multi-bore well. Operations of the flowchart 2000 returns to block 2002 (where the formation fluid from the subsurface formation continues to be introduced into the first bore of the multi-bore well).

Example Multilateral Wells

Example implementations may be performed in different Technology Advancement of Multilaterals (TAML) Level wells. In particular, multilateral wells are characterized according to definitions established in 1997 during a Technology Advancement of Multilaterals (TAML) Forum held in Aberdeen. These standards classify junctions as TAML Level 1, 2, 3, 4, 5, or 6 based on mechanical complexity, connectivity, and hydraulic isolation. The ascending order of these levels reflects increasing mechanical and pressure capability of the junction. Consequently, cost, complexity, and risk also generally increase at the higher TAML levels. However, other considerations of the well design also influence the overall complexity of the well-for example, a TAML Level 2 well with an advanced intelligent completion can be more complex and costly than a TAML Level 5 well with a simpler completion system.

In a TAML 1 well, the main bore, lateral, and junction are uncased. This basic lateral is designed to enhance reservoir drainage from consolidated formations. It has the advantage of low drilling and completion costs, but the open hole junction makes reentry into the lateral wellbore and control of flow from the lateral impossible.

Wells that have cased and cemented main bores and open hole laterals are designated TAML Level 2. A cemented main bore significantly reduces the risk of wellbore collapse and provides isolation between laterals. By placing sliding sleeves and packers in the main bore, operators can produce the bores singly or in commingle production.

Placing a liner in the lateral and mechanically connecting it to the cased and cemented main bore results in a TAML Level 3 well. A liner is a string of casing that does not extend to the surface but is anchored or suspended inside a previously run casing string. This TAML Level 3 well includes a lateral that is cased but not cemented at the junction. It is a relatively low-cost option that includes reentry capabilities and a lateral that is better supported than that of Levels 1 and 2. Using sliding sleeves and packer plugs, operators can produce the bores singly or in commingle production. A TAML Level 3 junction does not provide hydraulic isolation, and its use is restricted to consolidated formations.

TAML Level 4 junctions are applicable in both consolidated and unconsolidated formations because both the lateral and the main bore are cased and cemented at the junction. The junction provides full bore access to the lateral, and mechanical support is supplied by the tubulars and cement. However, because the cement can only withstand limited differential pressure, the junction does not provide hydraulic isolation.

TAML Level 5 wells do provide hydraulic isolation at the junction because pressure integrity is provided by the completion, which includes production tubing connecting a packer in the main wellbore above the junction and a packer in the lateral wellbore. Because hydraulic isolation and support are provided by the completion hardware, the junction may be a TAML Level 2, 3, or 4 before the Level 5 completion is installed. TAML Level 6 wells also provide hydraulic isolation at the junction. A well at this level differs from a TAML Level 5 well in that pressure integrity is provided by the main wellbore casing and a cemented or uncemented liner in the lateral. The cost and complexity of creating a single-metal-element dual-bore casing junction downhole has prevented TAML Level 6 wells from being developed. As of today, the category exists as a result of early experiments. Because multilateral wells that have higher TAML designations are generally more complex, they are more costly, and their configurations are more flexible. As they do with multilateral geometry, engineers choose a TAML level junction based primarily on reservoir characteristics, costs, and function.

The ability to reenter the lateral for well intervention operations is another multilateral well design consideration. Because it is a directionally drilled section that has no junction, the lower lateral is almost always easily accessed using standard intervention methods. Operators must make an economics-based decision during the well planning stage to include junctions that allow lateral access after pulling the upper completion, through-tubing access, junctions that can be adopted to allow access after installation or junctions through which no access is possible to main bore, lateral, or both. If the well includes more than one lateral, a selective through-tubing access system would need to be considered. The decision to deploy lateral junctions that allow full bore or restricted access is a function of the overall well design. Engineers usually opt for full bore access if a packer is to be placed below the junction or if an artificial lift system must be located near the lower lateral. In addition, based on their knowledge of the reservoir, operators may require full bore access to perform perforating, stimulation, logging, water shutoff, gravel packing, cleanout, and other remedial operations. Full bore access can be adapted to all TAML level junctions but must be specified before installation; some commercially available junctions allow no access or only restricted access to either the lateral or the main bore and cannot be adapted after installation.

The decision to use a multilateral well system and what type to use are the result of cost benefit analyses. In general, the less-complex junctions present operators with lower risks and costs. But risk mitigation and cost savings must be balanced against individual well and field development expectations. In low-value reservoirs, a simple open hole lateral that has no reentry capability may increase ultimate reserve recovery or accelerate production while having little impact on overall drilling and completion costs. In high-value deepwater plays, installing a hydraulically sealed TAML Level 5 or 6 junction can drive total well costs into millions of dollars and still be a good investment because it may save drilling another well with a complex and tortuous trajectory, preserve a well slot on an existing production platform, or eliminate the need entirely to procure and install additional subsea infrastructure.

In embodiments, a multilateral well is drilled and completed with a TAML Level 4 junction. The junction includes a pump and a fluid separator. The pump includes any pump capable of drawing in fluid through the pump intake, pressurizing it, and lifting it to the surface such as an electrical submersible pump, sucker-rod and pump jack, progressive cavity pump, gas lift and intermittent gas lift, reciprocating and jet hydraulic pumping systems, etc. The fluid separator and the pump can be above, at, or below the junction. The upper completion includes a retrievable electrical submersible pump packer while the lower completion has an orientation liner hanger or other orientation device.

While the aspects of the disclosure are described with reference to various implementations and exploitations, it will be understood that these aspects are illustrative and that the scope of the claims is not limited to them. Many variations, modifications, additions, and improvements are possible. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

In some implementations, a mechanical junction (not to be confused with the earthen junction of 2 earthen wellbores) may comprise a junction with a monolithic Y-Block. In some implementations, a monolithic Y-Block may provide for more robust connections to the other components of a junction assembly (i.e. main bore leg, lateral leg, tank, etc.).

Figure 21:
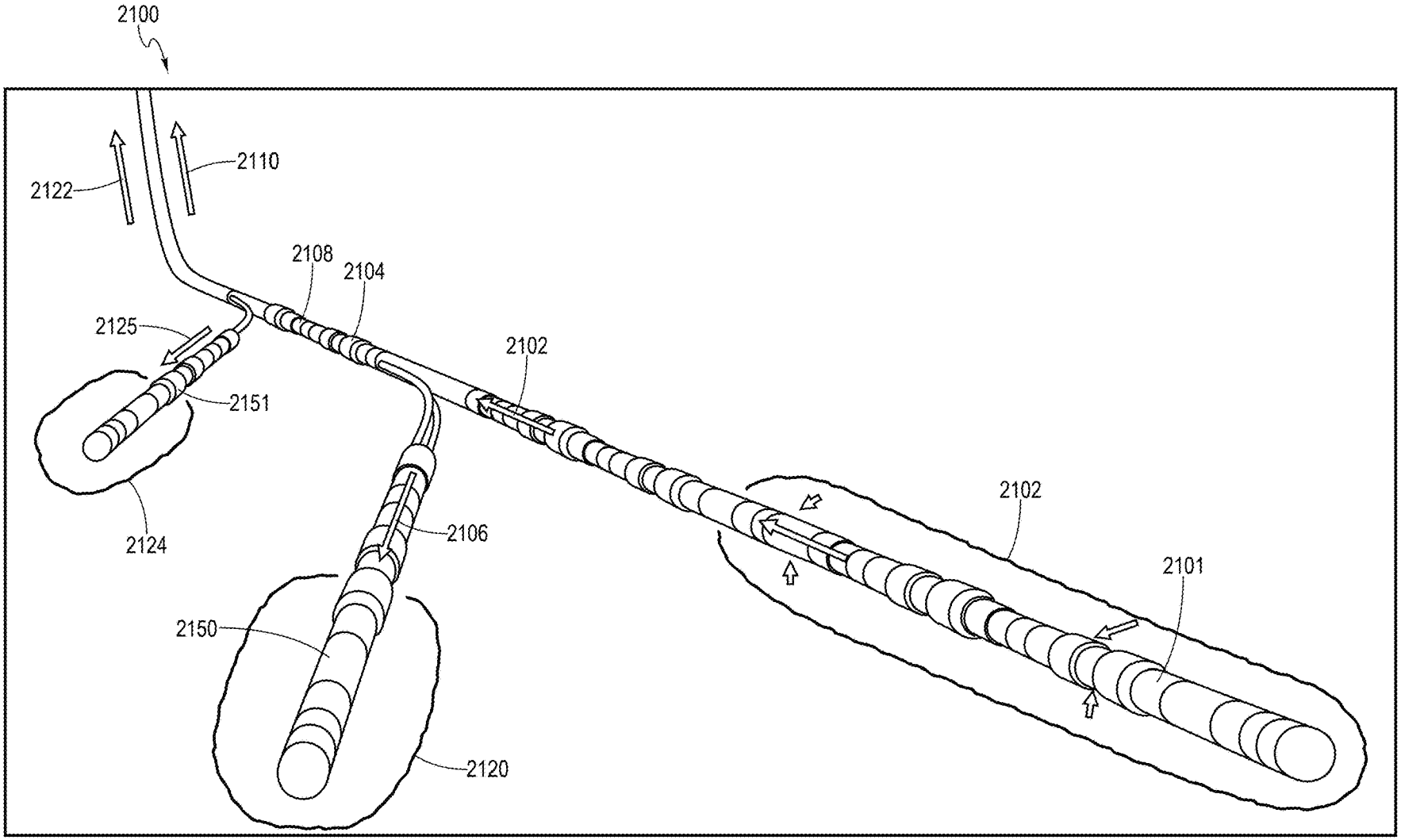
FIG. 21 is a perspective view of an example of a Level 5 (mechanical) junction assembly for use with a downhole oil, water and solids separator system (Downhole Oil Water Solids Separation), according to some embodiments.

To illustrate, FIG. 21 is a perspective view of an example of a Level 5 (mechanical) junction assembly for use with a downhole oil, water and solids separator system, according to some embodiments. FIG. 21 depicts a system 2100 having a multilateral well that includes a main bore 2101, a lateral bore 2150, and a lateral bore 2151. Formation fluid 2102 from the surrounding subsurface formation enters the main bore 2101. The formation fluid 2102 is transported through the main bore 2101 uphole to a level 5 monolithic Y-block 2104 and into a DOWSS 2108.

The DOWSS 2108 may process the formation fluid 2102 to separate out nonproduction fluid 2106 from production fluid 2122. The DOWSS 2108 may also process the formation fluid 2102 to separate sediment from at least one of the nonproduction fluid 2106 or the production fluid 2122. The DOWSS 2108 may transport the nonproduction fluid 2106 into the lateral bore 2150 for disposal in a disposal zone 2120 for the nonproduction fluid 2106 in the subsurface formation around the lateral bore 2150. The DOWSS 2108 may also transport sediment 2125 into the lateral bore 2151 for disposal in a disposal zone 2124 for the sediment 2125 in the subsurface formation around the lateral bore 2151. The DOWSS 2108 may also transport the production fluid 2122 and sediment 2110 to a surface of the multilateral well. Accordingly, in this example, the sediment may be disposed downhole into a highly permeable zone downhole and/or may be transported to the surface of the multilateral well.

Figure 22:
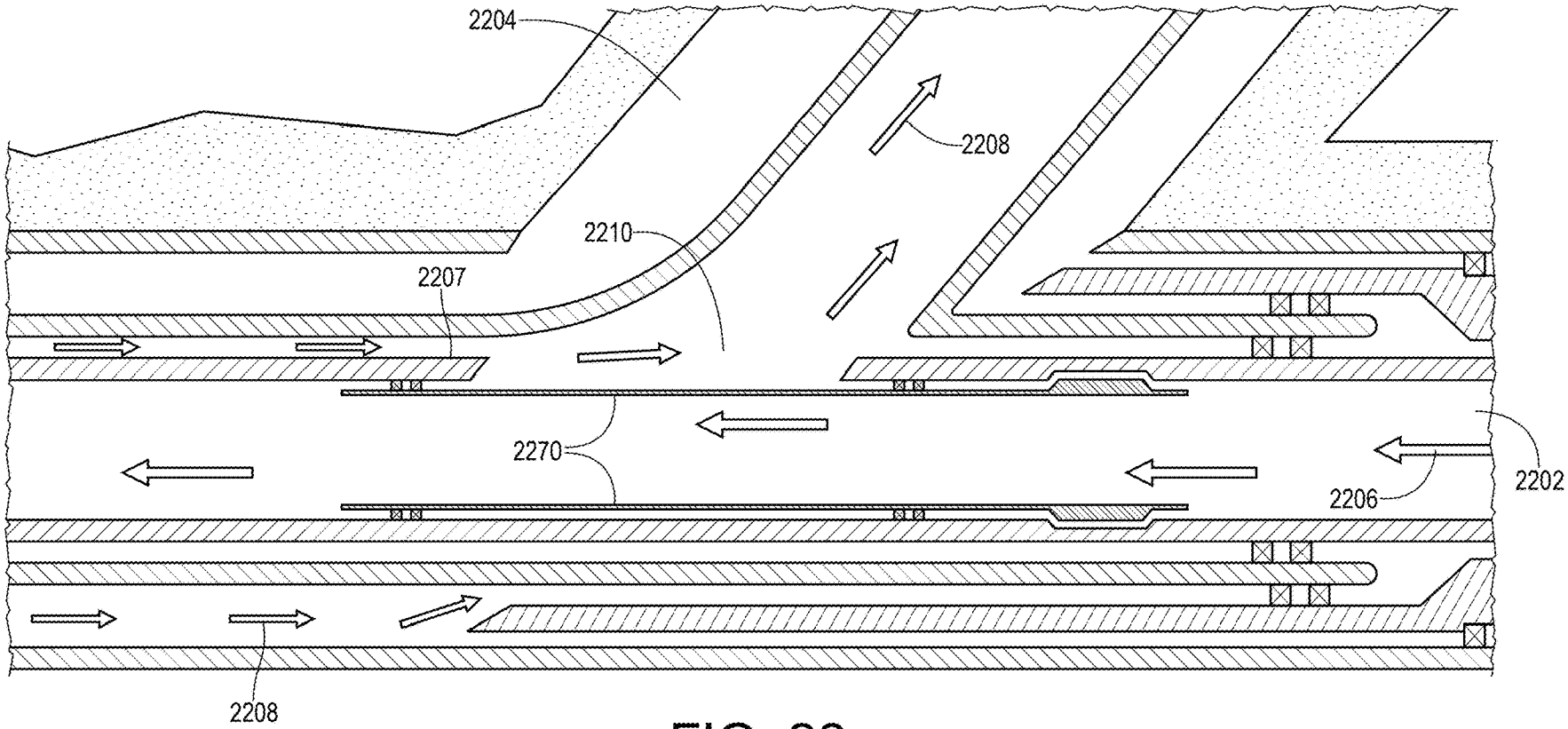
FIG. 22 is a cross-sectional view of an example of a Level 5 junction assembly for use with a downhole oil, water and solids separator system, according to some embodiments.

FIG. 22 is a cross-sectional view of an example of a Level 5 junction assembly for use with a downhole oil, water and solids separator system, according to some embodiments. In this embodiment, a main bore junction 2210 is used to provide a main bore 2202 for large tools to be passed through, or landed, in the y-block and/or main bore area of the junction 2210. A lateral bore 2204 is formed off the main bore 2202 at the junction 2210. In the example shown, an isolation sleeve 2270 may be landed in the junction. As shown, the isolation sleeve 2270 may provide pressure isolation between the formation fluids 2206 and the nonproduction fluids 2208. This main bore junction 2210 may be used with a variety of different Downhole Oil Water Separator Systems (DOWSS) and/or components including the DOWSS and/or its components disclosed within herein. The main bore junction 2210 may have a main bore leg inside diameter (ID) of 30% the outer diameter (OD) of the Junction's Y-Block. The main bore leg's ID may be 40% the OD of the Junction's Y-Block. The main bore leg's ID may be 50%, 53%, 55%, 60%, 67% or more of the Junction's Y-Block OD.

Figure 23A:
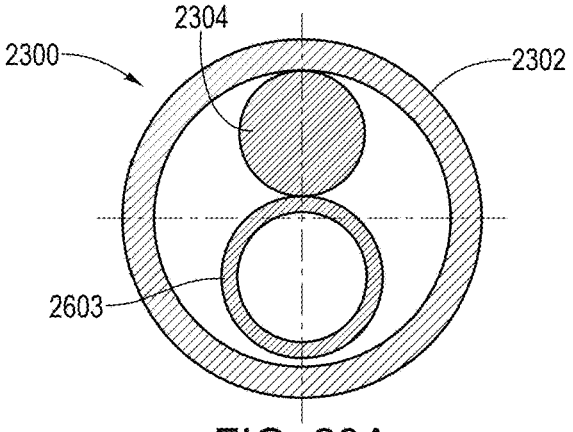
FIGS. 23A-23C are cross-sectional views of an example DOWSS positioned in a casing, according to some implementations.
Figure 23B:
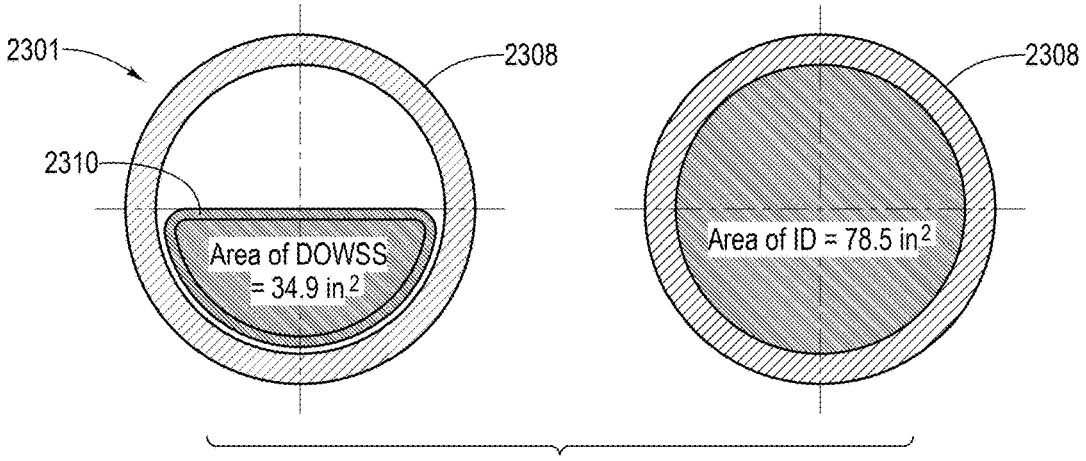
Figure 23C:
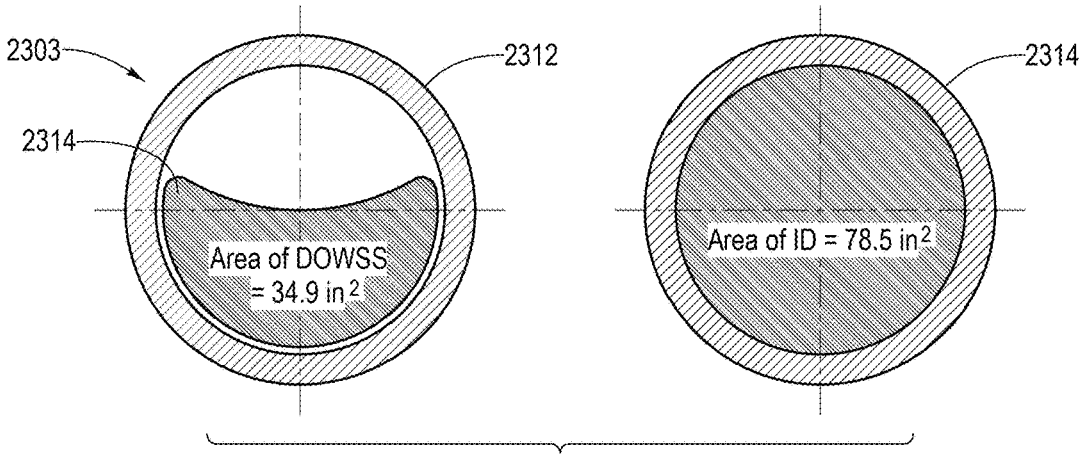

To help illustrate, FIGS. 23A-23C are cross-sectional views of an example DOWSS positioned in a casing, according to some implementations. FIG. 23A includes a DOWSS cross section view 2300 of a DOWSS 2306 in the inner bore of a casing 2302. As shown, the DOWSS 2306 and/or related equipment occupies approximately 55% of the inner diameter of the casing 2302. Accordingly, the remaining diameter may allow for a tool 2304 or to pass by the DOWSS. FIG. 23B includes a DOWSS cross section view 2301 of a DOWSS 2310 in the inner bore of a casing 2308. As shown in this implementation, the inner bore of the casing 2308 is approximately 78.5 square inches and the DOWSS 2310 occupies about 34.9 square inches, or approximately 44% of the flow area. Thus, the remaining area may remain open for tools to pass by the DOWSS 2310 for cleaning, servicing, parts replacement, etc. on the DOWSS 2310, related equipment, or other equipment/areas past the DOWSS 2310 in a well. The DOWSS 2310 may occupy any suitable space of the inner bore of the casing 2308. FIG. 23C includes a DOWSS cross section view 2303 of a DOWSS 2314 in the inner bore of a casing 2312. Similarly to FIG. 23B, the inner bore of the casing 2312 is approximately 78.5 square inches and the DOWSS 2314 occupies about 34.9 square inches, or approximately 44% of the flow area. Thus, the remaining area may remain open for tools to pass by the DOWSS 2314 for cleaning, servicing, parts replacement, etc. on the DOWSS 2314, related equipment, or other equipment/areas past the DOWSS 2314 in a well. In some implementations, the outer profile of the DOWSS 2314 may be shaped to provide functions such as support tools that pass over the DOWSS 2314, provide a sealing surface for service tools to seal against, provide features for the service tools to attach themselves to (such as to replace components, flush debris, lubricate one or more components, etc.), etc.

Figure 24:
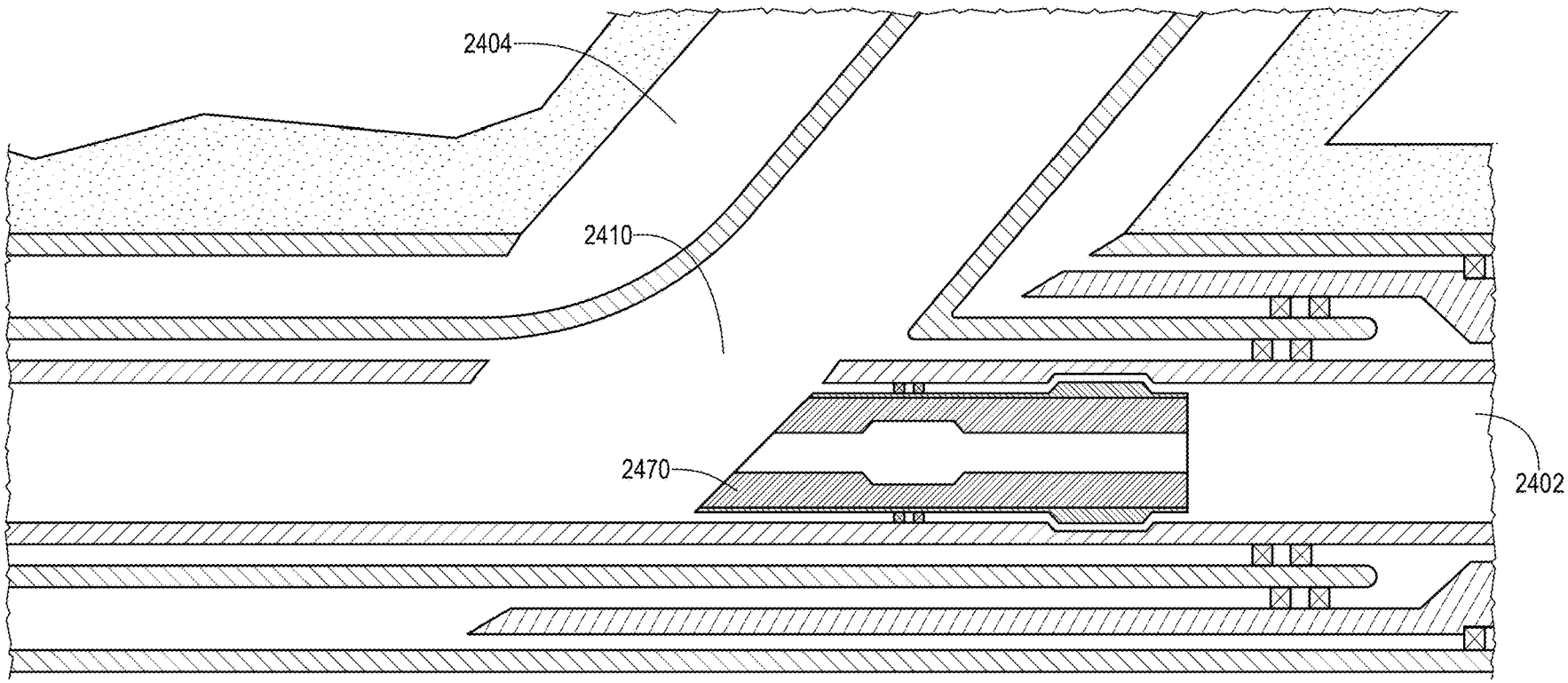
FIG. 24 is a cross-sectional view of an embodiment where the isolation sleeve can be shifted out of the way (or retrieved) and a deflection device installed to aid in deflecting one or more tools or devices out into a lateral bore, according to some embodiments.

FIG. 24 is a cross-sectional view of an embodiment where the isolation sleeve can be shifted out of the way (or retrieved) and a deflection device installed to aid in deflecting one or more tools or devices out into a lateral bore, according to some embodiments. FIG. 24 depicts a main bore 2402 and a lateral bore 2404 that is formed off the main bore 2402 at the junction 2410. An isolation sleeve 2470 may be shifted out of the way (or retrieved) to allow for a deflection device to be installed to aid in deflecting one or more tools or devices out into the lateral bore 2404.

Figure 25:
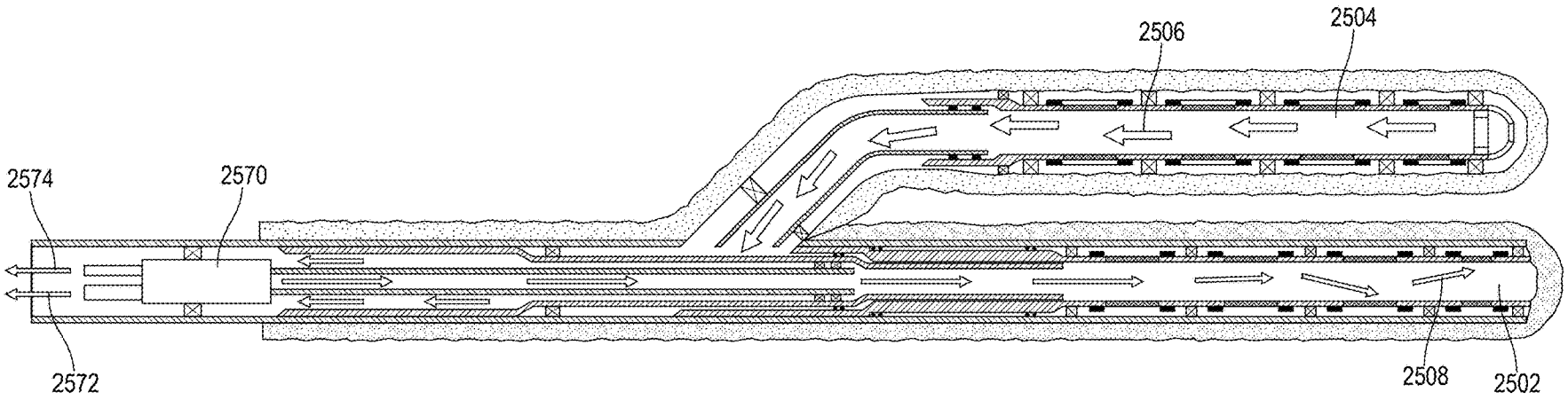
FIG. 25 is a cross-sectional view of a multilateral tool embodiment of one or more DOWSS embodiments with a non-Level 5 junction, according to some embodiments.

FIG. 25 is a cross-sectional view of a multilateral tool embodiment of one or more DOWSS embodiments with a non-Level 5 junction, according to some embodiments. In this example, the multilateral well is producing from a lateral bore 2504 (instead of the main bore 2502) so the earthen junction isn't over-pressure by fluid being injected in its surroundings. Formation fluid 2506 is being produced from a subsurface formation surrounding the lateral bore 2504. A DOWSS 2570 may receive the formation fluid 2506 and separate the formation fluid 2506 into a nonproduction fluid 2508, a sediment 2572, and a production fluid 2574. As shown, the nonproduction fluid 2508 may be disposed of downhole by being transported into the main bore 2502 for disposal in the surrounding subsurface formation. The sediment 2572 may be disposed of downhole and/or transported to the surface of the multilateral well. The production fluid 2574 may be transported to the surface of the multilateral well.

The above examples of junctions are provided as non-limiting examples—as other type of junctions may be used.

The placement of the DOWSS, the DOWSS components, the tubing/fluid paths are also non-limiting examples—as other placements, components, paths may be used. The terms "downhole" and "below" may or may not be considered equivalent depending on the type of wellbore. For example, "downhole" and "below" may be considered the same for vertical wellbores. However, "downhole" and "below" may be considered different for horizontal wellbores.

Example Subsea DOWSS (Downhole Oil Water Solids Separation)

Example implementations may include Subsea Oil Water Solids Separation (SOWSS). Example implementations may include disposal of solids, storage of water, and oil maybe subsea—on the seafloor or in storage wells or in storage vessels embedded in the seafloor.

Figure 26:
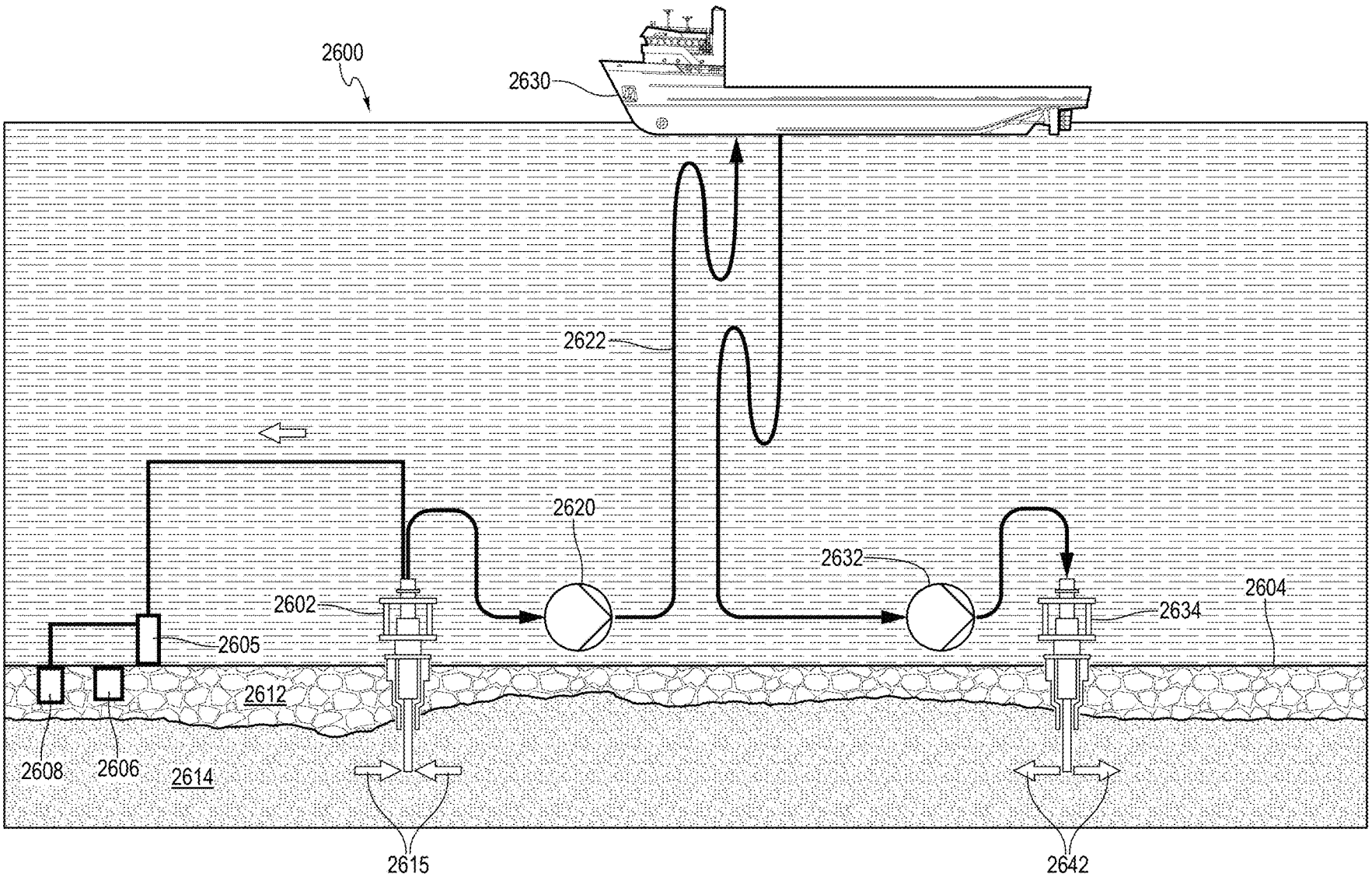
FIG. 26 is a perspective view of a first example subsea DOWSS, according to some embodiments.

FIG. 26 is a perspective view of a first example subsea DOWSS, according to some embodiments. FIG. 26 includes a subsea DOWSS 2600 that includes a subsea production well 2602 formed in a subsea surface 2604. The subsea production well 2602 may be formed through rock 2612 and a reservoir 2614. As described herein, production fluid (such as hydrocarbons 2615) and possibly nonproduction fluid, sediment, etc. may be transported from downhole to a surface of the subsea production well 2602.

In some implementations, this fluid transported to the surface of the subsea production well 2602 may be transported to a ship 2630 via a multiphase pump 2620 and risers 2622. The ship 2630 may include equipment to separate out nonproduction fluid (such as water) from the production fluid. The ship 2630 may also include storage for the production fluid. As shown, the nonproduction fluid (such as water) separated out from the production fluid by equipment of the ship 2630 may be transported down below to a subsea injection well 2634 via a water injection pump 2632. The water 2642 may be pumped downhole into the subsea injection well 2634. As shown, the water 2642 may be returned for storage in the reservoir 2614.

In some implementations, at least some of the fluid transmitted to the surface of the subsea production well 2602 may remain below (instead of being transported to the ship 2630). For example, after being transported to the surface, the fluid may be transported to a location 2605 at the subsea surface 2604 for processing, separating, pumping, etc. Then, the nonproduction fluid (separated out from this fluid) may be stored below the subsea surface 2604 at a location 2608. Additionally, the production fluid (separated out from this fluid) may be stored below the subsea surface 2604 at a location 2606. In some implementations (even though not shown), sediment (solids) separated out from this fluid may be stored at or under the subsea surface 2604.

Accordingly, fluid from the subsea production well 2602 may be pumped to subsea surface 2604 for processing, temporary storage, transport, water injection to maintain reservoir pressure, water flood from the subsea injection well 2634 to push hydrocarbons to the subsea production well 2602 and/or disposal.

In some embodiments, the solids may be flowed to the sea floor and then injected into a disposal well (or other designated well). In some embodiments, the solids, non-commercial fluids, a combination of both, etc. may be produced, separated, processed, stored and then injected into the disposal well (or other designated well).

Figure 27:
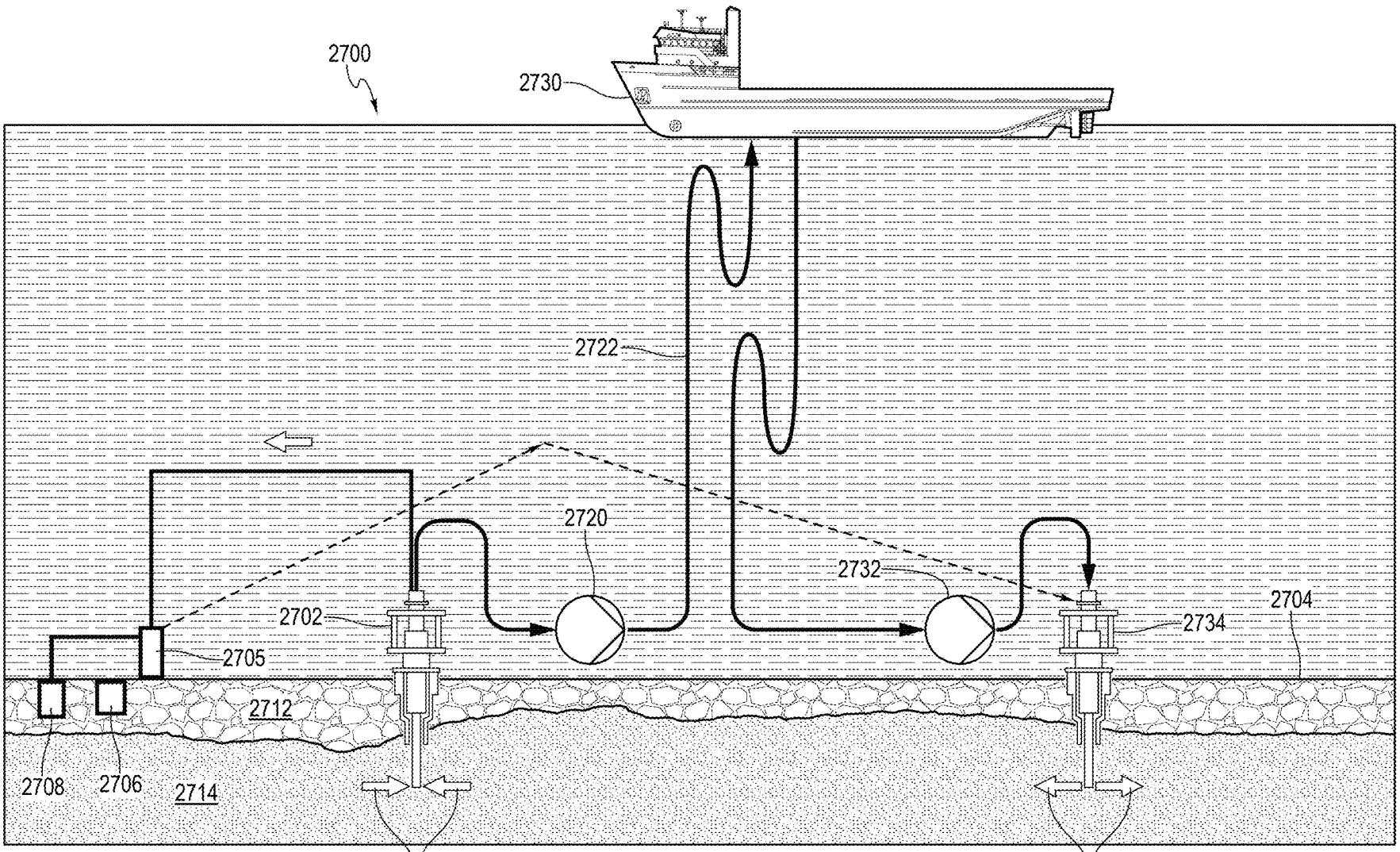
FIG. 27 is a perspective view of a second example subsea DOWSS, according to some embodiments.

To illustrate, FIG. 27 is a perspective view of a second example subsea DOWSS, according to some embodiments. Offshore drilling rigs (on occasion) inject used drilling mud into a disposal well. FIG. 27 includes a subsea DOWSS 2700 that includes a subsea disposal well 2734 used for injection of used drilling mud (solids (drill cuttings) 2742). The subsea DOWSS 2700 also includes a subsea production well 2702. As shown, the subsea disposal well 2734 and the subsea production well 2702 may be formed in a subsea surface 2704. The subsea disposal well 2734 and the subsea production well 2702 may be formed through rock 2712 and a reservoir 2714. As described herein, production fluid (such as hydrocarbons 2715) and possibly nonproduction fluid, sediment, etc. may be transported from downhole to a surface of the subsea production well 2702.

In some implementations, this fluid transported to the surface of the subsea production well 2702 may be transported to a ship 2730 via a multiphase pump 2720 and risers 2722. The ship 2730 may include equipment to separate out nonproduction fluid (such as water) from the production fluid. The ship 2730 may also include storage for the production fluid. As shown, the solids (drill cuttings) separated out from the production fluid by equipment of the ship 2730 may be transported down below to the subsea injection well 2734 via a pump 2732. The solids (drill cuttings) 2742 may be pumped downhole into the subsea disposal well 2734 for storage in the reservoir 2714.

In some implementations, at least some of the fluid transmitted to the surface of the subsea production well 2702 may remain below (instead of being transported to the ship 2730). For example, after being transported to the surface, the fluid may be transported to a location 2705 at the subsea surface 2704 for processing, separating, pumping, etc. Then, the nonproduction fluid (separated out from this fluid) may be stored below the subsea surface 2704 at a location 2708. Additionally, the production fluid (separated out from this fluid) may be stored below the subsea surface 2704 at a location 2706. The solids (drill cuttings) separated out from this fluid may be stored downhole in the subsea disposal well 2734.

Figure 28:
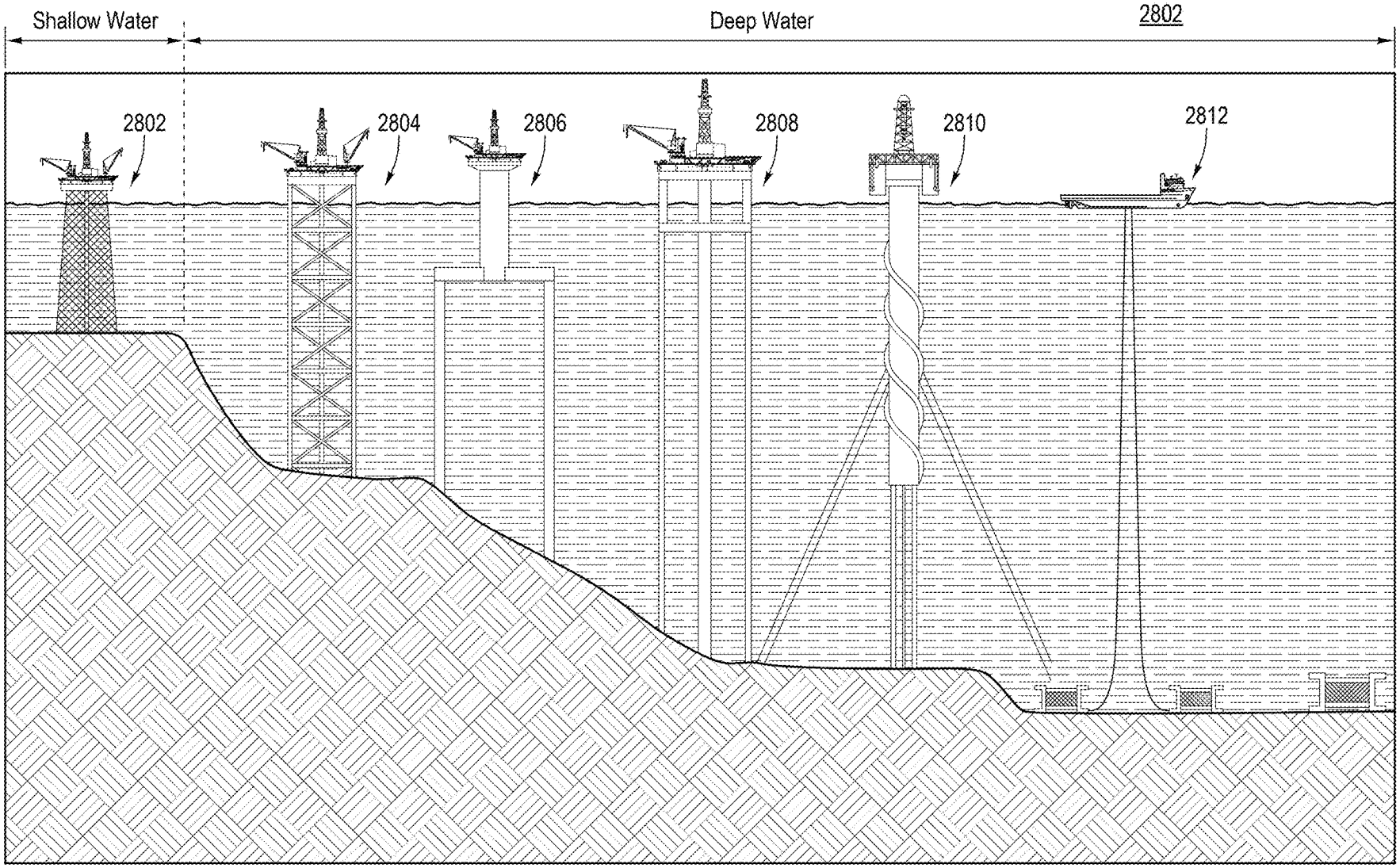
FIG. 28 is a perspective view of types of offshore wells that may benefit from example implementations, according to some embodiments.

FIG. 28 is a perspective view of types of offshore well that may benefit from example implementations, according to some embodiments. The lifting cost of producing formation water from 3000 meters (m) is very costly. The cost of lifting solids in a high-velocity rate is extremely erosive and costly. Separating out the solids and then lifting them at a slower rate will decrease the amount erosion. FIG. 28 depicts a number of offshore wells at different depths. In particular, FIG. 28 depicts a fixed platform well 2802 (that may be used up to 200 m), a compliant piled tower well 2804 (that may be used between 200-500 m), a tension leg platform (TLP) well 2806 (that may be used between 300-1500 m), a semi floating production system (FPS) well 2808 (that may be used between 300-2000 m), a single point anchor reservoir (SPAR) platform well 2810 (that may be used between 300-2000 m), and a floating production systems-FPSO and subsea well 2812 (that may be used up to 3000 m).

Figure 29:
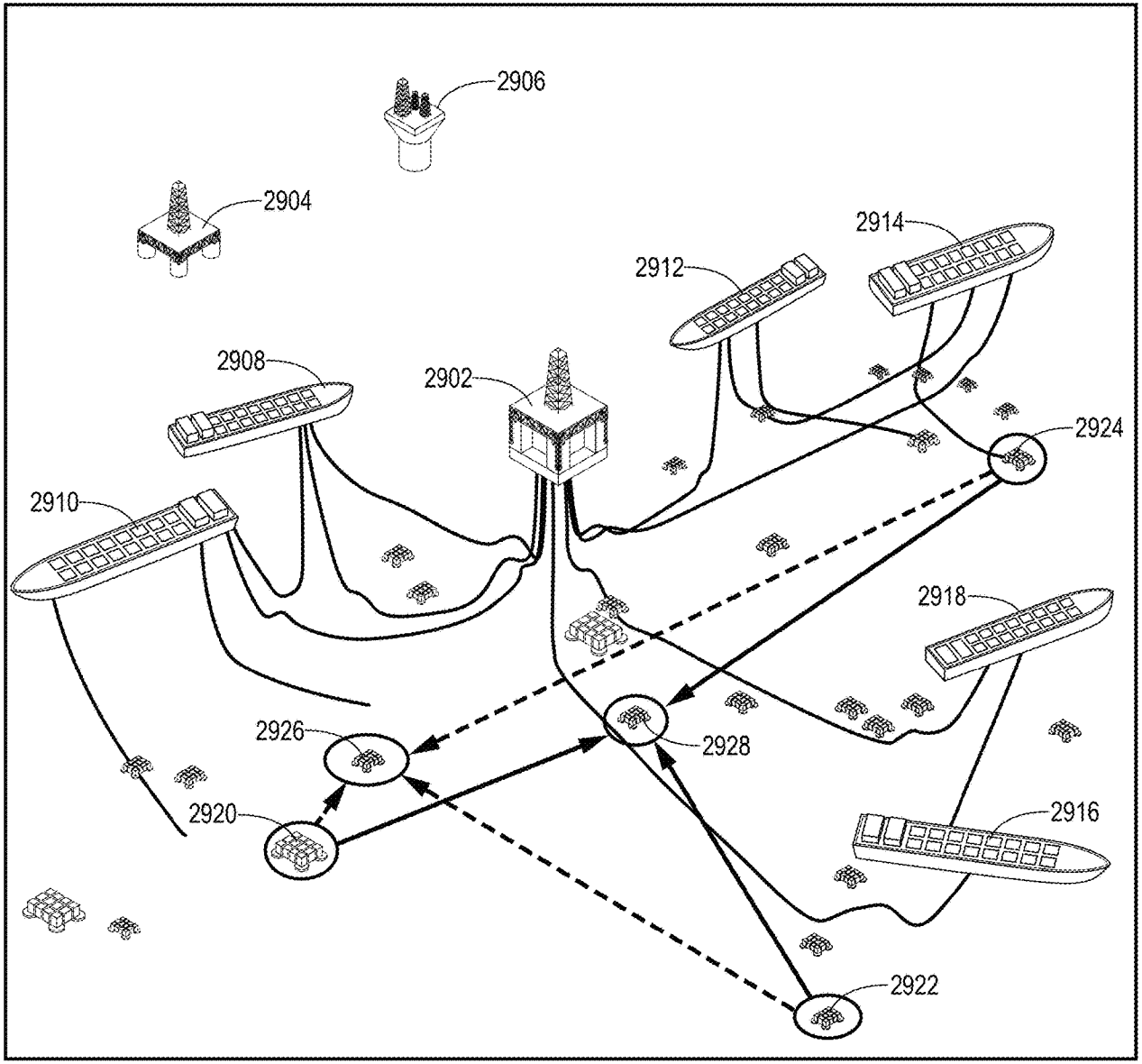
FIG. 29 is a perspective view of an example subsea downhole oil water solids separation, according to some embodiments.

FIG. 29 is a perspective view of an example subsea downhole oil water solids separation, according to some embodiments. FIG. 29 depicts a number of offshore rigs—an offshore rig 2902, an offshore rig 2904, and an offshore rig 2906. FIG. 29 also depicts a number of ships-a ship 2908, a ship 2910, a ship 2912, a ship 2914, a ship 2916, and a ship 2918. The offshore rigs 2902-2906 and the ships 2908-2918 may include equipment to separate out nonproduction fluid (such as water) from the production fluid. The offshore rigs 2902-2906 and the ships 2908-2918 may also include storage for the production fluid, the nonproduction fluid, etc.

FIG. 29 also depicts a number of production wells-a production well 2920, a production well 2922, and a production well 2924. FIG. 29 also depicts a water disposal well 2926 and a solids disposal well 2928. The fluids/solids from the production wells 2920-2924 may be transported to any of the oil rigs 2902-2906, any of the ships 2908-2918 or another subsurface well. For example, the nonproduction fluid and the solids from the production wells 2920-2924 may be transported to the water disposal well 2926 and the solids disposal well 2928, respectively. Additionally, production fluid processing and separation, nonproduction fluid processing and/or solids processing may occur at one of more of the locations identified in FIG. 29.

Figure 30:
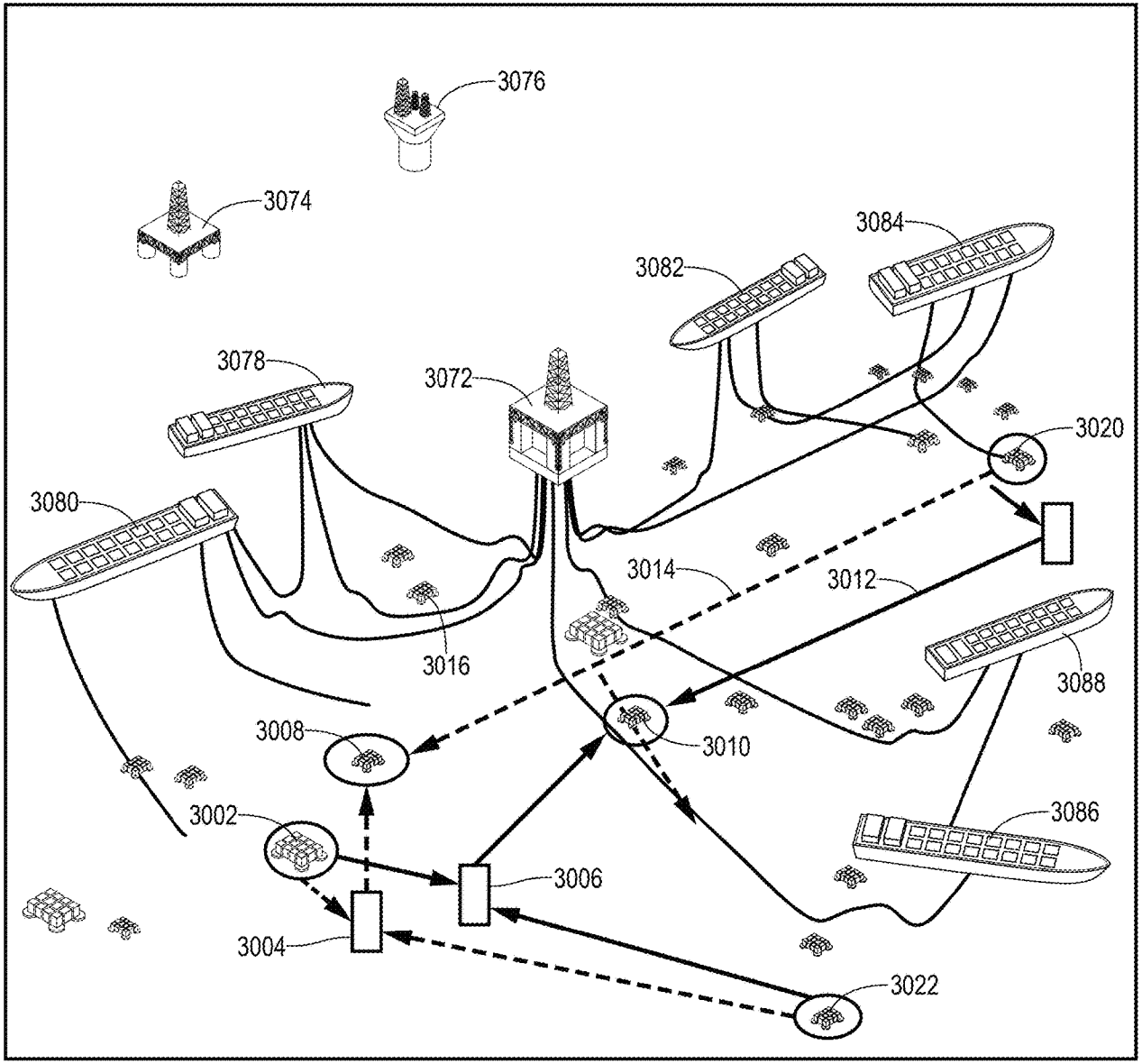
FIG. 30 is a perspective view of example locations in which example embodiments may be used.

FIG. 30 is a perspective view of example locations in which example embodiments may be used. FIG. 30 includes 11 example locations. A first example location includes a well 3002 where fluids may exit the well or are injected therein. A second example location includes an oil-cut processing unit 3004. For example, a flow diverter may divert oil-cut fluid to an oil-cut processing unit 3004. The oil-cut processing unit 3004 may include a flow diverter to remove more water from an oil-cut fluid. In some implementations, a flow diverter may divert solids, slurry, sludge, etc. to a processing unit 3006. Such solids, slurry, sludge, etc. may then be stored in a storage container or disposal well 3010. Flow diverter may be part of the storage container or disposal well 3010 to remove more oil from the slurry. The solids processing unit 3006 may include a flow diverter to remove more oil from the slurry.

FIG. 30 also depicts a number of offshore rigs—an offshore rig 3072, an offshore rig 3074, and an offshore rig 3076. FIG. 30 also depicts a number of ships—a ship 3078, a ship 3080, a ship 3082, a ship 3084, a ship 3086, and a ship 3088. The offshore rigs 3072-3076 and the ships 3078-3088 may include equipment to separate out nonproduction fluid (such as water) from the production fluid. The offshore rigs 3072-3076 and the ships 3078-3088 may also include storage for the production fluid, the nonproduction fluid, etc.

Another example location may include an oil storage and transfer unit 3008. Another example location may include a solids or slurry transfer line 3012. For example, a flow diverter may help mix, remix, stir, or agitate solids to keep them in suspension in the solids or transfer line 3012. Another example location may include a production fluids/oil-cut fluid/fluid transfer line 3014. For example, a flow diverter may help mix, remix, stir, or agitate solids and the fluids to keep them flowing properly in the production fluids/oil-cut fluid/fluid transfer line 3014. Another example location may include a well 3016 with vertical, inclined, sloped, deviated, tortuous paths.

Another example location may include a multilateral well 3018 (that includes a lateral wellbore, junction, etc. Another example location may include a horizontal well 3020. Another example location may include a main production transfer line 3022 to another subsea pumping, gathering, and/or processing station or to land-based pumping, gathering, and/or processing facility.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. As used herein, the term "or" is inclusive unless otherwise explicitly noted. Thus, the phrase "at least one of A, B, or C" is satisfied by any element from the set {A, B, C} or any combination thereof, including multiples of any element.

Example Embodiments

Example embodiments are now described.

Embodiment #1: A system comprising: a downhole separation system configured to be positioned downhole a well formed in a subsurface formation, wherein the downhole separation system is configured to receive formation fluid from the subsurface formation and configured to separate formation fluid into a production fluid and a nonproduction fluid, wherein the downhole separation system comprises, at least one device to be positioned in an opening of a downhole tubular through which the formation fluid is to be received from the subsurface formation, wherein the at least one device is to filter out at least a portion of solids in the formation fluid from entering the downhole tubular; and a controller configured to initiate an operation to clean the at least one device using a cleaning fluid.

Embodiment #2: The system of Embodiment #1, wherein the downhole separation system comprises a production fluid pump configured to pump the production fluid to a surface of the multi-bore well.

Embodiment #3: The system of any of Embodiments #1-2, wherein the well comprises a multi-bore well, wherein the formation fluid is to be received from the subsurface formation surrounding a first bore of the multi-bore well, and wherein the downhole separation system comprises, at least one solids separator configured to separate out at least a portion of the solids from the nonproduction fluid; a nonproduction fluid pump configured to pump the nonproduction fluid into a second bore of the multi-bore well for disposal into the subsurface formation surrounding the second bore; and at least one solids injector configured to inject the solids separated out from the nonproduction fluid.

Embodiment #4: The system of any of Embodiments #1-3, wherein the downhole disposal location comprises the subsurface formation surrounding a third bore of the multi-bore well.

Embodiment #5: The system of any of Embodiments #1-4, further comprising: at least one sensor configured to detect a value of a parameter that is indicative the at least one device needs to be cleaned, and wherein the controller is configured to initiate the operation to clean the at least one device using the cleaning fluid in response to the value of the parameter passing a threshold value.

Embodiment #6: The system of any of Embodiments #1-5, further comprising a cleaning device attached to the end of the coiled tubing.

Embodiment #7: The system of any of Embodiments #1-6, wherein the at least one sensor comprises a downhole sensor to monitor a change in fluid flow.

Embodiment #8: The system of any of Embodiments #1-7, wherein the downhole separation system comprises at least one solid separator configured to separate solids from at least one of the formation fluid, the production fluid, or the nonproduction fluid.

Embodiment #9: The system of any of Embodiments #1-8, wherein the at least one sensor is configured to measure a property of the materials that is being separated out from the at least one of the formation fluid, the production fluid, or the nonproduction fluid.

Embodiment #10: The system of any of Embodiments #1-9, wherein the materials comprise a solid.

Embodiment #11: The system of any of Embodiments #1-10, wherein the controller is configured to initiate the operation to apply a fluid to the at least one device in response to the property of the materials that is being separated out from the at least one of the formation fluid, the production fluid, or the nonproduction fluid falling below the threshold value.

Embodiment #12: The system of any of Embodiments #1-11, wherein the at least one sensor comprises a first sensor to measure a flow rate of at least one of the formation fluid, the production fluid, or the nonproduction fluid, and wherein the controller is configured to initiate the operation to apply the fluid to the at least one device in response to the value of the flow rate being less than a flow rate threshold value.

Embodiment #13: The system of any of Embodiments #1-12, wherein the downhole separation system comprises at least one solid separator configured to separate solids from at least one of the formation fluid, the production fluid, or the nonproduction fluid, wherein the at least one sensor comprises a second sensor to measure a property of the solids that is being separated out from the at least one of the formation fluid, the production fluid, or the nonproduction fluid, and wherein the controller is configured to initiate the operation to apply the fluid to the at least one device in response to the property of the solids that is being separated out from the at least one of the formation fluid, the production fluid, or the nonproduction fluid falling below a solids threshold value.

Embodiment #14: The system of any of Embodiments #1-13, further comprising a pump configured to pump the fluid to be applied the at least one device, wherein the controller is configured to initiate the operation to apply the fluid to the at least one device based on control of the pump to pump the fluid.

Embodiment #15: The system of any of Embodiments #1-14, wherein the fluid comprises water, wherein the pump is at a surface of the well, and wherein the system comprises a tubing fluidly coupling the pump to the at least one device.

Embodiment #16: A method comprising: performing a downhole separation of at least one of fluids or solids downhole in a well that is formed in a subsurface formation, the performing comprising, introducing a formation fluid from the subsurface formation into the well; filtering the formation fluid via at least one device to filter out solids prior to the formation fluid entering a tubular positioned in the well; measuring, using at least one sensor, a value of a parameter that is indicative that the at least one device needs to be cleaned; and cleaning the at least one device, in response to the value of the parameter passing a threshold value.

Embodiment #17: The method of Embodiment #16, wherein the well comprises a multi-bore well, wherein the formation fluid is to be received from the subsurface formation surrounding a first bore of the multi-bore well, wherein the method comprises, separating downhole the formation fluid into a production fluid and a nonproduction fluid.

Embodiment #18: The method of any of Embodiments #16-17, further comprising: separating out at least a portion of the solids from the nonproduction fluid; and disposing of the nonproduction fluid into the subsurface formation surrounding a second bore of the multi-bore well.

Embodiment #19: The method of any of Embodiments #16-18, wherein a device is positioned relative to the downhole disposal location to filter out at least a portion of solids from entering a subsurface formation of the downhole disposal location.

Embodiment #20: The method of any of Embodiments #16-19, further comprising: disposing of the solids separated out from the nonproduction fluid into a tubular connected to another local of the multi-bore well, a surface of the multi-bore well or a seafloor.

Embodiment #21: The method of any of Embodiments #16-20, wherein the downhole disposal location comprises at least one of a location below a subsea surface, a location above the subsea surface or other near seafloor location.

Embodiment #22: The method of any of Embodiments #16-21, wherein the at least one sensor is positioned downhole or at a surface of the well.

Embodiment #23: The method of any of Embodiments #16-22, further comprising enhancing cleaning, using a cleaning device attached to the end of the coiled tubing.

Embodiment #24: The method of any of Embodiments #16-23, wherein performing the downhole separation comprises, separating the formation fluid into a production fluid and a nonproduction fluid; and separate solids from at least one of the formation fluid, the production fluid, or the nonproduction fluid, wherein measuring the value of the parameter comprises measuring, using the at least one sensor, a property of the solids that is being separated out from the at least one of the formation fluid, the production fluid, or the nonproduction fluid, and wherein cleaning the at least one device comprises cleaning the at least one device in response to the property of the solids that is being separated out from the at least one of the formation fluid, the production fluid, or the nonproduction fluid falling below the threshold value.

Embodiment #25: The method of any of Embodiments #16-24, wherein performing the downhole separation comprises, separating the formation fluid into a production fluid and a nonproduction fluid; and wherein measuring the value of the parameter comprises measuring, using a first sensor of the at least one sensor, a flow rate of at least one of the formation fluid, the production fluid, or the nonproduction fluid, and wherein cleaning the at least one device comprises cleaning the at least one device in response to the value of the flow rate being less than a flow rate threshold value.

Embodiment #26: The method of any of Embodiments #16-25, wherein measuring the value of the parameter comprises measuring, using a second sensor, a property of the solids that is being separated out from the at least one of the formation fluid, the production fluid, or the nonproduction fluid, and wherein cleaning the at least one device comprises cleaning the at least one device in response to the property of the solids that is being separated out from the at least one of the formation fluid, the production fluid, or the nonproduction fluid exceeding a solids threshold value.

Embodiment #27: The method of any of Embodiments #16-26, wherein cleaning the at least one device, in response to the value of the parameter passing the threshold value comprises, pumping, using a pump, to clean the at least one device, in response to the value of the parameter passing the threshold value, wherein the pump is at a surface of the well, and wherein pumping comprises pumping, using the pump via a tubular fluidly coupling the pump to the at least one device.

The invention claimed is:

1. A system comprising:

a downhole separation system configured to be positioned downhole in a well formed in a subsurface formation, wherein the downhole separation system is configured to receive formation fluid from the subsurface formation and configured to separate formation fluid into a production fluid and a nonproduction fluid, wherein the downhole separation system comprises, at least one device to be positioned in an opening of a downhole tubular through which the formation fluid is to be received from the subsurface formation, wherein the at least one device is to filter out at least a portion of solids in the formation fluid from entering the downhole tubular; and a controller configured to initiate an operation to clean the at least one device using a cleaning fluid; and wherein the well comprises a multi-bore well, wherein the formation fluid is to be received from the subsurface formation surrounding a first bore of the multi-bore well, and wherein the downhole separation system comprises, at least one solids separator configured to separate out at least a portion of the solids from the nonproduction fluid;

a nonproduction fluid pump configured to pump the nonproduction fluid into a second bore of the multi-bore well for disposal into the subsurface formation comprising a downhole disposal location surrounding the second bore; and at least one solids injector configured to inject the portion of the solids separated out from the nonproduction fluid.

2. The system of claim 1, wherein the downhole separation system comprises a production fluid pump configured to pump the production fluid to a surface of the well.

3. The system of claim 1, wherein the downhole disposal location comprises the subsurface formation surrounding a third bore of the multi-bore well.

4. The system of claim 1, further comprising:

at least one sensor configured to detect a value of a parameter that indicates the at least one device needs to be cleaned, wherein the controller is configured to initiate the operation to clean the at least one device using the cleaning fluid in response to the value of the parameter passing a threshold value.

5. The system of claim 4, further comprising a cleaning device attached to coiled tubing, the coiled tubing to contain a flow of the cleaning fluid.

6. The system of claim 4, wherein the at least one sensor comprises a downhole sensor to monitor a change in fluid flow.

7. The system of claim 4, wherein the downhole separation system comprises at least one solids separator configured to separate solids from at least one of the formation fluid, the production fluid, or the nonproduction fluid.

8. The system of claim 7, wherein the at least one sensor is configured to measure a property of materials when separated from the at least one of the formation fluid, the production fluid, or the nonproduction fluid.

9. The system of claim 8, wherein the materials comprise the solids to be separated by the at least one solids separator.

10. The system of claim 8, wherein the controller is configured to initiate the operation to clean the at least one device in response to the property of the materials falling below the threshold value.

11. The system of claim 4, wherein the at least one sensor comprises a first sensor to measure a flow rate of at least one of the formation fluid, the production fluid, or the nonproduction fluid, and wherein the controller is configured to initiate the operation to clean the at least one device in response to the value of the flow rate being less than a flow rate threshold value.

12. The system of claim 11, wherein the downhole separation system comprises at least one solids separator configured to separate solids from at least one of the formation fluid, the production fluid, or the nonproduction fluid, wherein the at least one sensor comprises a second sensor to measure a property of the solids when separated out from the at least one of the formation fluid, the production fluid, or the nonproduction fluid, and wherein the controller is configured to initiate the operation to clean the at least one device in response to the property of the solids falling below a solids threshold value.

13. The system of claim 1, further comprising a pump configured to pump the cleaning fluid, and to be controlled by the controller.

14. The system of claim 13, wherein the fluid comprises water, wherein the pump is at a surface of the well, and wherein the system comprises a tubing fluidly coupling the pump to the at least one device.

* * * * *